US008679197B2

(12) United States Patent
Hinestroza et al.

(10) Patent No.: US 8,679,197 B2
(45) Date of Patent: Mar. 25, 2014

(54) CONFORMAL PARTICLE COATINGS ON FIBROUS MATERIALS

(71) Applicant: Cornell University, Ithaca, NY (US)

(72) Inventors: Juan P. Hinestroza, Ithaca, NY (US); Hong Dong, Perry Hall, MD (US)

(73) Assignee: Cornell University, Ithaca, NY (US)

( * ) Notice: Subject to any disclaimer, the term of this patent is extended or adjusted under 35 U.S.C. 154(b) by 0 days.

(21) Appl. No.: 13/945,015

(22) Filed: Jul. 18, 2013

(65) Prior Publication Data

US 2013/0309519 A1 Nov. 21, 2013

Related U.S. Application Data

(63) Continuation of application No. 12/988,293, filed as application No. PCT/US2009/040853 on Apr. 16, 2009, now Pat. No. 8,491,668.

(60) Provisional application No. 61/046,252, filed on Apr. 18, 2008, provisional application No. 61/056,649, filed on May 28, 2008, provisional application No. 61/081,915, filed on Jul. 18, 2008.

(51) Int. Cl.
*D06M 15/423* (2006.01)
*B32B 5/16* (2006.01)

(52) U.S. Cl.
USPC ..... 8/115.6; 428/331

(58) Field of Classification Search
USPC ..... 8/115.6; 428/331
See application file for complete search history.

(56) References Cited

U.S. PATENT DOCUMENTS 8,347,447 B2 * 1/2013 Benson et al. ..... 15/228

* cited by examiner

*Primary Examiner* — Eisa Elhilo
(74) *Attorney, Agent, or Firm* — Harris Beach PLLC

(57) ABSTRACT

Methods are provided for uniform deposition of particles on curved surfaces such as fibers and coatings formed by the particles. Particles in the size range of 10-2000 nm are deposited onto a fibrous material via electrostatic interaction between charge modified fiber material surfaces and oppositely charged particles or metal ions. Various nonmetallic, bimetallic or other charged particles are deposited onto a fibrous material via electrostatic interaction between charged modified fibrous material surfaces and oppositely charged particles. Particles can be directly assembled onto a surface of a fibrous material by controlling hydrogen bonding interactions between interfaces of fibers and functionalized particles. Metal particles can also be deposited by in situ synthesis. A method is also provided for layer-by-layer deposition of particles over a fibrous material.

20 Claims, 53 Drawing Sheets

Figure 1A:
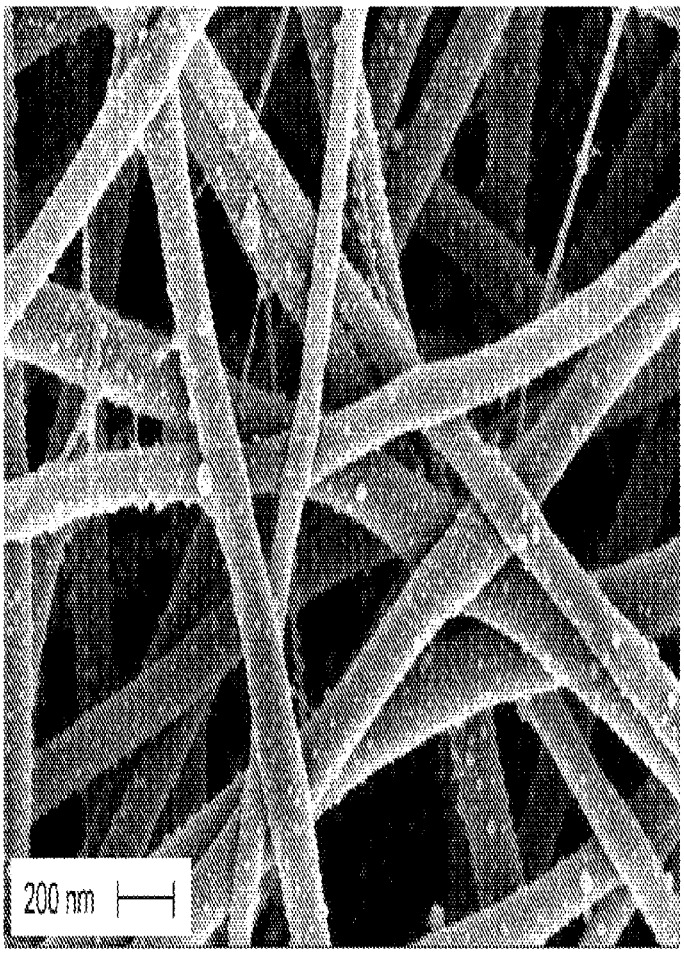

Keck SEM WD = 3 mm EHT = 2.00kV Aperture Size = 20.00μm Date: 2 Feb 2007
Mag = 60.00 KX File Name = Ag-Nylon6-pH3-01.tif Signal A = InLens Time: 11:15:08

Keck SEM WD = 3 mm EHT = 2.00kV Aperture Size = 20.00μm Date: 2 Feb 2007
Mag = 60.00 KX File Name = Ag-Nylon6-pH4-02.tif Signal A = InLens Time: 11:37:47

Keck SEM WD = 3 mm EHT = 2.00kV Aperture Size = 20.00 μm Date: 2 Feb 2007
Mag = 60.00 KX File Name = Ag-Nylon6-pH3-01.tif Signal A = InLens Time: 11:15:08

Keck SEM WD = 3 mm EHT = 2.00kV Aperture Size = 20.00 μm Date: 2 Feb 2007
Mag = 60.00 KX File Name = Ag-Nylon6-pH4-02.tif Signal A = InLens Time: 11:37:47

Keck SEM WD = 3 mm EHT = 2.00kV Aperture Size = 20.00μm Date: 2 Feb 2007
Mag = 60.00 KX File Name = Ag-Nylon6-pH5-08.tif Signal A = InLens Time: 12:15:31

Keck SEM WD = 3 mm EHT = 2.00kV Aperture Size = 20.00μm Date: 2 Feb 2007
Mag = 60.00 KX File Name = Ag-Nylon6-pH6-06.tif Signal A = InLens Time: 12:29:00

Keck SEM WD = 3 mm EHT = 2.00kV Aperture Size = 20.00 μm Date: 2 Feb 2007
Mag = 60.00 KX File Name = Ag-Nylon6-pH7-06.tif Signal A = InLens Time: 12:42:55

Keck SEM WD = 3 mm EHT = 2.00kV Aperture Size = 20.00 μm Date: 2 Feb 2007
Mag = 60.00 KX File Name = Ag-Nylon6-orig-04.tif Signal A = InLens Time: 12:54:01

Keck SEM WD = 6 mm EHT = 5.00kV Aperture Size = 30.00μm Date: 31 Aug 2006
Mag = 30.00 KX File Name = Au-cotton-1%citrate-C09.tif Signal A = InLens Time: 10:30:33

Keck SEM WD = 4 mm EHT = 2.00kV Aperture Size = 30.00μm Date: 3 Oct 2006
Mag = 50.00 KX File Name = Pt-cotton-15-1st-06.tif Signal A = InLens Time: 16:07:14

Keck SEM WD = 7 mm EHT = 5.00kV Aperture Size = 30.00μm Date: 6 Sep 2006
Mag = 20.00 KX File Name = Au-cotton-115-02.tif Signal A = InLens Time: 12:21:02

Keck SEM WD = 5 mm EHT = 5.00kV Aperture Size = 30.00μm Date: 9 Nov 2006
Mag = 30.00 KX File Name = Au-cotton-NaAuCl4-5mM-07.tif Signal A = InLens Time: 15:03:48

Keck SEM WD = 5 mm EHT = 5.00kV Aperture Size = 30.00μm Date: 9 Nov 2006
Mag = 30.00 KX File Name = Pd-cotton-Na2PdCl4-5mM-05.tif Signal A = InLens Time: 15:29:15

Keck SEM WD = 3 mm EHT = 3.00kV Aperture Size = 30.00μm Date: 7 Jul 2008
Mag = 7.48 KX File Name = washfiber06.tif Signal A = InLens Time: 11:17:51

CONFORMAL PARTICLE COATINGS ON FIBROUS MATERIALS

CROSS-REFERENCE TO RELATED APPLICATIONS

This application is a continuation of U.S. patent application Ser. No. 12/988,293, now U.S. Pat. No. 8,491,668 B2 which is a national stage application under 35 U.S.C. §371 of PCT Application No. PCT/US2009/040853, filed Apr. 16, 2009, which claims priority to and the benefit of U.S. provisional patent application Ser. No. 61/046,252 filed Apr. 18, 2008; Ser. No. 61/056,649 filed May 28, 2008; and Ser. No. 61/081,915 filed Jul. 18, 2008, each of which applications is incorporated herein by reference in its entirety.

STATEMENT REGARDING FEDERALLY SPONSORED RESEARCH OR DEVELOPMENT

The disclosed invention was made with government support under contract no. F06-CR02 from the U.S. Department of Commerce. The government has rights in this invention.

1. TECHNICAL FIELD

The present invention relates to preparation and applications of conformal particle coatings on non-planar surfaces, and more specifically to a method of surface bonding of particles onto fibrous material.

2. BACKGROUND OF THE INVENTION

Polymers play an important role in the synthesis and applications of metal nanoparticles allowing the creation of materials with unique electronic, magnetic, optical and catalytic properties (Shenhar, R.; Norsten, T. B.; Rotello, V. M. Adv. Mater. 2005, 17, 657-669; Rotello, V. M. Nanoparticles: Building Blocks for Nanotechnology; Kluwer Academic Publishers: New York, 2004). In addition to the utilization of polymers as stabilizers during the synthesis of metal nanoparticles (NPs), to prevent agglomeration in solution (Grubbs, R. B. Polym. Reviews 2007, 47, 197-215) and for controlled interfacial assembly of metal nanoparticles (Rotello, V. M. Nanoparticles: Building Blocks for Nanotechnology; Kluwer Academic Publishers: New York, 2004), the preparation of polymer-nanoparticle composites have been extensively studied (Shenhar, R.; Norsten, T. B.; Rotello, V. M. Adv. Mater. 2005, 17, 657-669). Incorporation of metal nanoparticles into polymer matrices has allowed the development of materials exhibiting unique properties arising from the nanoscale size and shape of the nanoparticles (Shenhar, R.; Norsten, T. B.; Rotello, V. M. Adv. Mater. 2005, 17, 657-669).

Metal nanoparticles have been supported on diverse substrates such as silica, metals or metal oxides, carbon, and polymers, tailored by their specific optical, electronic, catalytic, magnetic, or sensor applications (Rotello, V. M.; Building Blocks For Nanotechnology, Kluwer Academic Publishers, New York, 2004; Shipway, A. N.; Katz, E.; Willner, I., ChemPhysChem, 2000, 1, 18-52; Serp, P.; Corrias, M.; Kalck, P., Appl. Catal. A, 2003 253, 337-358). Natural cellulose fibers with nanoporous surface features have also been recently reported as substrates for the in situ synthesis of noble metal nanoparticles (He, J.; Kunitake, T.; Nakao, A., Chem. Mater., 2003, 15, 4401-4406). The metal ions were impregnated into the cellulose fibers by taking advantage of their inherent porosity followed by reduction of these ions into metal nanoparticles. The nanoporous structure and the high oxygen density of cellulose fibers appear to form an effective nanoreactor suitable for the in situ synthesis and stabilization of metal nanoparticles. A limiting feature of that approach, as revealed by the authors, is that this method is applicable only to porous cellulose fibers.

A large number of polymers have been processed into uniform fibers, with diameters in the range of several micrometers to tens of nanometers, using electrospinning techniques (Huang, Z. M.; Zhang, Y. Z.; Kotaki, M.; Ramakrishna, S. Compos. Sci. Technol. 2003, 63, 2223-2253; Li, D.; Xia, Y. Adv. Mater. 2004, 16, 1151-1170). The electrospinning process provides operational flexibility for incorporating other species into fibers. For example, metal nanoparticles have been incorporated into electrospun fibers, and unique properties of the resulted electrospun fibers were achieved by introducing these additives. Electrospun fiber mats of acrylonitrile and acrylic acid copolymers (PAN-AA) containing catalytic palladium (Pd) nanoparticles were prepared via electrospinning from homogeneous solutions of PAN-AA and $PdCl_2$ followed by reduction with hydrazine. The catalytic activities of the composite fibers were subsequently investigated (Demir, M. M.; Gulgun, M. A.; Menceloglu, Y. Z.; Erman, B.; Abramchuk, S. S.; Makhaeva, E. E.; Khokhlov, A. R.; Matveeva, V. G.; Sulman, M. G. Macromolecules 2004, 37, 1787-1792). Dodecanethiol-capped Au nanoparticles were mixed with PEO prior to electrospinning and one-dimensional arrays of Au nanoparticles within the electrospun nanofibers were observed (Kim, G.-M.; Wutzler, A.; Radusch, H.-J.; Michler, G. H.; Simon, P.; Sperling, R. A.; Parak, W. J. Chem. Mater. 2005, 17, 4949-4957). Ag nanoparticles have also been incorporated into various electrospun polymer fibers (Yang, Q. B.; Li, D. M.; Hong, Y. L.; Li, Z. Y.; Wang, C.; Qiu, S. L.; Wei, Y Synth. Met. 2003, 137, 973-974; Son, W. K.; Youk, J. H.; Lee, T. S.; Park, W. H. Macromol. Rapid Commun. 2004, 25, 1632-1637; Xu, X. Y.; Yang, Q. B.; Wang Y. Z.; Yu, H. J.; Chen, X. S.; Jing, X. B. Europ. Polym. J. 2006, 42, 2081-2087; Hong, K H.; Park, J. L.; Sul, I. H.; Youk, J. H.; Kang, T. J. J. Polym. Sci. Part B Polym. Phys. 2006, 44, 2468-2474) and these composite fibers were found to exhibit antibacterial activity (Son, W. K.; Youk, J. H.; Lee, T. S.; Park, W. H. Macromol. Rapid Commun. 2004, 25, 1632-1637; Xu, X. Y.; Yang, Q. B.; Wang Y. Z.; Yu, H. J.; Chen, X. S.; Jing, X. B. Europ. Polym. J. 2006, 42, 2081-2087; Hong, K. H.; Park, J. L.; Sul, Youk, J. H.; Kang, T. J. J. Polym. Sci. Part B Polym. Phys. 2006, 44, 2468-2474). The formation of Ag nanoparticles was usually achieved either by reducing $AgNO_3$ into Ag nanoparticles in polymer solution prior to electrospinning (Yang, Q. B.; Li, D. M.; Hong, Y. L.; Li, Z. Y.; Wang, C.; Qiu, S. L.; Wei, Y Synth. Met. 2003, 137, 973-974) or by post treatments using UV radiation, heat or chemical reduction of the electrospun polymer/$AgNO_3$ composite fibers (Son, W. K.; Youk, J. H.; Lee, T. S.; Park, W. H. Macromol. Rapid Commun. 2004, 25, 1632-1637; Xu, X. Y.; Yang, Q. B.; Wang Y. Z.; Yu, H. J.; Chen, X. S.; Jing, X. B. Europ. Polym. J. 2006, 42, 2081-2087; Hong, K. H.; Park, J. L.; Sul, I. H.; Youk, J. H.; Kang, T. J. J. Polym. Sci. Part BPolym. Phys. 2006, 44, 2468-2474).

To have the surface of the polymer fibers effectively covered with Ag nanoparticles, which is essential in applications where the amount of accessible sites is important, a large ratio of $AgNO_3$ relative to the polymer is usually incorporated into the polymer solution (Xu, X. Y.; Yang, Q. B.; Wang Y. Z.; Yu, H. J.; Chen, X. S.; Jing, X. B. Europ. Polym. J. 2006, 42, 2081-2087). Recently, it was reported that metal nanoparticles were synthesized on the surface of electrospun poly(4-vinylpyridine) fibers by taking advantage of the binding capability of pyridyl groups to metal ions and metal NPs (Dong, H.; Fey, E.; Gandelman, A. Chem. Mater. 2006, 18, 2008-2011).

Though much work was been done on flat surfaces, there is a need in the art for methods for uniform deposition of particles (in the size range of 2-2000 nm) on curved surfaces such as fibers and conformal coatings formed by the particles. Conformal coatings can be defined as uniform coatings of non-planar, topographically uneven surfaces. This need is broad with respect to both the fiber material and fiber cross sectional diameter, and also the particle materials. Furthermore, there is a need to precisely control the placement of the particles across the entire surface of fibrous materials and the thickness of the particle coating.

Citation or identification of any reference in Section 2, or in any other section of this application, shall not be considered an admission that such reference is available as prior art to the present invention.

3. SUMMARY OF THE INVENTION

The invention provides methods for uniform deposition of particles in the size range of 2-2000 nm on curved surfaces such as fibers and coatings formed by the particles.

Conformal (i.e., uniform) coatings of chemically functional particles on polymeric, non-planar, topographically uneven surfaces are provided.

Methods are also provided for deposition of metal particles onto a fiber material via electrostatic interaction between modified fiber material surfaces and oppositely charged metal particles or metal ions.

A method is also provided for deposition of various non-metallic, bimetallic or other charged particles onto a fiber material via electrostatic interaction between modified fiber material surfaces and oppositely charged particles.

A method is also provided for layer-by-layer deposition of polyectrolytes over a fiber material (e.g., cotton fibers).

In one aspect, nanofiber mats decorated with metal particles produced in accordance with the methods of the invention can exhibit strong antibacterial activity, and thus can be used, e.g., for producing wound dressing, antibacterial clothing, and non-woven antibacterial filtration materials.

In another aspect, the method of the invention can be used for fabric inkjet printing with particles. In a further aspect, fiber mats decorated with metallic or nonmetallic particles produced in accordance with the methods of the invention can be used as flexible and portable catalytic mantles, or seed for electroless deposition of metal on cellulose substrates.

A conformal coating for deposition on a non-planar surface of a substrate is provided. The coating comprises a plurality of chemically functional particles, wherein:

the particles have a cross-sectional diameter of 2-2000 nm, the average distance between adjacent particles across the entire non-planar surface is no greater than 10 times the largest cross-sectional dimension of any particle in the plurality, and the attachment of the particles to the surface is through electrostatic self-assembly or covalent bonding.

In one embodiment, the substrate is a polymer.

In another embodiment, the substrate comprises a plurality of fibers.

In another embodiment, the fibers have cross-sectional diameters of 10-100 μm.

In another embodiment, the fibers are organic or inorganic.

In another embodiment, the inorganic fibers comprise glass or ceramic.

In another embodiment, the ceramic fibers comprise alumina, beryllia, magnesia, thoria, zirconia, silicon carbide, or quartz.

In another embodiment, the fibers are a bi-component or tri-component fibers.

In another embodiment, the substrate is a textile.

In another embodiment, the textile is a woven textile, a non-woven textile, a woven composite, a knit, a braid or a yarn.

In another embodiment, the substrate comprises natural or synthetic carbohydrate-based fibers.

In another embodiment, the natural or synthetic carbohydrate-based fibers comprise cellulose, cellulose acetate or cotton.

In another embodiment, the substrate comprises natural protein-based fibers.

In another embodiment, the natural protein-based fibers comprise wool, collagen or silk.

In another embodiment, the substrate comprises organic synthetic fibers capable of participating in hydrogen bonding.

In another embodiment, the organic synthetic fibers comprise polyamides, polycarboxylic acids, polysaccharides, polyalcohols, polyamines, polyaminoacids, polyvinylpyrrolidone, polyethylene oxide or specialized fibers of block copolymers having nucleobase functionality.

In another embodiment, the organic synthetic fibers are substitutionally inert.

In another embodiment, the substitutionally inert organic synthetic fibers comprise polyamides, polyesters, fluoropolymers, polyimides or polyolefins.

In another embodiment, the particles are metallic.

In another embodiment, the particles comprise metal or metal oxide.

In another embodiment, the particles are organic.

In another embodiment, the organic particles are selected from the group consisting of polystyrene sulfonate based particles, polyacrylate based particles, and polyglutamate based particles, polyalkylammonium salt based particles, and cyclic polydiallylammonium salt based particles.

In another embodiment, the particles are inorganic and non-metallic.

In another embodiment, the particles comprise $SiO_2$.

In another embodiment, the particles are hybrid particles.

In another embodiment, the hybrid particles are semiconductor quantum dots or core/shell particles comprising materials selected from the group consisting of metals, metal oxides, polymers and non-metal oxides.

In another embodiment, the particles are spherical and/or non-spherical.

In another embodiment, the particles are functionalized.

In another embodiment, the particles are functionalized metal particles, functionalized metal oxide particles, functionalized non-metal oxide particles or functionalized organic polymeric particles.

A polymeric non-planar surface comprising the conformal coating is also provided.

A method for surface-bonding particles to a non-planar surface of a substrate to produce a conformal coating is also provided. The method can comprise the steps of:

(a) providing a substrate comprising a non-planar surface;

(b) chemically modifying the non-planar surface to impart a surface charge; and (c) depositing complementary charged particles on the non-planar surface, producing the conformal coating of surface-bonded particles, wherein:

the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic self-assembly or covalent bonding.

A method for surface-bonding metallic particles to a non-planar surface of a substrate to produce a conformal coating is also provided. The method can comprise the steps of:

(a) providing a substrate comprising a non-planar surface;

(b) depositing complementary charged metal ions or complementary charged metal complexes on the non-planar surface; and (c) treating the complementary charged metal ions or complementary charged metal complexes deposited on the non-planar surface with a treatment selected from the group consisting of treating with a reducing agent, treating with a base or heating, producing the conformal coating of surface-bonded metallic particles, wherein:

the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic bonding.

A method for surface-bonding particles to a chemically modified non-planar surface of a substrate to produce a conformal coating is also provided. The method can comprise the steps of:

(a) providing a substrate comprising a chemically modified non-planar surface; and (b) covalently attaching chemically functional particles to the chemically modified non-planar surface, producing the conformal coating of surface-bonded particles, wherein:

the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through covalent bonding.

A method for surface-bonding particles to a non-planar surface of a substrate to produce a conformal coating is also provided. The method can comprise the comprise the steps of:

(a) providing a substrate comprising a non-planar surface wherein the non-planar surface comprises hydrogen bond donors/acceptors; and (b) depositing chemically functional particles on the non-planar surface, producing the conformal coating of surface-bonded particles, wherein:

the chemically functional particles comprise hydrogen bond donors/acceptors, hydrogen bonding occurs between the hydrogen bond donors/acceptors on the particles and complementary hydrogen bond donors/acceptors on the non-planar surface, the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic self-assembly mediated by hydrogen bonding.

A method for surface-bonding particles to a non-planar surface of a substrate to produce a conformal coating is also provided. The method can comprise the steps of:

(a) providing a substrate comprising a non-planar surface;

(b) plasma-treating the non-planar surface to impart a surface charge; and (c) depositing complementary charged particles on the non-planar surface, producing the conformal coating of surface-bonded particles, wherein:

the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic self-assembly.

A method for surface-bonding metallic particles to a non-planar surface of a substrate to produce a conformal coating is also provided. The method can comprise the steps of:

(a) providing a substrate comprising a non-planar surface;

(b) plasma-treating the non-planar surface to impart a surface charge;

(c) depositing complementary charged metal ions or complementary charged metal complexes on the non-planar surface; and (d) treating the complementary charged metal ions or complementary charged metal complexes deposited on the non-planar surface with a treatment selected from the group consisting of treating with a reducing agent, treating with a base or heating, producing the conformal coating of surface-bonded metallic particles, wherein:

the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic bonding.

In one embodiment, the substrate comprises a carbohydrate-based polymer or a protein-based polymer.

In another embodiment, the substrate comprises a plurality of fibers.

In another embodiment, the fibers have cross-sectional diameters of 10 nm-100 μm.

In another embodiment, the fibers are organic or inorganic.

In another embodiment, the inorganic fibers comprise glass or ceramic.

In another embodiment, the ceramic fibers comprise alumina, beryllia, magnesia, thoria, zirconia, silicon carbide, or quartz.

In another embodiment, the fiber is a bi-component or tri-component fiber.

In another embodiment, the substrate comprises natural or synthetic carbohydrate-based fibers.

In another embodiment, the natural or synthetic carbohydrate-based fibers comprise cellulose, cellulose acetate or cotton.

In another embodiment, the substrate comprises natural protein-based fibers.

In another embodiment, the natural protein-based fibers comprise wool, collagen or silk.

In another embodiment, the surface comprises organic synthetic fibers.

In another embodiment, the organic synthetic fibers comprise polyamides, polycarboxylic acids, polysaccharides, polyalcohols, polyamines, polyaminoacids, polyvinylpyrrolidone, polyethylene oxide or specialized fibers of block copolymers having nucleobase functionality.

In another embodiment, the organic synthetic fiber is substitutionally inert.

In another embodiment, the substitutionally inert organic synthetic fiber comprises polyamides, polyesters, fluoropolymers, polyimides or polyolefins.

In another embodiment, the substrate is a textile.

In another embodiment, the textile is a woven textile, a non-woven textile, a woven composite, a knit, a braid or a yarn.

In another embodiment, the textile is a composite of synthetic fiber and natural fiber, a composite of synthetic fibers, or a composite of natural fibers including, but not limited to, cotton and nylon blends, cotton and wool blends, cotton and polyester blends.

In another embodiment, the textile is a composite of natural fibers, organic synthetic fibers or non-organic synthetic fibers.

In another embodiment, the particles are metallic.

In another embodiment, the metallic particles comprise metal or metal oxide.

In another embodiment, the metallic particles comprise metal or metal oxide.

In another embodiment, the particles are organic.

In another embodiment, the organic particles are polystyrene sulfonate based particles, polyacrylate based particles, and polyglutamate based particles, polyalkylammonium salt based particles, and cyclic polydiallylammonium salt based particles.

In another embodiment, the particles are inorganic and non-metallic.

In another embodiment, the particles comprise $SiO_2$.

In another embodiment, the particles are hybrid particles.

In another embodiment, the hybrid particles are semiconductor quantum dots or core/shell particles comprising materials selected from the group consisting of metals, metal oxides, polymers and non-metal oxides.

In another embodiment, the particles are spherical and/or non-spherical.

In another embodiment, the particles have a cross-sectional diameter of 2-2000 nm.

In another embodiment, the particles are functional devices comprising an organic or an inorganic component.

In another embodiment, a charged organic molecule, an organic molecule that becomes charged after reacting with the non-planar surface or an ionizing chemical reagent is used to chemically modify the non-planar surface to impart the surface charge.

In another embodiment, a charged organic molecule, an organic molecule that becomes charged after reacting with the non-planar surface or an ionizing chemical reagent is used to treat the complementary charged metal ions or complementary charged metal complexes deposited on the non-planar surface.

In another embodiment, the non-planar surface is chemically modified with an organic molecule that comprises:

a first functional group that reacts at the repeating functional groups of the non-planar surface; and a second functional group that allows covalent attachment of chemically modified particles.

In one embodiment, the chemically modified particles comprise surface groups that allow covalent attachment of the chemically modified non-planar surface.

In another embodiment, the chemically modified particles are functionalized metal particles, functionalized metal oxide particles, functionalized non-metal oxide particles or functionalized organic polymeric particles.

In another embodiment, the non-planar substrate comprises a carbohydrate-based polymer or a protein-based polymer having positive charge, and the complementary charged metal complexes have negative charge.

In another embodiment, the positive charge is imparted using an alkyl ammonium salt of the formula $(R_1, R_2, R_3, R_4)—N^+$, wherein:

$R_1$ comprises a reactive group suitable for functionalizing the primary alcohol of the carbohydrate backbone or the primary amines of the protein backbone, the reactive group is selected from the group consisting of epoxides, alkyl iodides/bromide/chlorides, sulfonic acid esters, and activated carboxylic acids, and $R_2$-$R_4$ are selected from the group consisting of aliphatic carbon chains and groups comprising a 5- or 6-membered cyclic ammonium salt.

In another embodiment, the positive charge is imparted using a cationic N-alkylated aromatic heterocycle.

In another embodiment, the cationic N-alkylated aromatic heterocycle is selected from the group consisting of pyridinium and imidazolium derivatives having the following general structure:

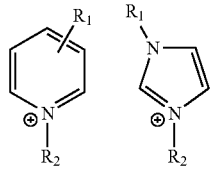

wherein:

$R_1$ comprises a reactive group suitable for functionalizing the primary alcohol of the carbohydrate backbone or the primary amines of the protein backbone, and $R_2$ is H, $CH_3$, $CH_2CH_3$ or similar aliphatic carbon chains.

In another embodiment, the reactive group is selected from the group consisting of epoxides, alkyl iodides, alkyl bromides, alkyl chlorides, sulfonic acid esters, and activated carboxylic acids.

In another embodiment, the cationic N-alkylated aromatic heterocycle is selected from the group consisting of pyridinium and imidazolium derivatives having the following general structure:

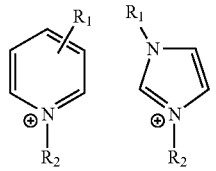

wherein:

$R_1$ is H, and $R_2$ comprises a reactive group suitable for functionalizing the primary alcohol of the carbohydrate backbone or the primary amines of the protein backbone.

In another embodiment, the reactive group is selected from the group consisting of epoxides, alkyl iodides, alkyl bromides, alkyl chlorides, sulfonic acid esters and activated carboxylic acids.

In another embodiment, the positive charge is imparted using a sulfonium salt of the formula $(R_1,R_2R_3)$—$S^+$, wherein:

$R_1$ comprises a reactive group suitable for functionalizing the primary alcohol of the carbohydrate backbone or the primary amines of the protein backbone, and $R_2$ and $R_3$ are aliphatic carbon chains.

In another embodiment, the reactive group is selected from the group consisting of epoxides, alkyl iodides, alkyl bromides, alkyl chlorides, sulfonic acid esters and activated carboxylic acids.

In another embodiment, the non-planar substrate comprises a carbohydrate-based polymer having negative charge, and the complementary charged metal ions have positive charge.

In another embodiment, the non-planar surface comprises a polymer having negative charge, and the complementary charged metal ions have positive charge.

In another embodiment, the negative charge is imparted using carboxylates of the formula R—$CH_2$—COO—, wherein R comprises a reactive group for functionalizing the primary alcohol of the carbohydrate backbone.

In another embodiment, the reactive group is selected from the group consisting of epoxides, alkyl iodides, alkyl bromides, alkyl chlorides and sulfonic acid esters.

In another embodiment, the plasma is oxygen plasma, the surface charge is negative, and the particles are positively charged.

In another embodiment, the plasma is oxygen plasma, the surface charge is negative, and the complementary charged metal ions or metal complexes are positively charged.

In another embodiment, the plasma is ammonia/helium plasma, the surface charge is positive, and the complementary charged particles are negatively charged.

In another embodiment, the plasma is ammonia/helium plasma, the surface charge is positive, and the complementary charged metal ions or metal complexes are negatively charged.

In another embodiment, the depositing step is conducted in an aqueous solution.

In another embodiment, the treating step is conducted in an aqueous or organic solution.

In another embodiment, the methods of the invention can be carried out at a temperature range above 273° K.

In another embodiment, the methods of the invention can be carried out at pH greater than 1.

In another embodiment, the complementary charged metal ions are positively charged and the surface-bonded metallic particles produced are metal oxide particles.

In another embodiment, the non-planar surface is a carbohydrate-based polymer or a protein based polymer having a positive surface charge, and the complementary charged particles are negatively charged.

In another embodiment, the positive charge is imparted using an alkyl ammonium salt of the formula $(R_1, R_2, R_3, R_4)$—$N^+$, wherein: $R_1$ comprises a reactive group suitable for functionalizing the primary alcohol of the carbohydrate backbone or the primary amines of the protein backbone, and $R_2$-$R_4$ are aliphatic carbon chains or groups comprising a 5- or 6-membered cyclic ammonium salt.

In another embodiment, the reactive group is selected from the group consisting of epoxides, alkyl iodides, alkyl bromides, alkyl chlorides, sulfonic acid esters, and activated carboxylic acids.

In another embodiment, the positive charge is imparted using cationic N-alkylated aromatic heterocycles.

In another embodiment, the aromatic heterocycles are selected from the group consisting of pyridinium and imidazolium derivatives having the following general structure:

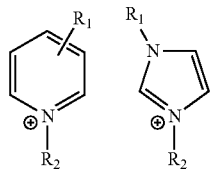

wherein:

$R_1$ comprises a reactive group suitable for functionalizing the primary alcohol of the carbohydrate backbone or the primary amines of the protein backbone, and $R_2$ is an aliphatic carbon chain.

In another embodiment, the reactive group is selected from the group consisting of epoxides, alkyl iodides, alkyl bromides, alkyl chlorides, sulfonic acid esters, and activated carboxylic acids.

In another embodiment, the aromatic heterocycles are selected from the group consisting of pyridinium and imidazolium derivatives having the following general structure:

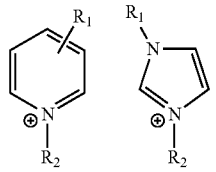

wherein:

$R_1$ is H, and $R_2$ comprises a reactive group suitable for functionalizing the primary alcohol of the carbohydrate backbone or the primary amines of the protein backbone.

In another embodiment, the reactive group is selected from the group consisting of epoxides, alkyl iodides, alkyl bromides, alkyl chlorides, sulfonic acid esters and activated carboxylic acids.

In another embodiment, the positive charge is imparted using a sulfonium salt of the formula $(R_1,R_2R_3)$—$S^+$, wherein $R_1$ comprises a reactive group suitable for functionalizing the primary alcohol of the carbohydrate backbone or the primary amines of the protein backbone, and $R_2$ and $R_3$ are aliphatic carbon chains.

In another embodiment, the reactive group is selected from the group consisting of epoxides, alkyl iodides/bromide/chlorides, sulfonic acid esters and activated carboxylic acids.

In another embodiment, the non-planar surface is a carbohydrate-based polymer having a negative surface charge, and the complementary charged particles are positively charged.

In another embodiment, the non-planar surface is a polymer having a negative surface charge, and the particles are positively charged.

In another embodiment, the complementary charged particles are metal or metal oxide particles functionalized with a chemical reagent having at least one group capable of binding to the metal or metal oxide and at least one group that is charged.

In another embodiment, the complementary charged particles are organic polymeric particles having positively charged surfaces.

In another embodiment, the positively charged surfaces comprise polyalkylammonium salts or cyclic polydiallylammonium salts.

In another embodiment, the complementary charged particles are organic polymeric particles having negatively charged surfaces.

In another embodiment, the negatively charged surfaces comprise polystyrene sulfonate, polyacrylic acid or polyglutamic acid.

In another embodiment, the negative charge is imparted using carboxylates of the formula $R—CH_2—COO—$, wherein R comprises a reactive group for functionalizing the primary alcohol of the carbohydrate backbone.

In another embodiment, the reactive group is selected from the group consisting of epoxides, alkyl iodides, alkyl bromides, alkyl chlorides and sulfonic acid esters.

In another embodiment, the negative charge is imparted using phosphonates of the formula $R_1—CH_2—PO_3R_2—$, wherein $R_1$ comprises a reactive group suitable for functionalizing the primary alcohol of the carbohydrate backbone including, but not limited to epoxides, alkyl iodides/bromides/chlorides, and sulfonic acid esters, and $R_2$ is an aliphatic carbon chains.

In another embodiment, the method comprises the step of phosphorylating the primary alcohol of the carbohydrate backbone using a suitable phosphorylating agent to confer the negative charge.

In another embodiment, the phosphorylating agent is an enzymatic phosphorylating agent.

In another embodiment, the negative charge is imparted using sulfonates of the formula $R—CH_2—SO_3—$, wherein R comprises a reactive group suitable for functionalizing the primary alcohol of the carbohydrate backbone.

In another embodiment, the reactive group is selected from the group consisting of epoxides, alkyl iodides, alkyl bromides, alkyl chlorides and sulfonic acid esters.

In another embodiment, the method comprises the step of alkylating the primary alcohol of the carbohydrate backbone using 1,3-propane sultone or 1,4-butane sultone to confer the negative charge.

In another embodiment, the negative charge is imparted using sulfonates of the formula $R—CH_2—OSO_3—$, wherein R comprises a reactive group suitable for functionalizing the primary alcohol of the carbohydrate backbone.

In another embodiment, the reactive group is selected from the group consisting of epoxides, alkyl iodides, alkyl bromides, alkyl chlorides and sulfonic acid esters.

In another embodiment, the method comprises the step of alkylating the primary alcohol of the carbohydrate backbone using 5- or 6-membered ring sulfate esters to confer the negative charge.

In another embodiment, the depositing step is conducted in an aqueous suspension.

In another embodiment, the depositing step is conducted at a temperature above 273° K.

In another embodiment, the depositing step is conducted at a pH above 1.

In another embodiment, the chemically functional particles comprise surface groups that are capable of hydrogen bonding with the non-planar surface, or are functionalized to produce surface groups capable of hydrogen bonding with the non-planar surface.

In another embodiment, the particles are metal or metal oxide particles, and functionalized with a chemical reagent that has at least one reactive group that is capable of binding to the metal or metal oxide particles and at least one group that is a hydrogen bond donor/acceptor.

In another embodiment, the hydrogen bond donors/acceptor is selected from the group consisting of carboxylic acids, amides, imides, amines, alcohols and nucleobases.

In another embodiment, the chemically functional particles are organic polymeric particles bearing hydrogen bonding donors/acceptors.

In another embodiment, the hydrogen bonding donors/acceptors are polymers or copolymers comprising polyamides, polycarboxylic acids, polysaccharides, polyalcohols, polyamines, polyaminoacids, polyvinylpyrrolidone or polyethylene oxide, or specialized block copolymers having nucleobase functionality.

In another embodiment, the substrate comprises organic synthetic fibers with surface groups that are capable of hydrogen bonding with the particles.

In another embodiment, the substrate is selected from the group consisting of polyamides, polycarboxylic acids, polysaccharides, polyalcohols, polyamines, polyaminoacids, polyvinylpyrrolidone, polyethylene oxide or specialized fibers of block copolymers having nucleobase functionality.

In another embodiment, the substrate comprises nylon fibers or a combination of nylon fibers.

In another embodiment, the depositing step is conducted in an aqueous suspension.

In another embodiment, the depositing step is conducted at a temperature above 273° K.

In another embodiment, the depositing step is conducted at a pH greater than 1.

In another embodiment, the method comprises controlling hydrogen bonding interactions between the non-planar surface and the particles by controlling the pH.

A conformal coating produced by any of the methods of the invention is also provided.

A surface-bonded particle produced by any of the methods of the invention is also provided.

A method for preventing microbial contamination of a wound in a human or animal subject is also provided. The method can comprise applying to the wound a substrate with a non-planar surface, wherein the non-planar surface is coated with a conformal coating of the invention.

A method for producing enhanced wound healing properties in a substrate is also provided. The method can comprise applying the conformal coating to a non-planar surface of the substrate.

A method for preventing or inhibiting biofilm accumulation on a non-planar surface is also provided. The method can comprise applying to the surface the conformal coating.

A method for preventing microbial contamination of a filtration medium is also provided. The method can comprise applying the conformal coating to a non-planar surface of the medium.

A method for producing catalytic properties in a catalytic mantle is also provided. The method can comprise applying the conformal coating to a non-planar surface of the catalytic mantle.

A method for producing enhanced spectroscopic properties in a material is also provided. The method can comprise applying the conformal coating to a non-planar surface of the material. In one embodiment, the spectroscopic properties are selected from the group consisting of Raman, infrared and fluorescence spectroscopic properties.

A method for producing enhanced magnetic properties in a material is also provided. The method can comprise applying the conformal coating to a non-planar surface of the material.

A method for producing self-cleaning properties in textile goods is also provided. The method can comprise applying the conformal coating to a non-planar surface of the textile goods.

A method for producing superhydrophobic and/or superoleophobic properties in textiles goods is also provided. The method can comprise applying the conformal coating to a non-planar surface of the textile goods.

A method for producing electrical conductivity in a substrate is also provided. The method can comprise applying the conformal coating to a non-planar surface of the substrate.

A method for producing thermal conductivity in a substrate is also provided. The method can comprise applying the conformal coating to a non-planar surface of the substrate.

A method for producing insulating properties in a substrate is also provided. The method can comprise applying the conformal coating to a non-planar surface of the substrate.

A method for regulating the absorption, reflection or scattering of light by a substrate is also provided. The method can comprise applying the conformal coating to a non-planar surface of the substrate. In one embodiment, the light is UV, visible, near infrared or infrared.

The invention also provides an antimicrobial article comprising a substrate and the conformal coating deposited on a non-planar surface of the substrate.

The invention also provides a wound-healing article comprising a substrate and the conformal coating deposited on a non-planar surface of the substrate.

The invention also provides a biofilm-inhibitory article comprising a substrate and the conformal coating deposited on a non-planar surface of the substrate.

The invention also provides a catalytic mantle comprising a substrate and the conformal coating deposited on a non-planar surface of the substrate.

The invention also provides an article with enhanced spectroscopic properties comprising a substrate and the conformal coating deposited on a non-planar surface of the substrate. In one embodiment, the spectroscopic properties are selected from the group consisting of Raman, infrared and fluorescence spectroscopic properties.

The invention also provides an article with enhanced magnetic properties comprising a substrate and the conformal coating deposited on a non-planar surface of the substrate.

The invention also provides a textile with self-cleaning properties comprising a textile and the conformal coating deposited on a non-planar surface of the textile.

The invention also provides a textile with superhydrophobic and/or superoleophobic properties comprising a textile and the conformal coating deposited on a non-planar surface of the textile.

The invention also provides an article with enhanced electrical conductivity comprising a substrate and the conformal coating deposited on a non-planar surface of the substrate.

The invention also provides an article with enhanced thermal conductivity comprising a substrate and the conformal coating deposited on a non-planar surface of the substrate.

The invention also provides an article with enhanced insulating properties comprising a substrate and the conformal coating deposited on a non-planar surface of the substrate.

The invention also provides an article comprising a substrate and the conformal coating deposited on a non-planar surface of the substrate, wherein the absorption, reflection or scattering of light by the substrate is regulated by the conformal coating. In one embodiment, the light is UV, visible, near infrared or infrared.

4. BRIEF DESCRIPTION OF THE DRAWINGS

The present invention is described herein with reference to the accompanying drawings, in which similar reference characters denote similar elements throughout the several views. It is to be understood that in some instances, various aspects of the invention may be shown exaggerated or enlarged to facilitate an understanding of the invention.

FIGS. 1A-F. Field Emission Scanning Electron Microscopy (FESEM) images: assembly of Ag NPs from Ag colloidal solutions with various pH values, (a) pH 3M, (b) pH 4.0, (c) pH 5.0, (d) pH 6.0, (e) pH 7.0, and (f) pH 9.7.

Figure 2A:
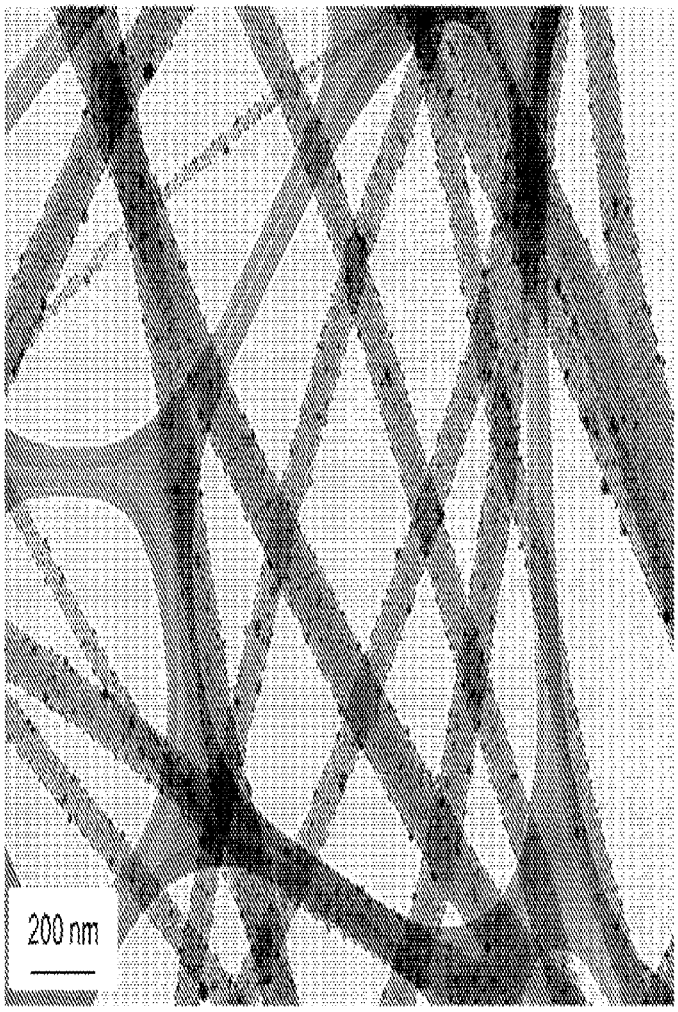
Figure 2B:
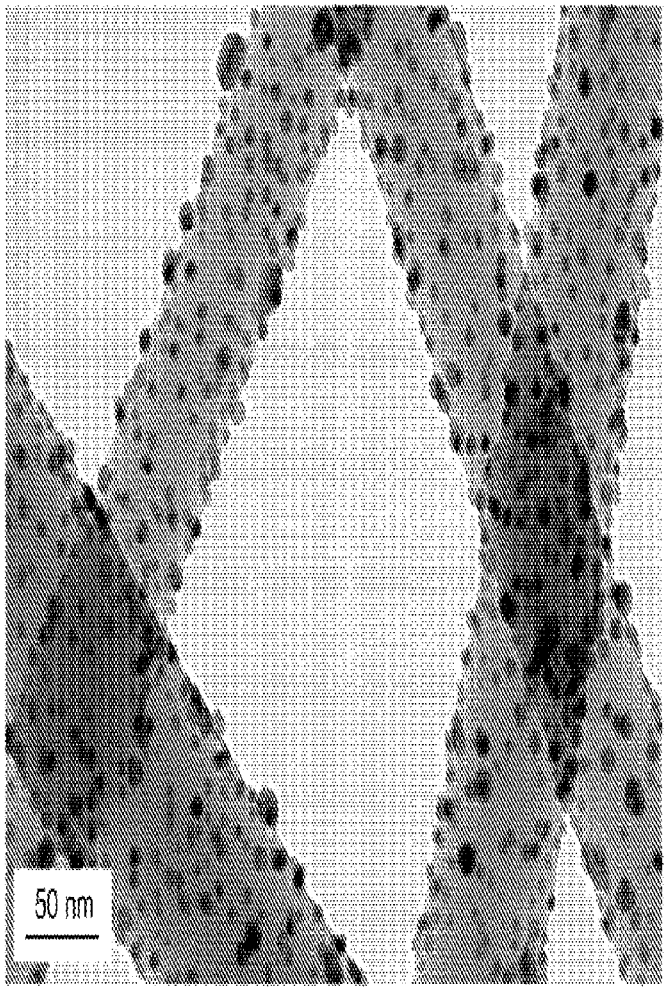

FIGS. 2A-B. Transmission Electron Microscopy (TEM) images at low magnification (a) and high magnification (b) of Ag NPs on nylon 6 nanofibers obtained from immersing the fibers in a solution of Ag NPs with pH 5.

Figure 3:
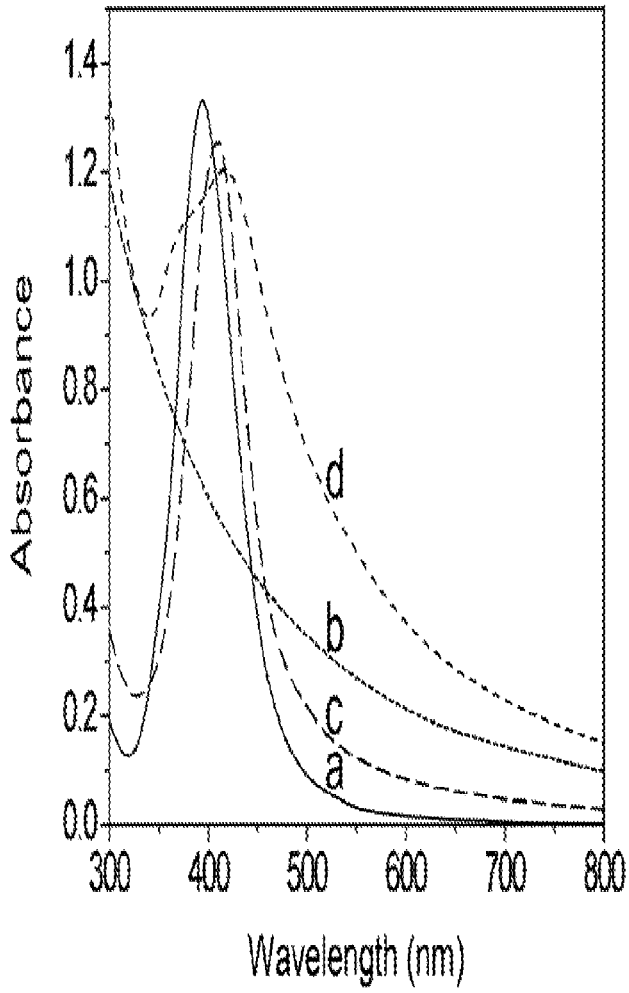

FIG. 3. Ultra Violet visible (UV-vis) spectra for (a) diluted solution of as-synthesized Ag NPs at a ratio of 1:1 with water, (b) nylon 6 nanofiber mat, (c) wet Ag-nylon 6 nanofiber mat, and (d) dried Ag-nylon 6 nanofiber mat.

Figure 4A:
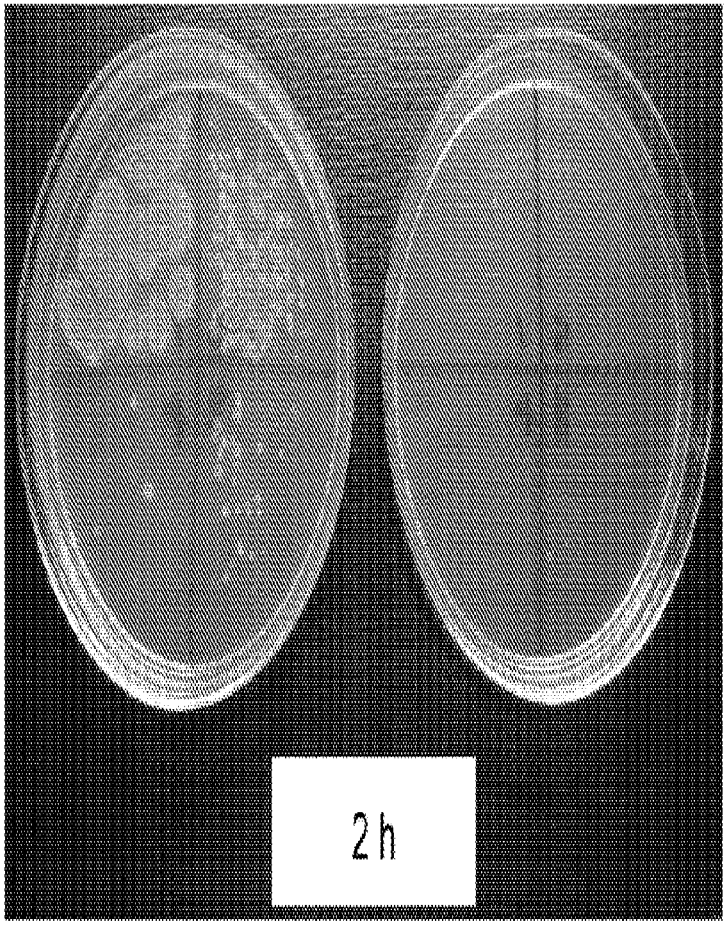
Figure 4B:
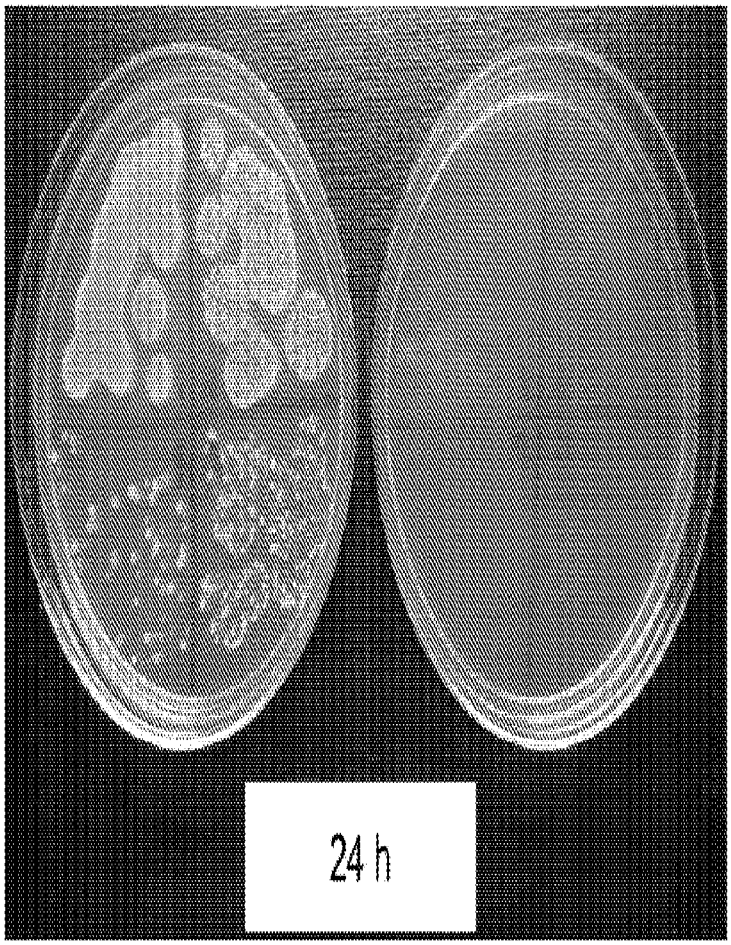

FIGS. 4A-B. Antibacterial results of nylon 6 nanofiber mats without (left) and with (right) Ag NPs on *E. coli* after incubation for (a) a 2 hour contact time, (b) a 24 hour contact time. The extraction of bacterial solution after the contact time was diluted to $10^1$, $10^2$, and $10^3$ times. Then the extraction and three diluents were incubated on four zones of a nutrient agar plate at 37 Celsius for 18 hours.

FIGS. 5A-D. TEM images: (a) and (b) assembly of Au NPs on nylon 6 nanofibers at pH 5; (c) and (d) assembly of Pt NPs on nylon 6 fibers at pH 5.

Figure 6A:
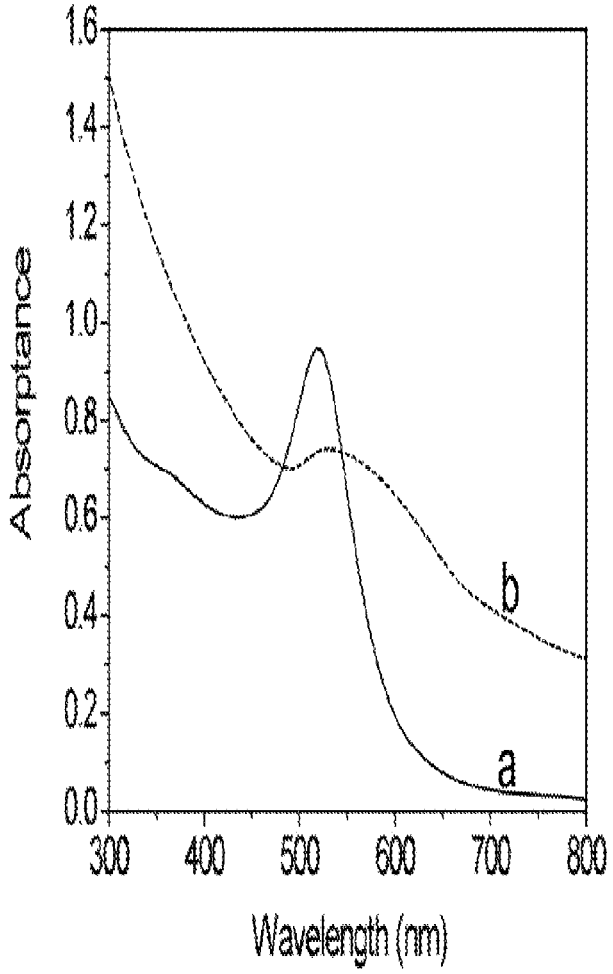
Figure 6B:
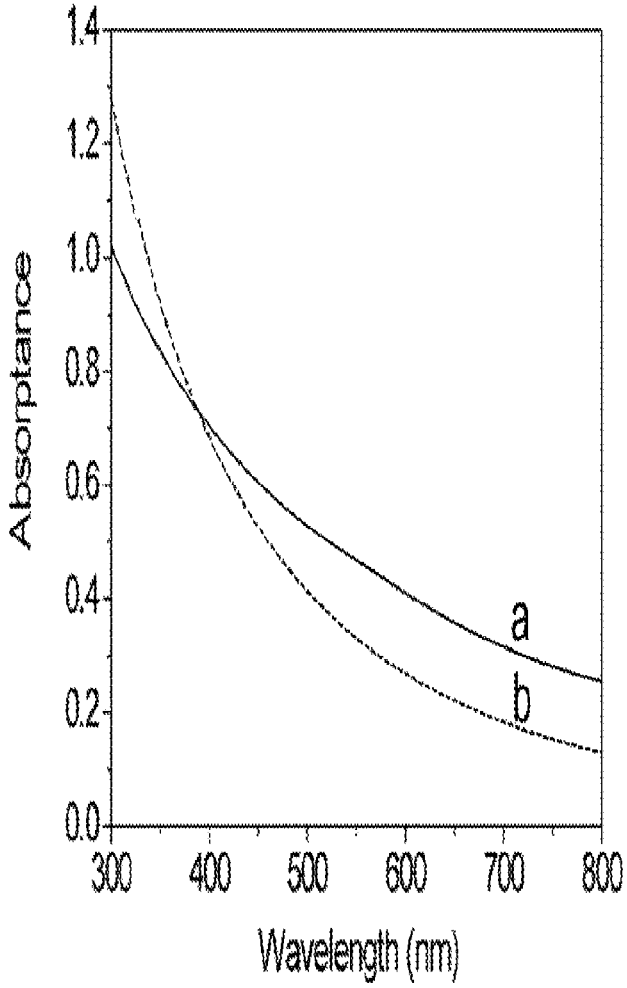

FIGS. 6A-B. (A) UV-vis spectra for (a) half-diluted solution of Au NPs and (b) Au-nylon 6 nanofiber mat; (B) UV-vis spectra for (a) half-diluted solution of Pt NPs and (b) Pt-nylon 6 nanofiber mat.

Figure 7A:
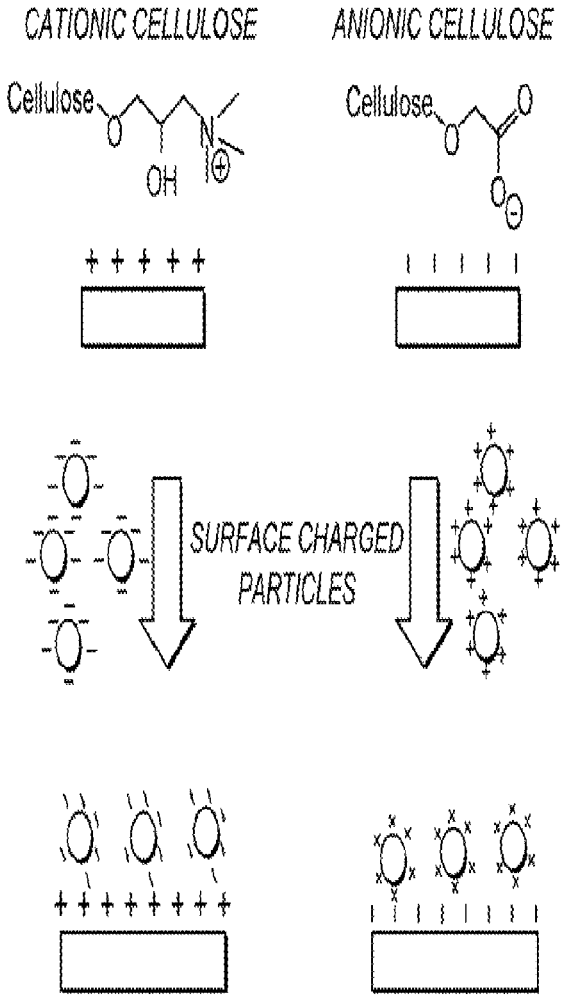

FIG. 7A. Direct assembly using (left) negatively charged nanoparticles (NPs) in a colloidal suspension onto cationic cellulose, and (right) positively charged NPs in a colloidal suspension onto anionic cellulose.

Figure 7B:
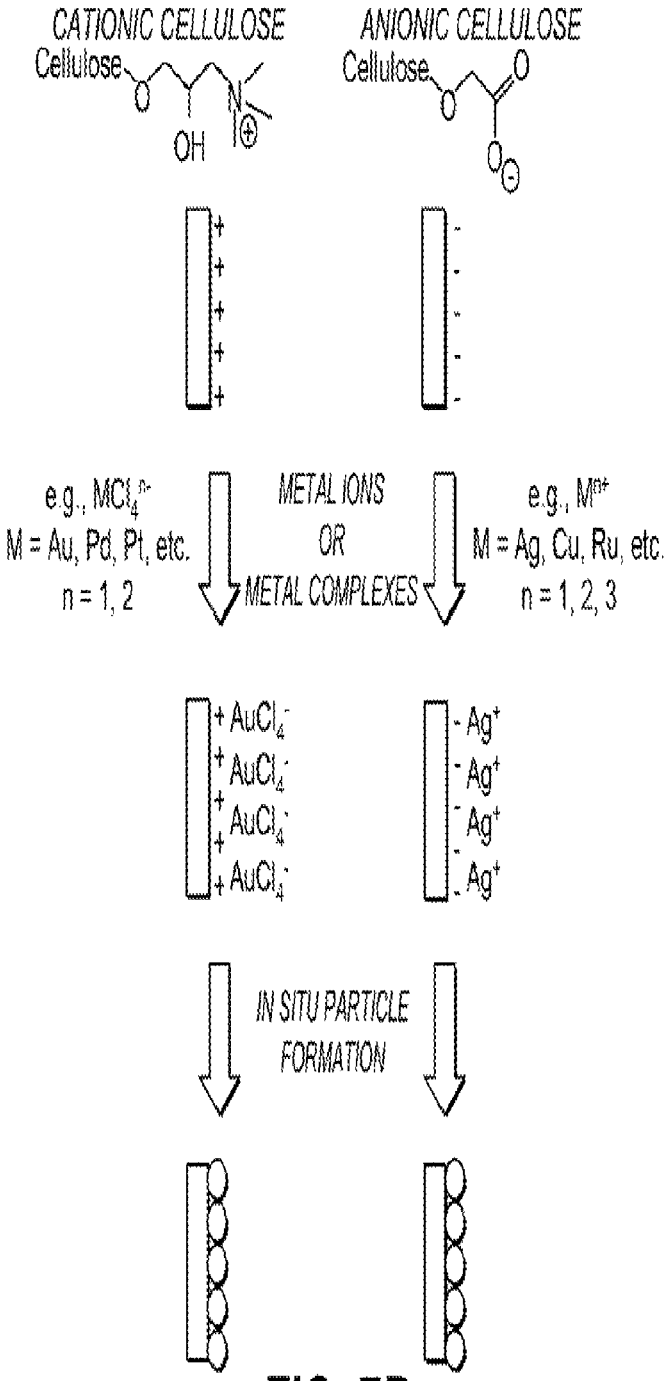

FIG. 7B. In-situ synthesis of metallic NPs using (left) negatively charged metal complexes on cationic cellulose, (right) positively charged metal ions on anionic cellulose.

Figure 8:
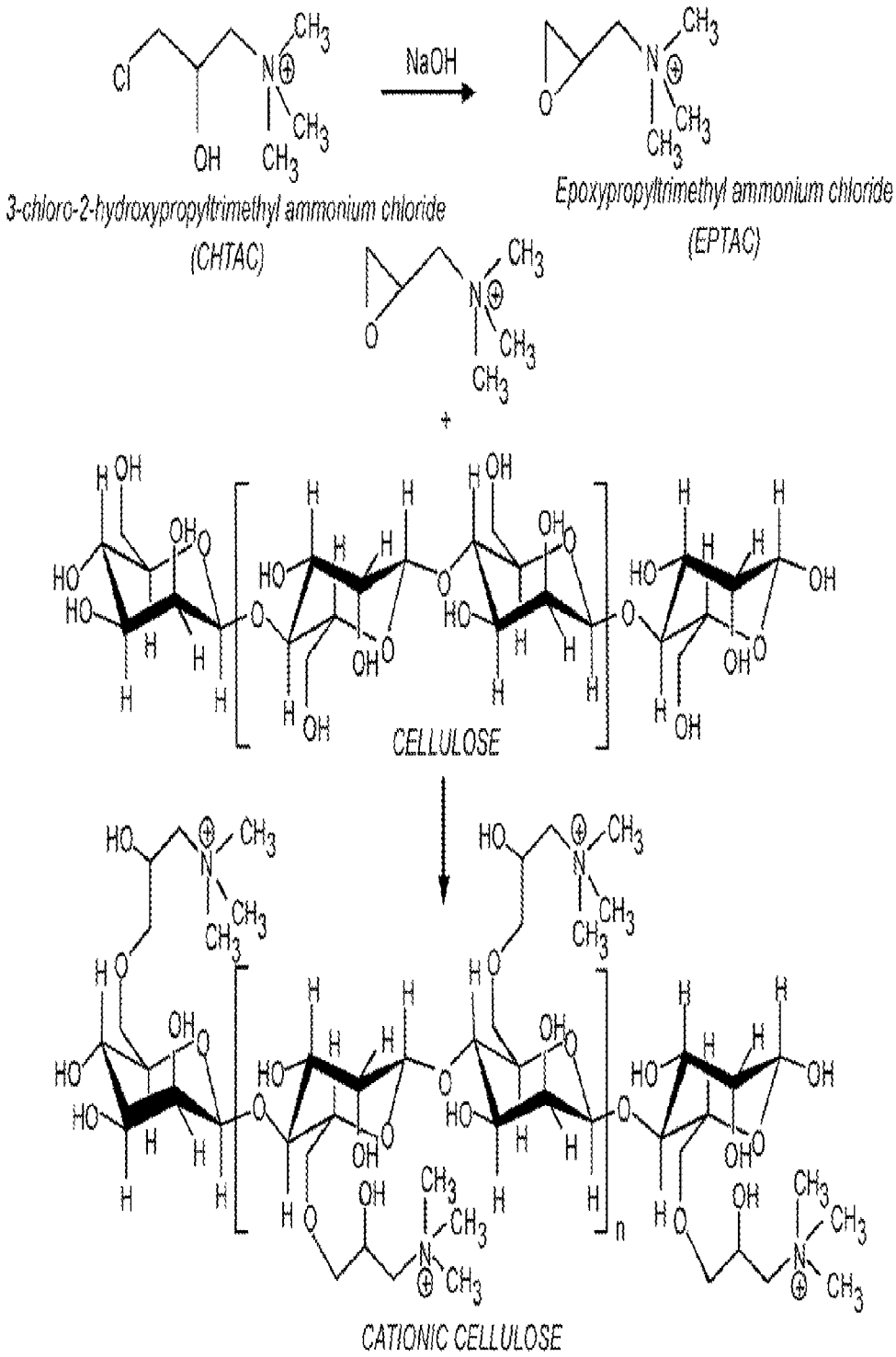

FIG. 8. Synthesis of cationic cellulose.

Figure 9:
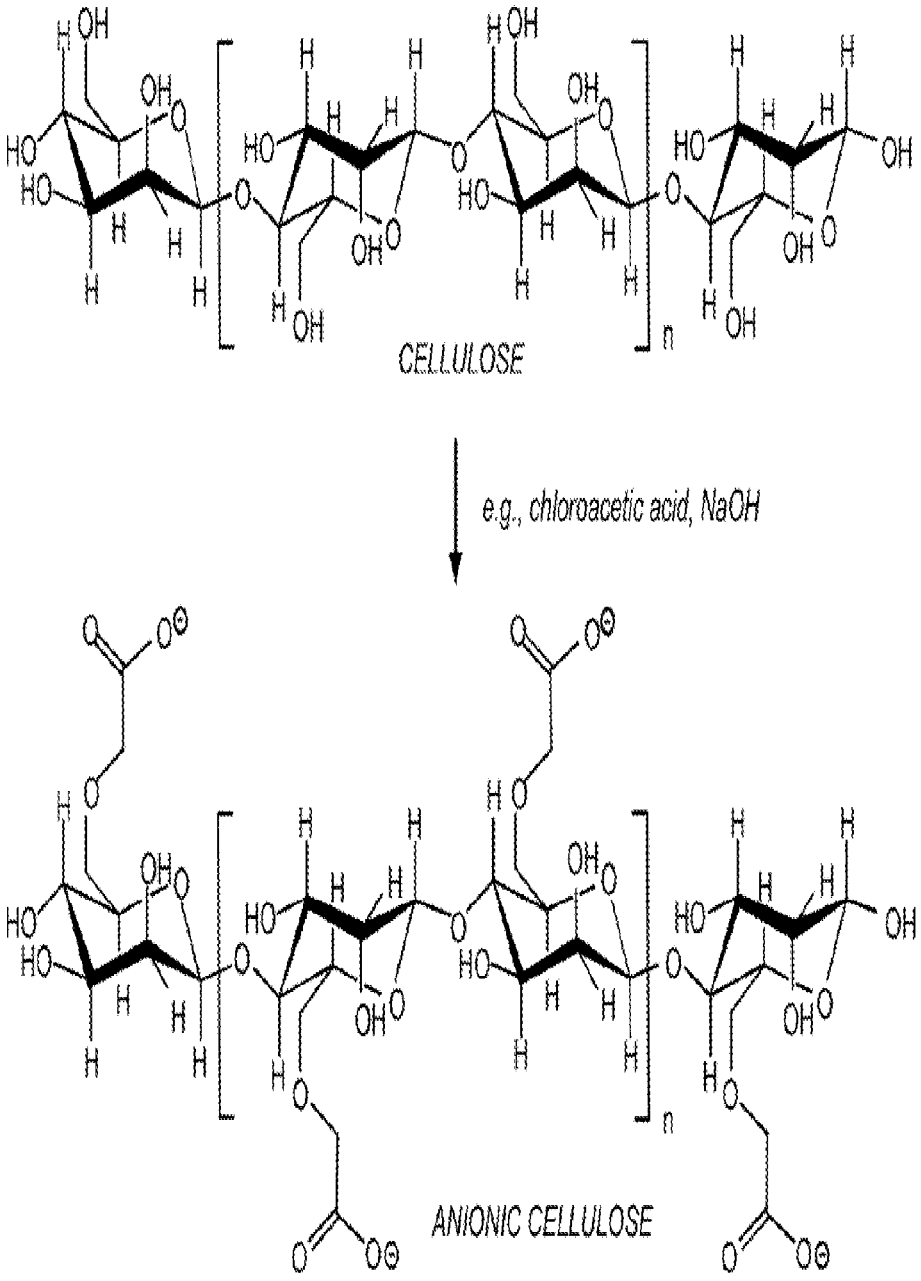
Figure 10A:
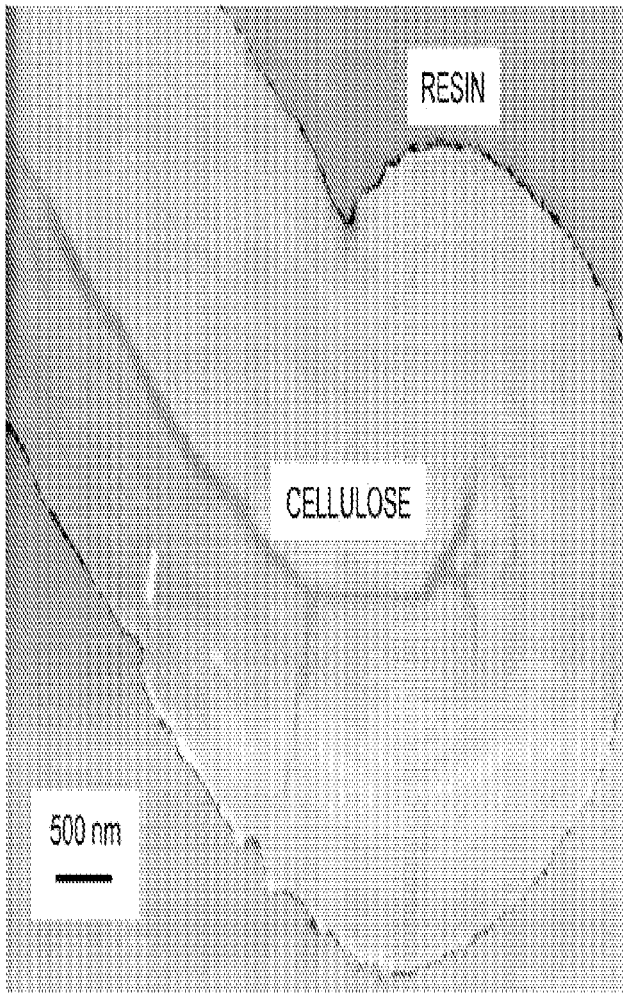
Figure 10B:
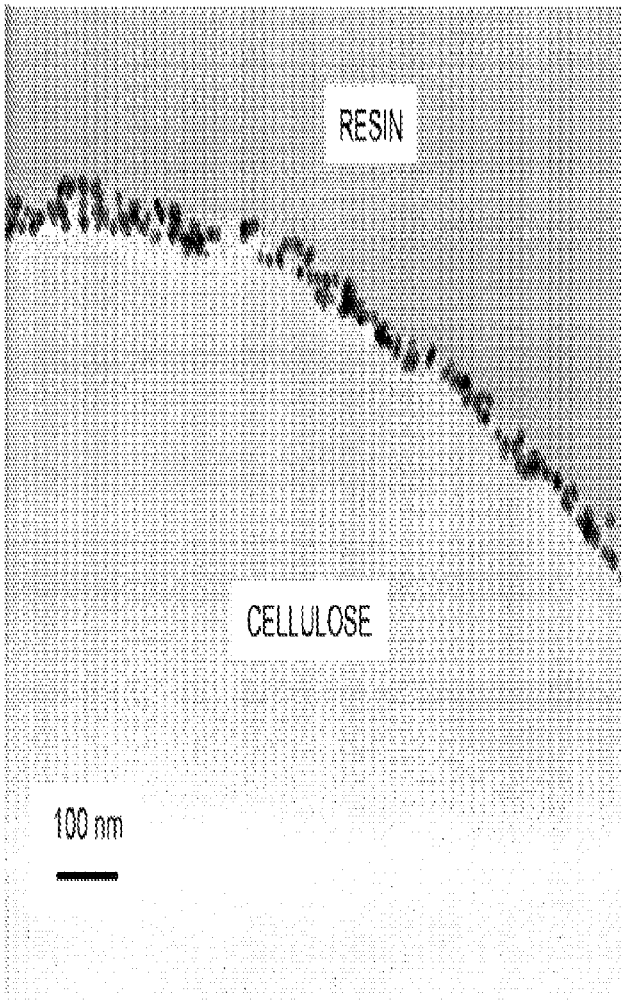
Figure 10C:
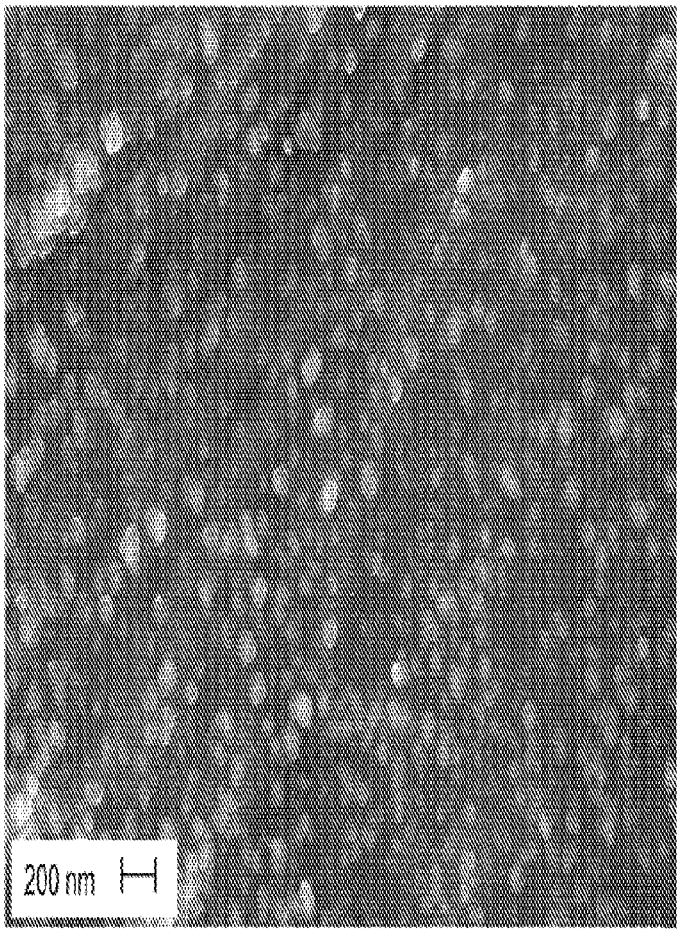
Figure 10D:
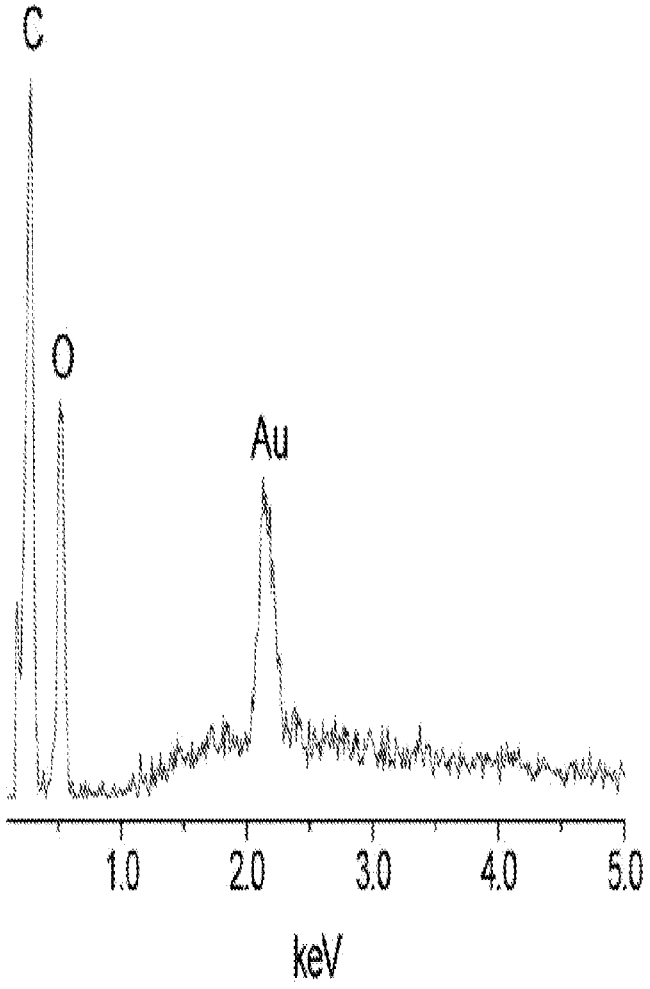
Figure 11A:
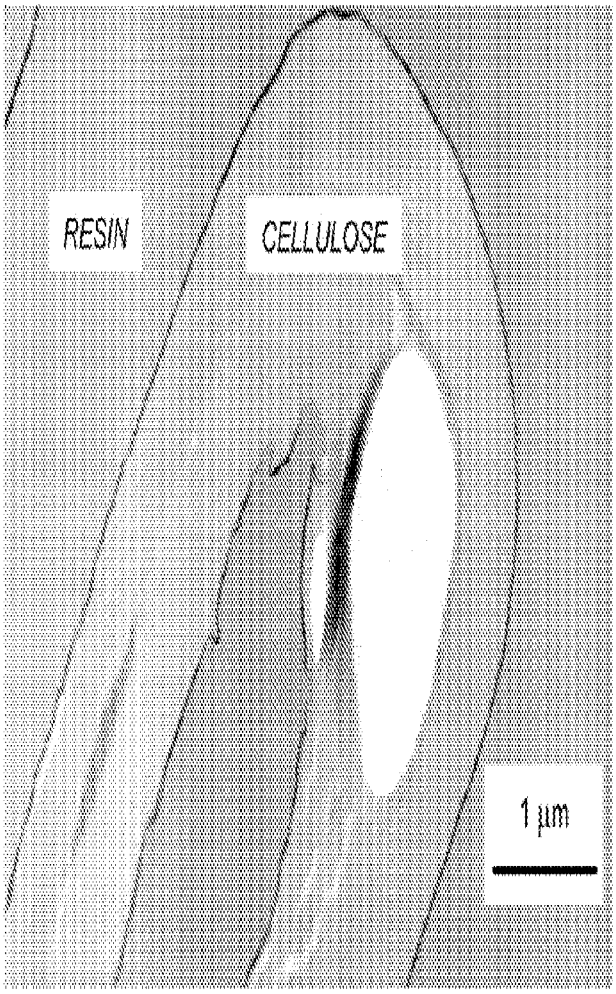
Figure 11B:
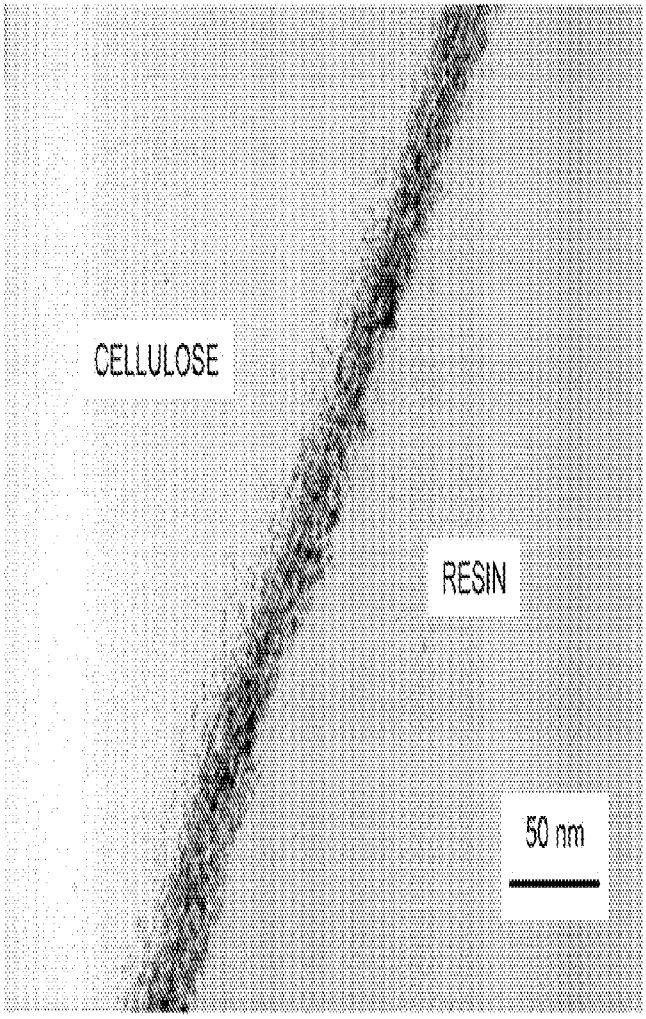
Figure 11C:
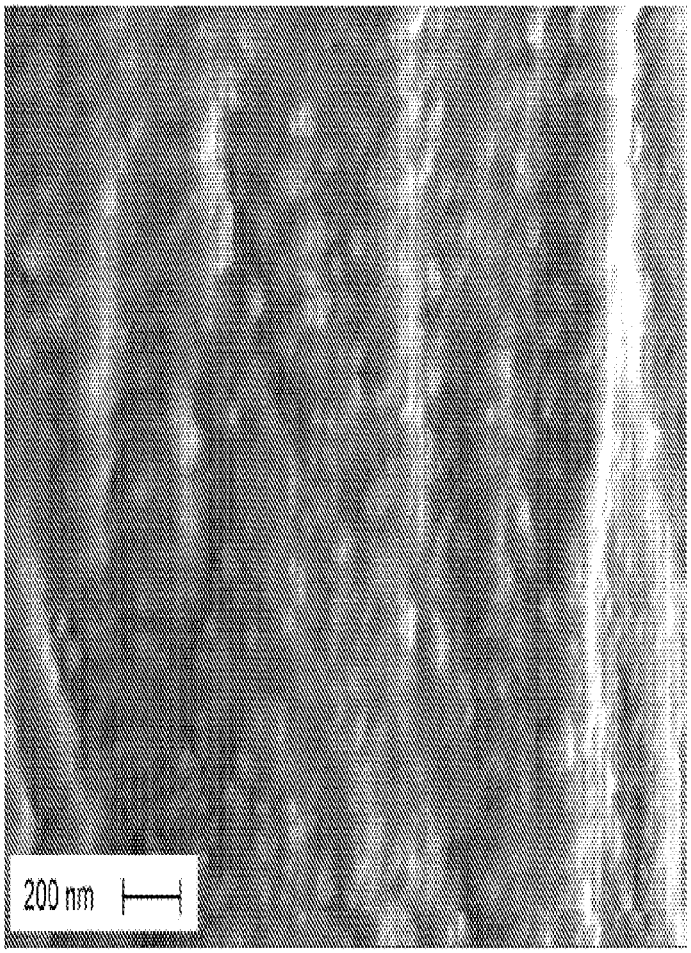
Figure 11D:
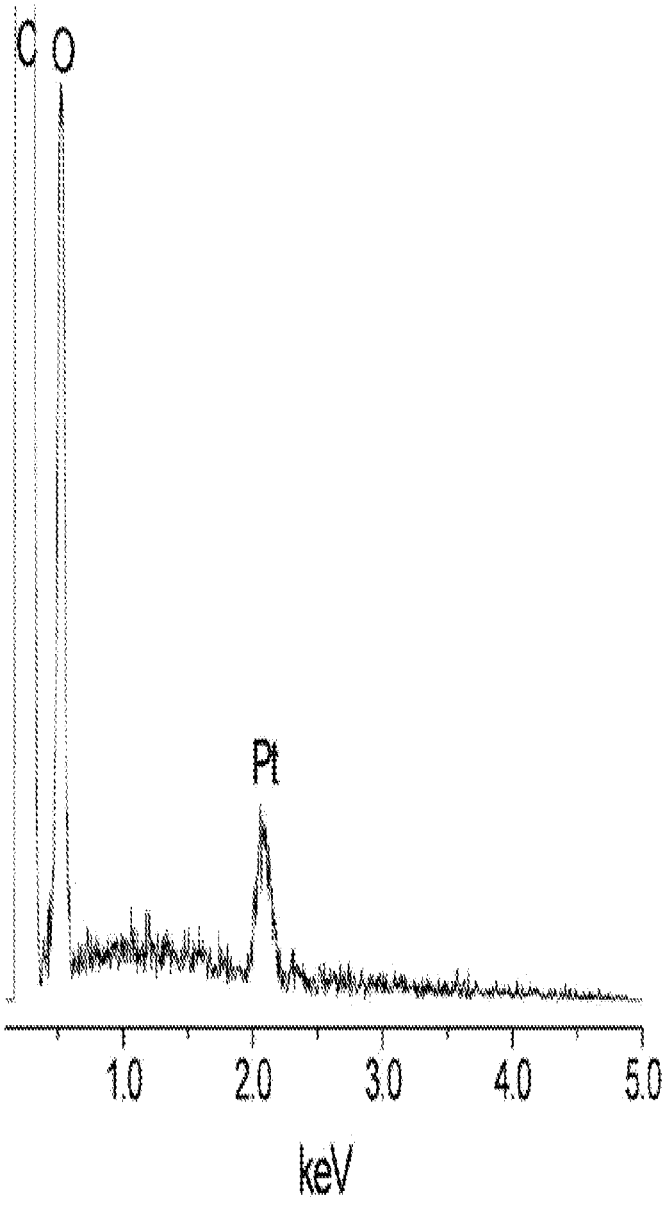

FIG. 9. Synthesis of anionic cellulose.

FIGS. 10A-D. Direct assembly of Au NPs on cotton synthesized using 1% citrate. (A-B) TEM images of the cross sections of cotton fibers coated with Au NPs, (C) FESEM image of the surface of a cotton fiber coated with Au NPs, (D) Energy Dispersive X-ray Analysis (EDX) of a cotton fiber coated with Au NPs.

FIGS. 11A-D. Direct assembly of Pt NPs on cotton. (A-B) TEM images of the cross sections of cotton fibers coated with Pt NPs, (C) FESEM image of the surface of a cotton fiber coated with Pt NPs, (D) EDX spectra of a cotton fiber coated with Pt NPs.

Figure 12A:
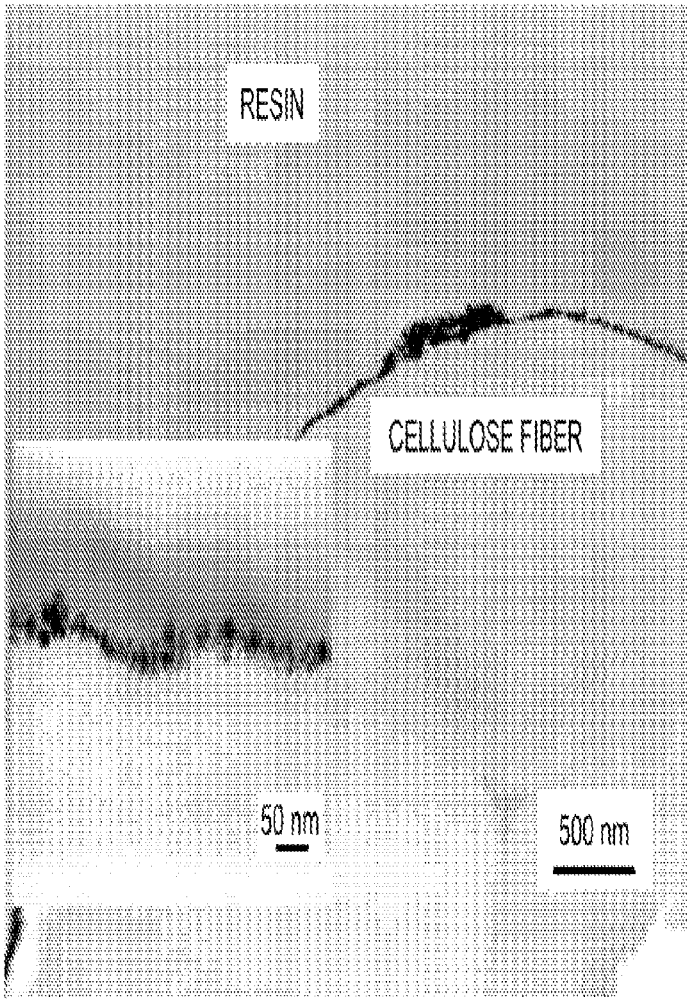
Figure 12B:
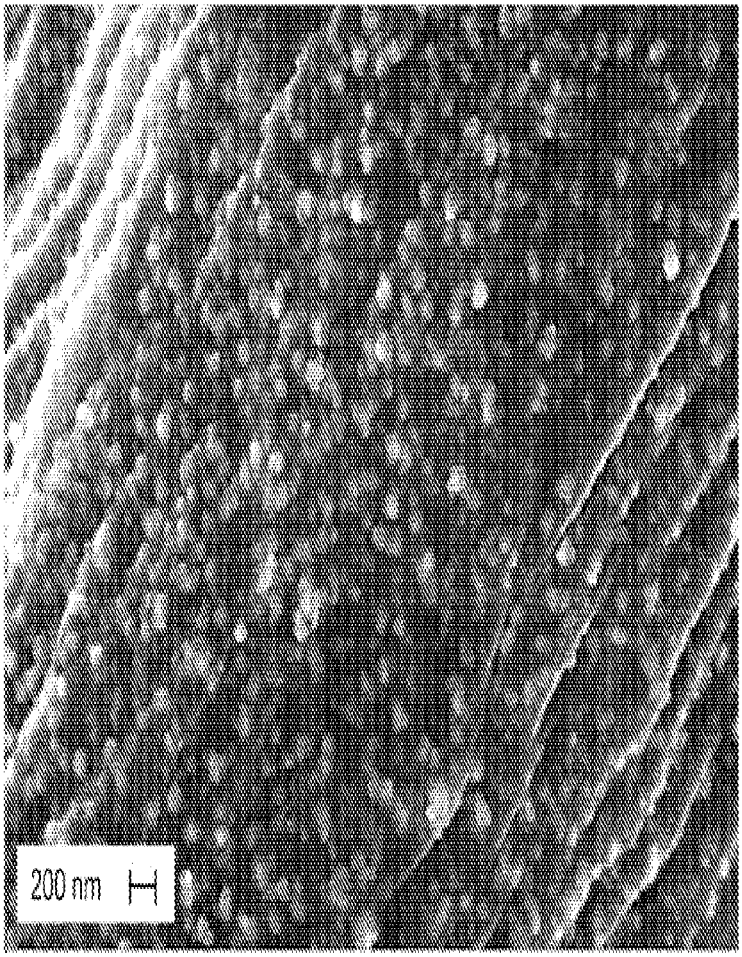
Figure 12C:
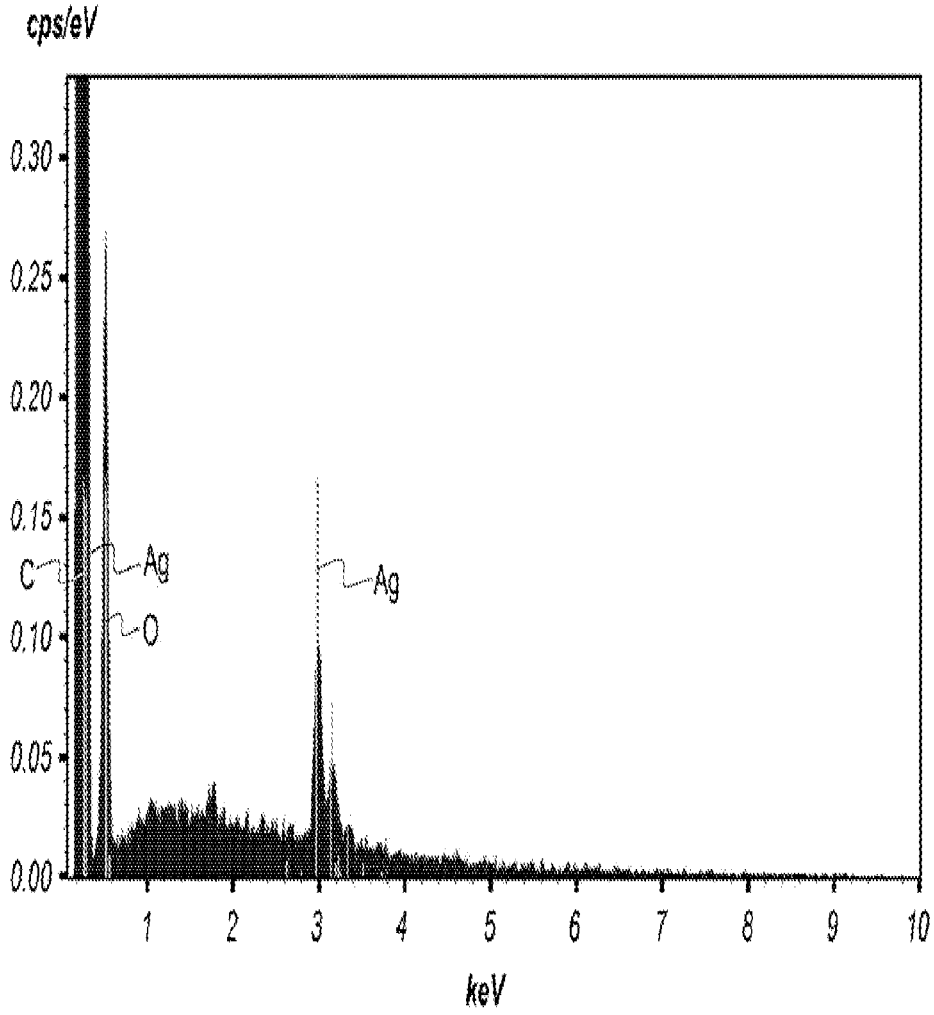
Figure 13A:
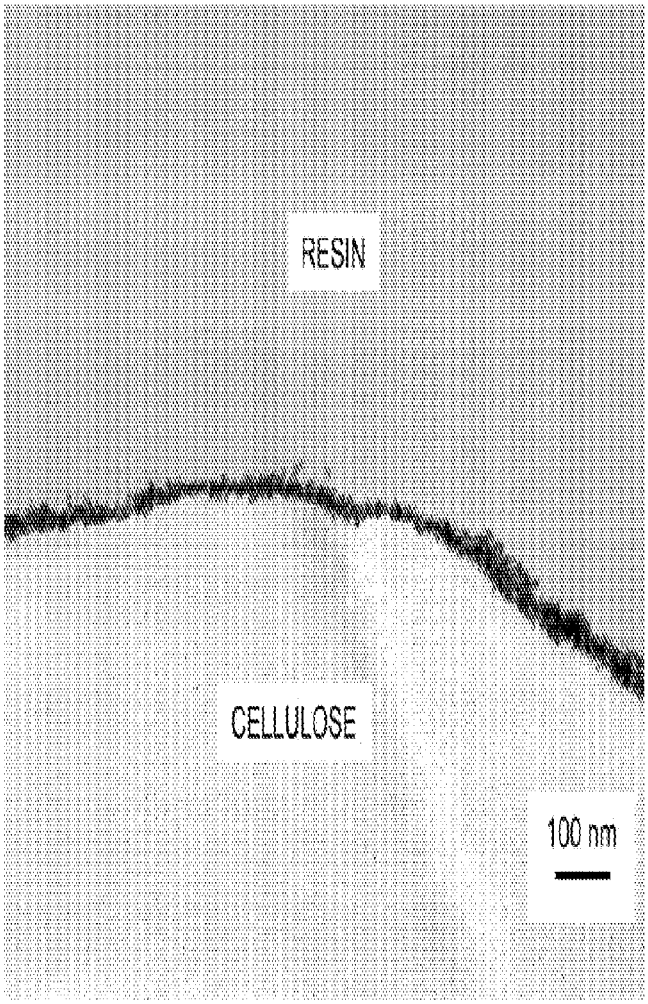
Figure 13B:
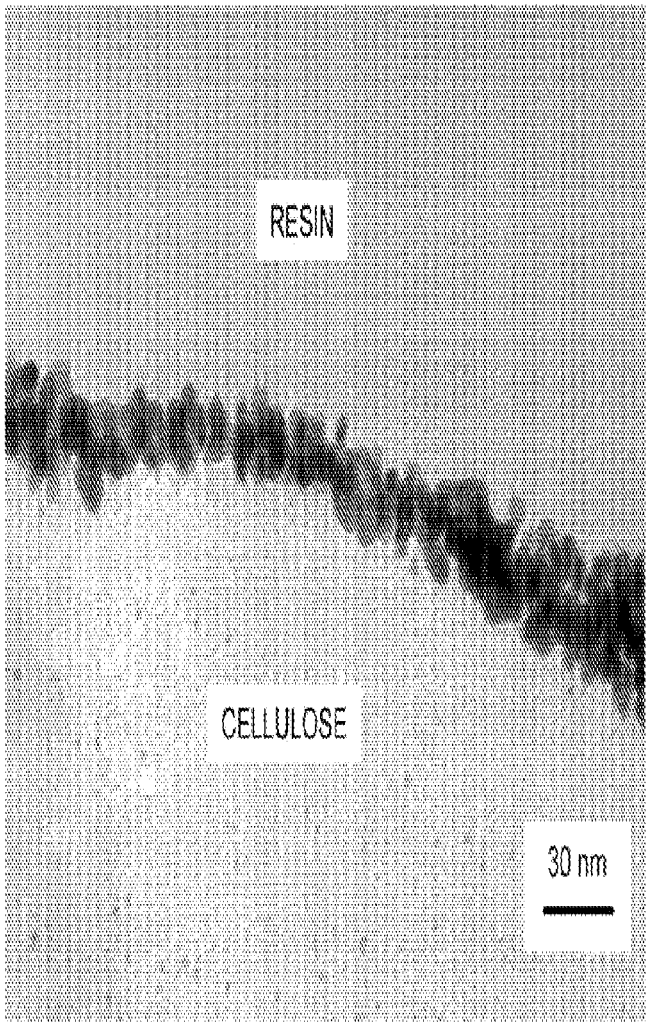
Figure 13C:
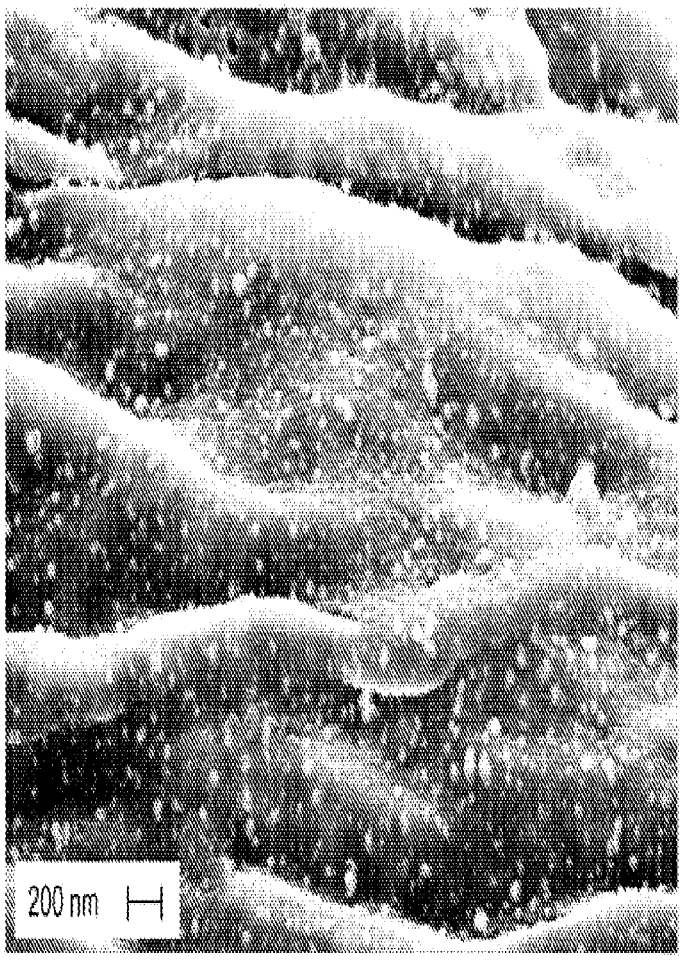
Figure 13D:
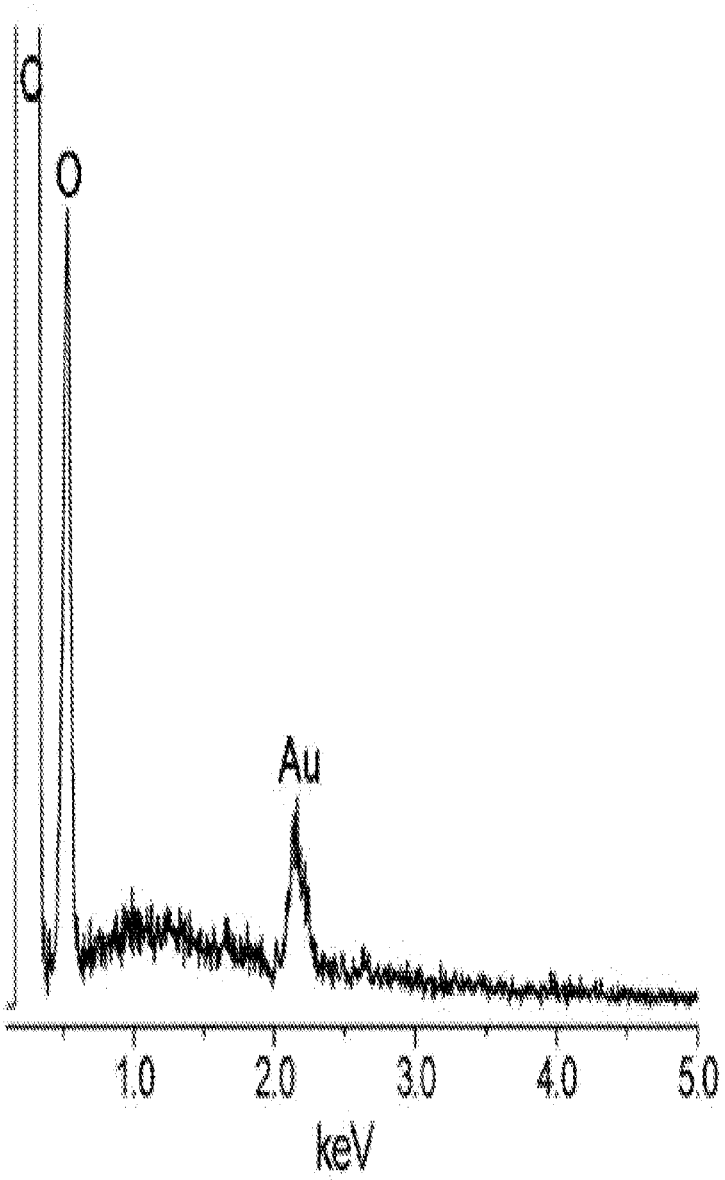
Figure 14A:
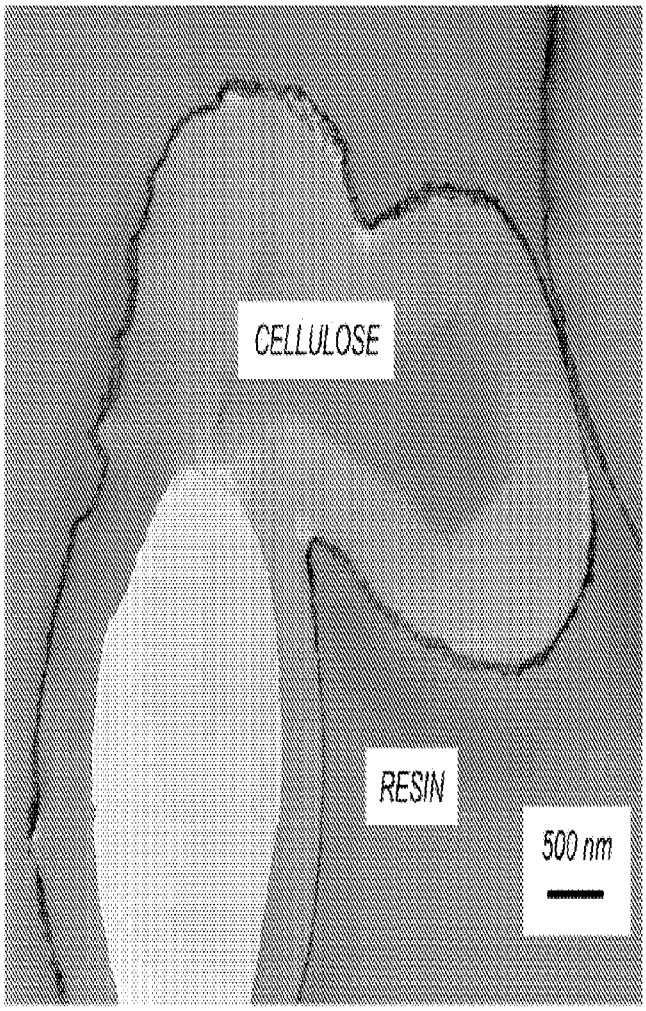
Figure 14B:
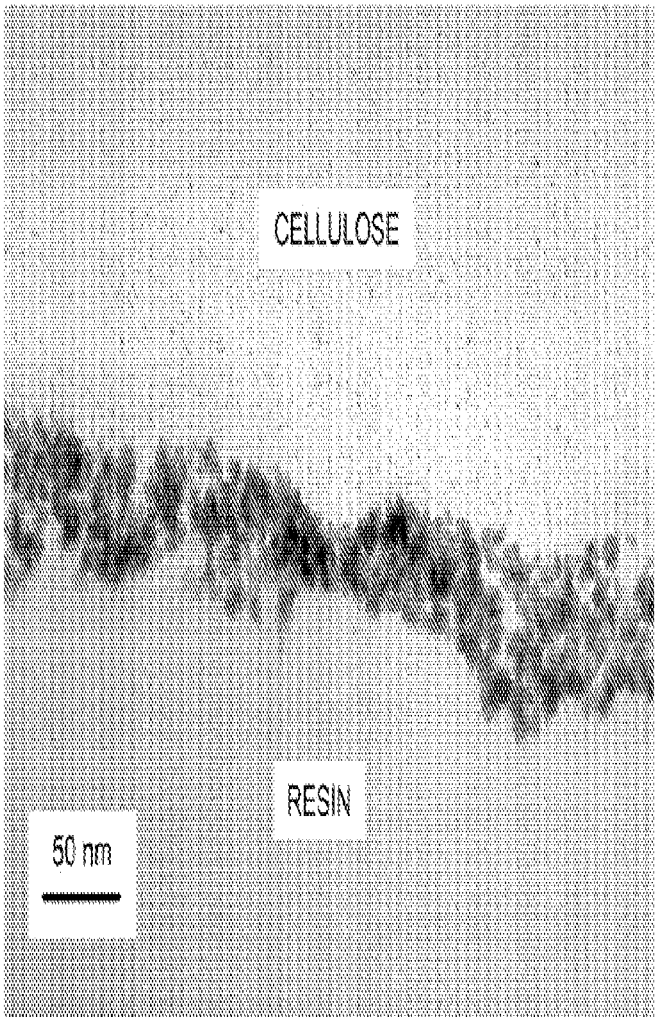
Figure 14C:
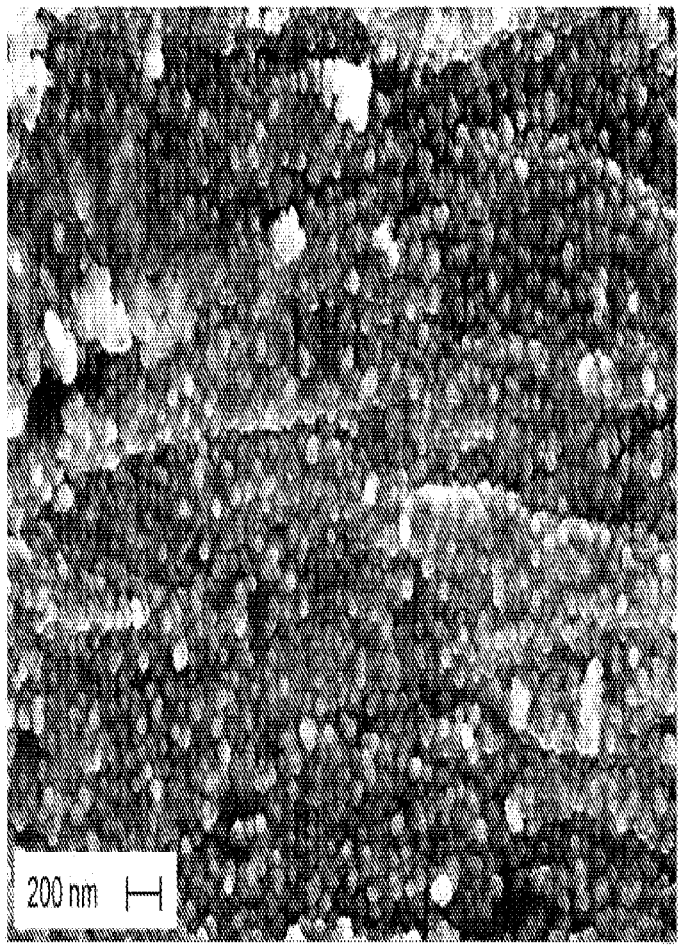
Figure 14D:
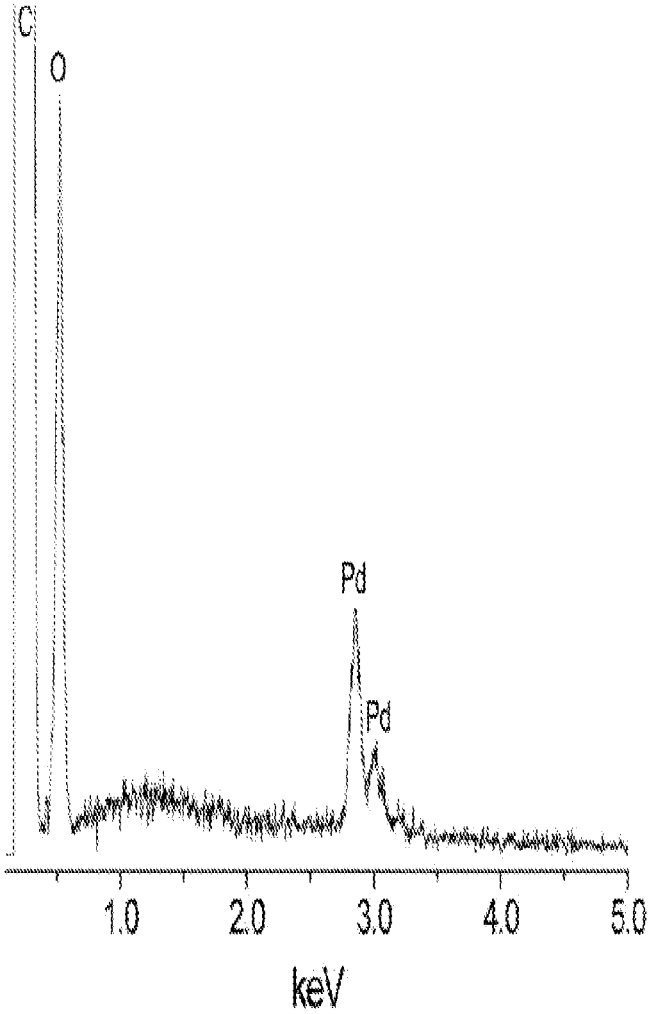

FIGS. 12A-C. In-situ formation of Ag NPs on cotton, synthesized from 5 mM $AgNO_3$ metallic precursor solution. (A) TEM images of the cross sections of cotton fibers coated with Ag NPs, (B) FESEM image of the surface of a cotton fiber coated with Ag NPs, (C) Energy Dispersive Spectroscopy (EDS) analysis of a cotton fiber coated with Ag NPs.

FIGS. 13A-D. In-situ formation of Au NPs on cotton, synthesized from 5 mM $NaAuCl_4$ metallic precursor solution. (A-B) TEM images of the cross sections of cotton fibers coated with Au NPs, (C) FESEM image of the surface of a cotton fiber coated with Au NPs, (D) EDX spectra of a cotton fiber coated with Au NPs.

FIGS. 14A-D. In-situ formation of Pd NPs on cotton, synthesized from 5 mM $Na_2PdCl_4$ metallic precursor solution. (A-B) TEM images of the cross sections of cotton fibers coated with Pd NPs, (C) FESEM image of the surface of a cotton fiber coated with Pd NPs, (D) EDX spectra of a cotton fiber coated with Pd NPs.

Figure 15A:
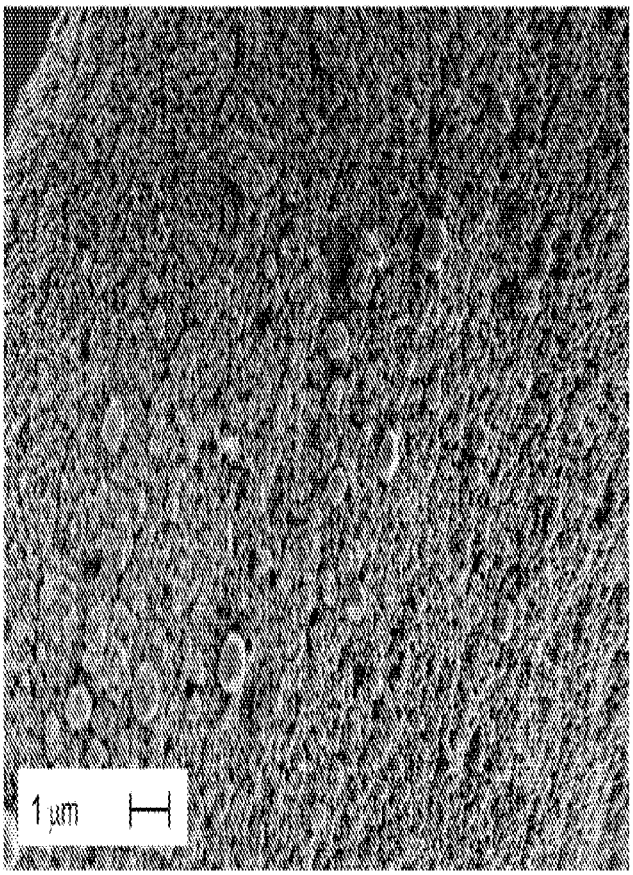
Figure 15B:
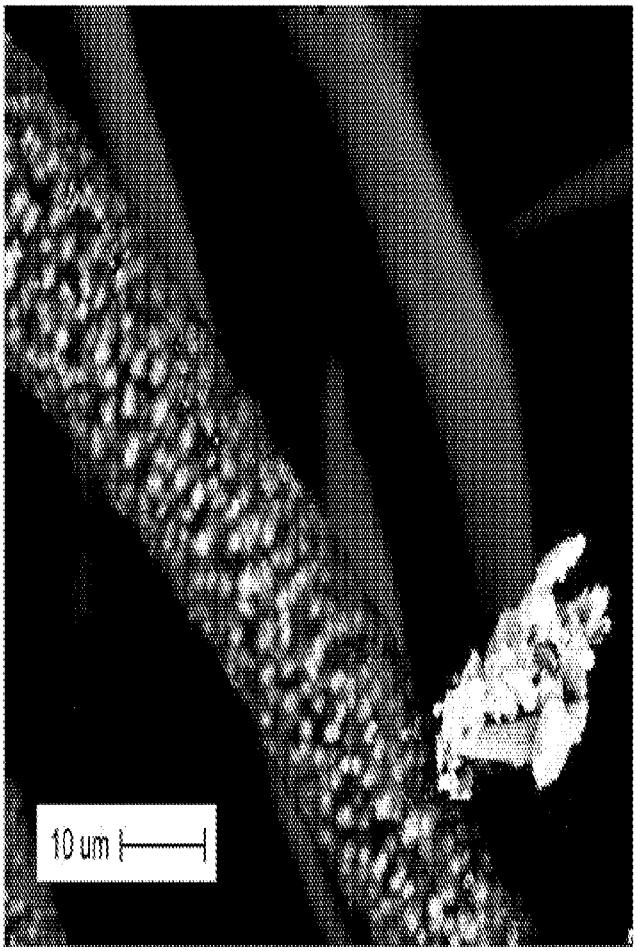
Figure 15C:
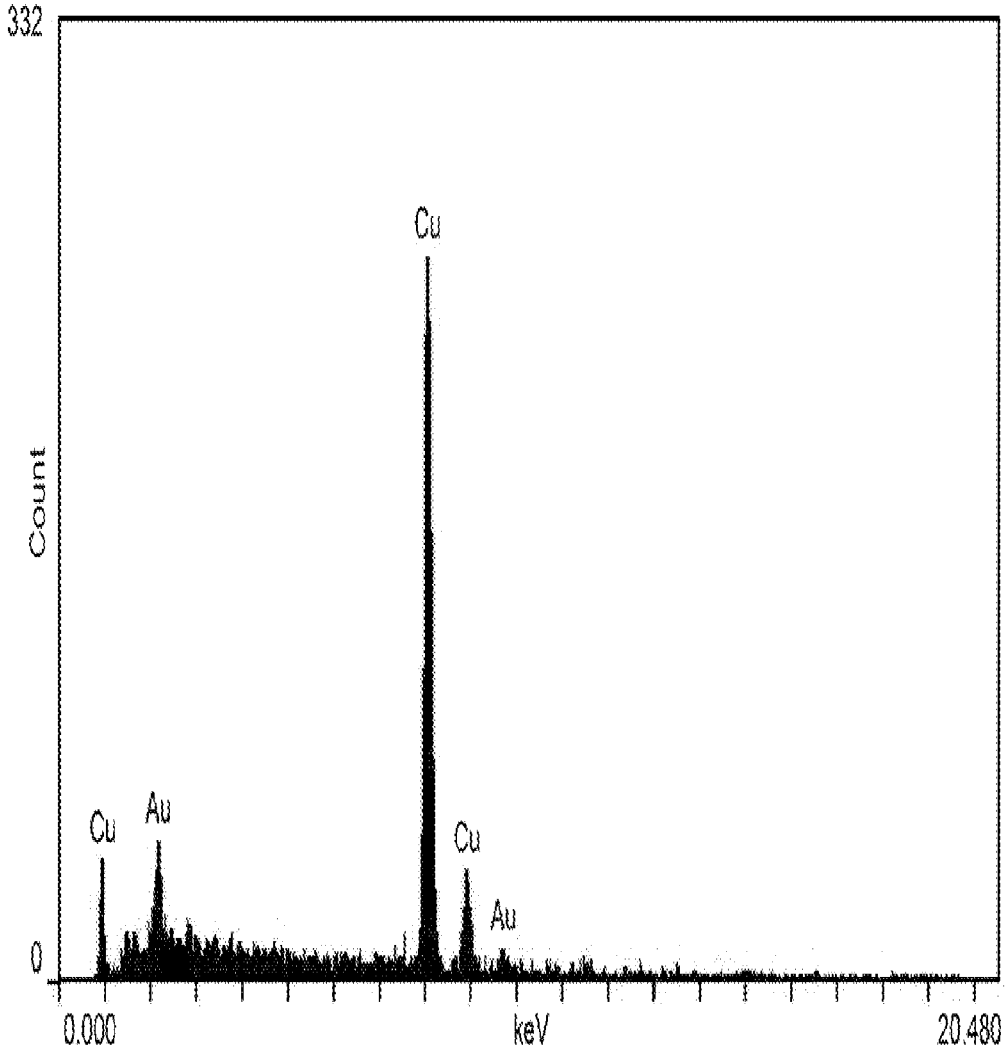

FIGS. 15A-C. In-situ formation of Cu NPs on cotton first coated with Pd NPs, synthesized from $CuSO_4$ metallic precursor solution. (A) FESEM image of the surface of a cotton fiber coated with Cu NPs, (B) SEM image of the surface of a cotton fiber coated with Cu NPs, (C) EDS analysis of a cotton fiber coated with Cu NPs.

Figure 16A:
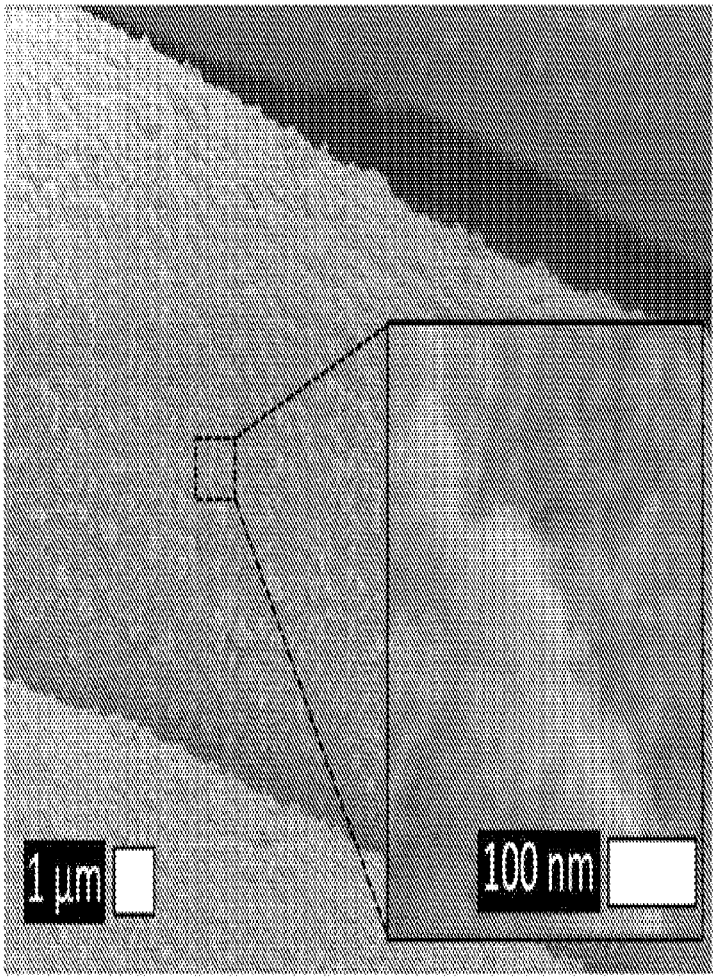
Figure 16B:
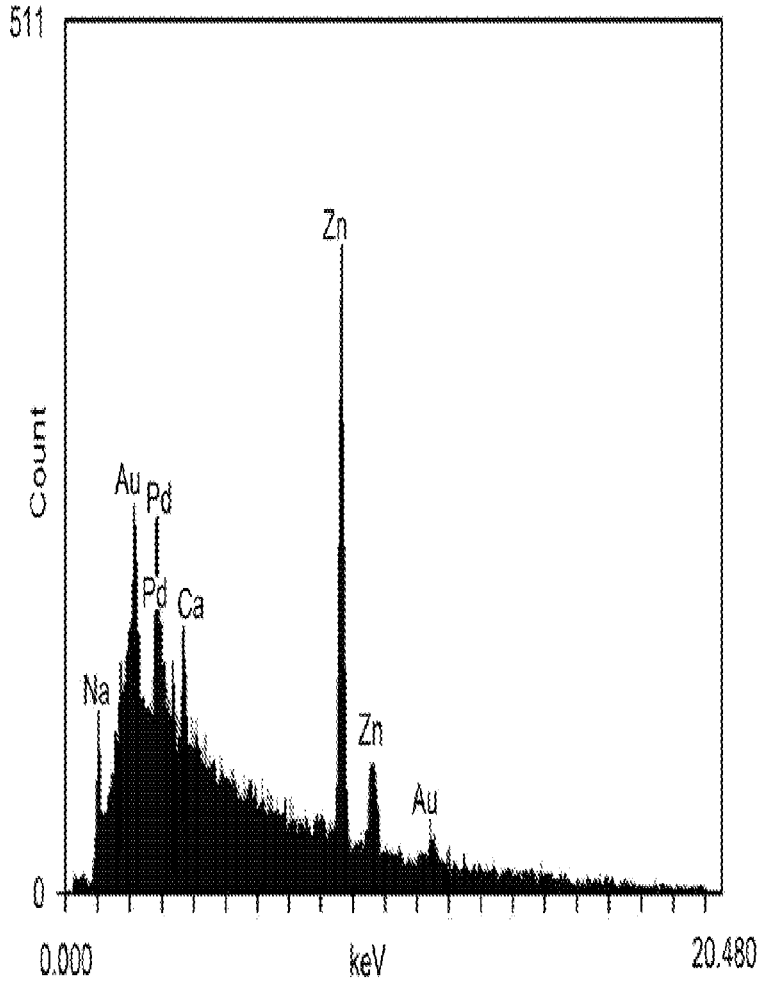

FIGS. 16A-B. In-situ formation of ZnO NPs on cotton, synthesized from 10 mM $Zn(OAc)_2$ metallic precursor solution. (A) SEM image of the surface of a cotton fiber coated with Zn NPs, (B) EDS analysis of a cotton fiber coated with ZnO NPs.

Figure 17A:
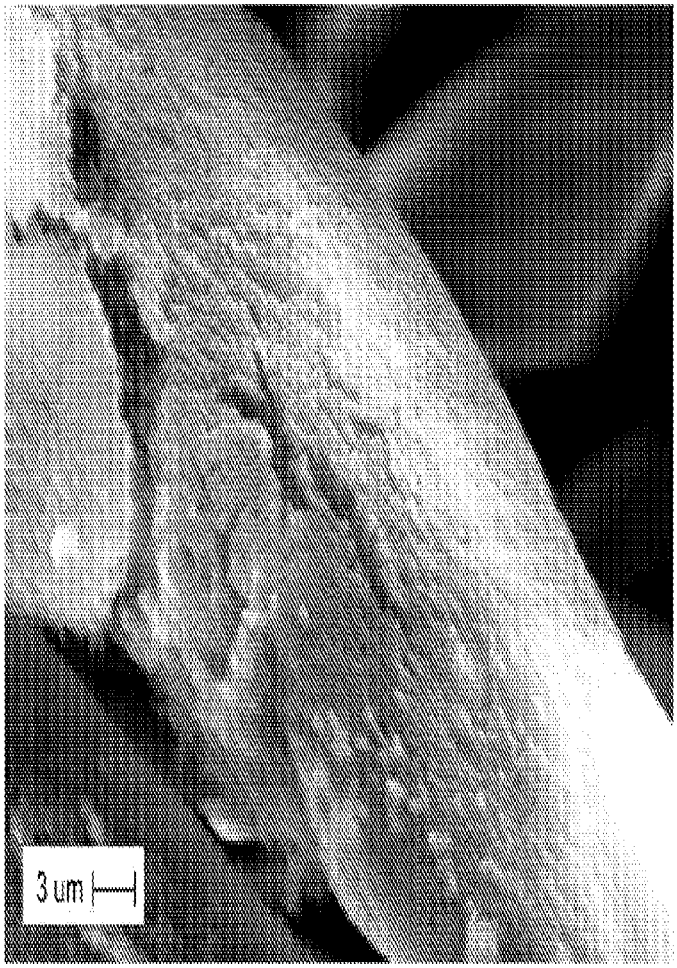
Figure 17B:
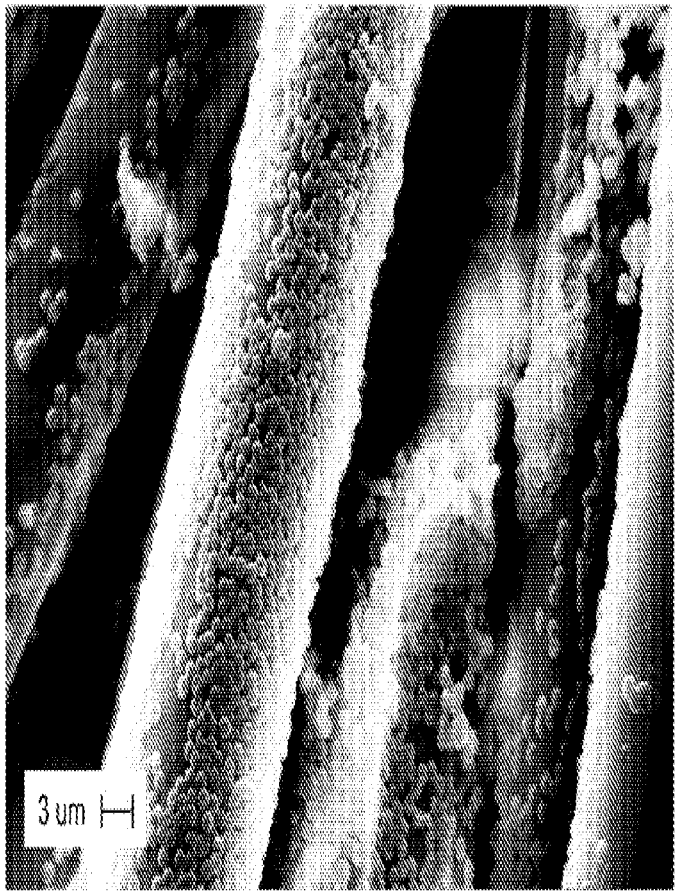

FIGS. 17A-B. SEM images of the surface of a cationic cotton fiber coated with (A) polystyrene sulfonate spheres size 1 micron in diameter, (B) polystyrene sulfonate mushroom cap particles size 1.2 microns in diameter.

Figure 18A:
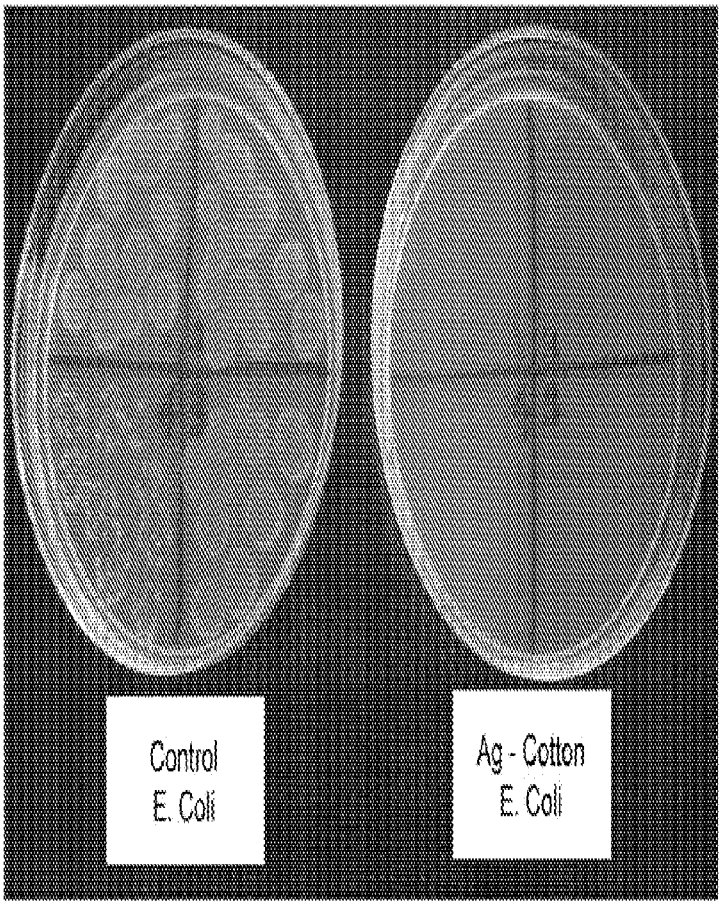

FIG. 18A. Antibacterial results of cotton swatches without (left) and with (right) Ag NPs on *E. coli* after incubation for 24 h contact time. The extraction of bacterial solution after the contact time was diluted to $10^1$, $10^2$, and $10^3$ times. Then the extraction and three diluents were incubated on four zones of a nutrient agar plate at 37 Celsius for 18 hours.

Figure 18B:
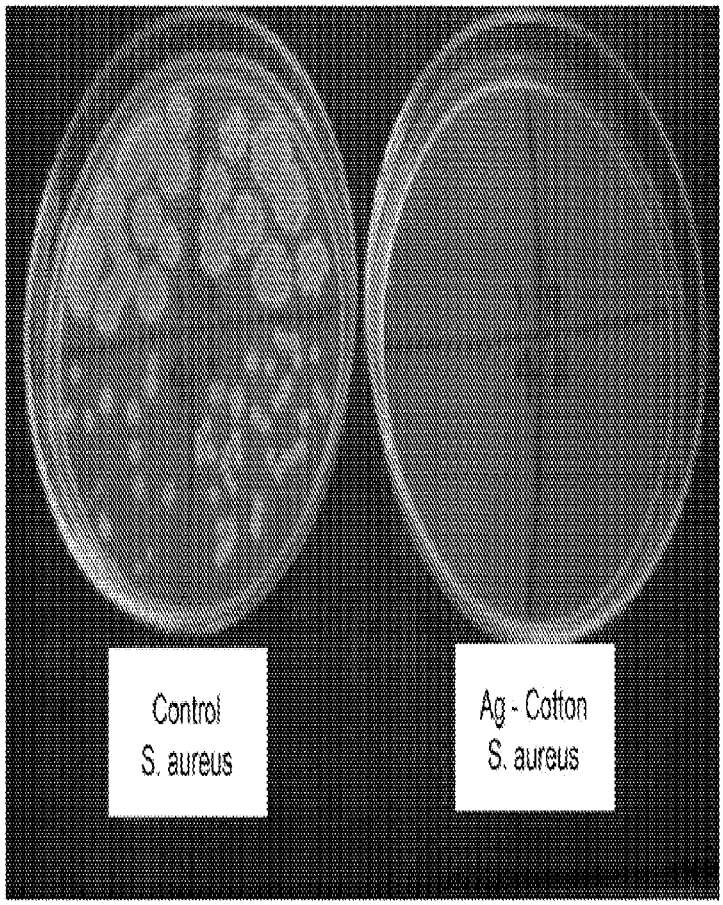

FIG. 18B. Antibacterial results of cotton swatches without (left) and with (right) Ag NPs on *S. aureus* after incubation for 24 h contact time. The extraction of bacterial solution after the contact time was diluted to $10^1$, $10^2$, and $10^3$ times. Then the extraction and three diluents were incubated on four zones of a nutrient agar plate at 37 Celsius for 18 hours.

Figure 19A:
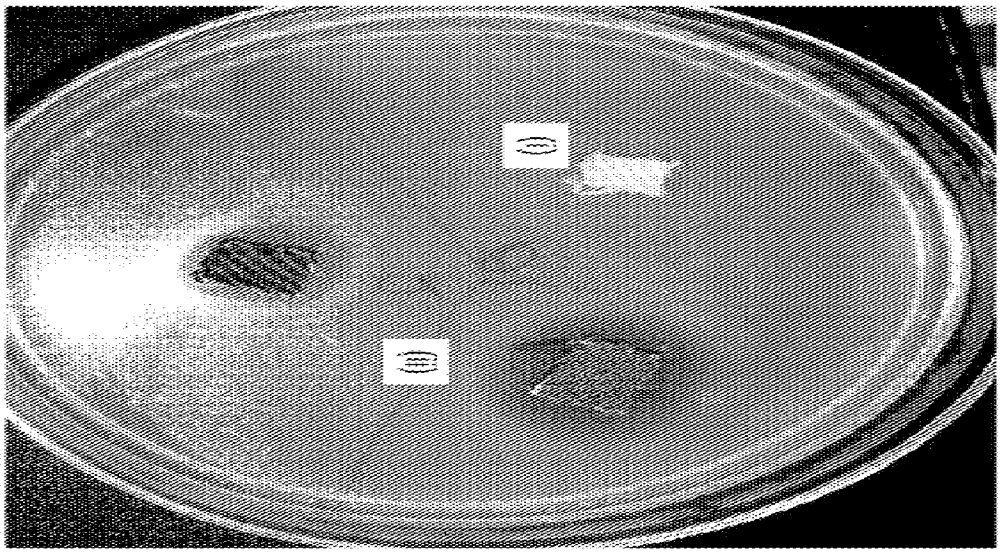

FIG. 19A. Antibacterial results of cotton swatches (i) without NP coating, (ii) coated with Cu NPs, on *S. aureus* after incubation for 18 hours.

Figure 19B:
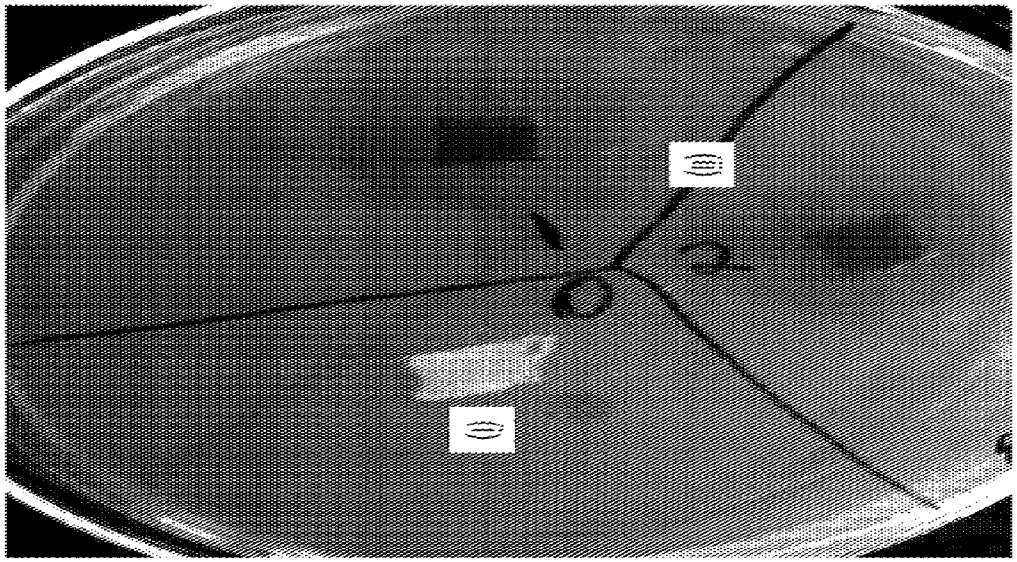

FIG. 19B. Antibacterial results of cotton swatches (i) without NP coating, (ii) coated with Cu NPs, on *E. coli* after incubation for 18 hours.

Figure 20:
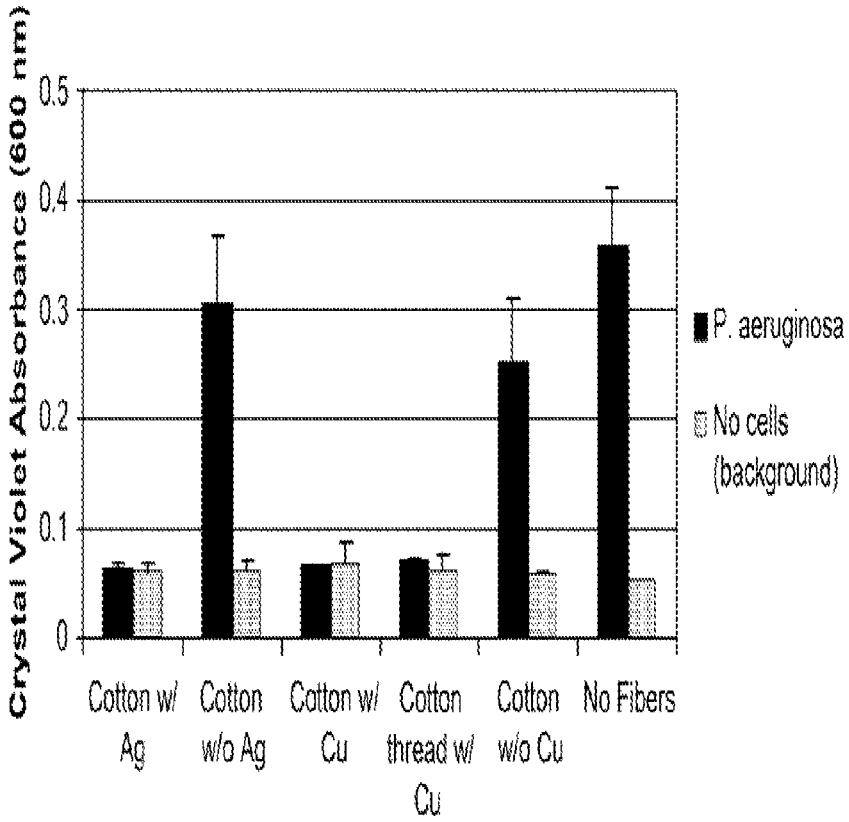

FIG. 20. Results from a biofilm inhibition assay. *P. aeruginosa* cells were grown in the presence of Au-cotton and Cu-cotton composite fibers and assayed for biofilm formation by staining with crystal violet.

Figure 21:
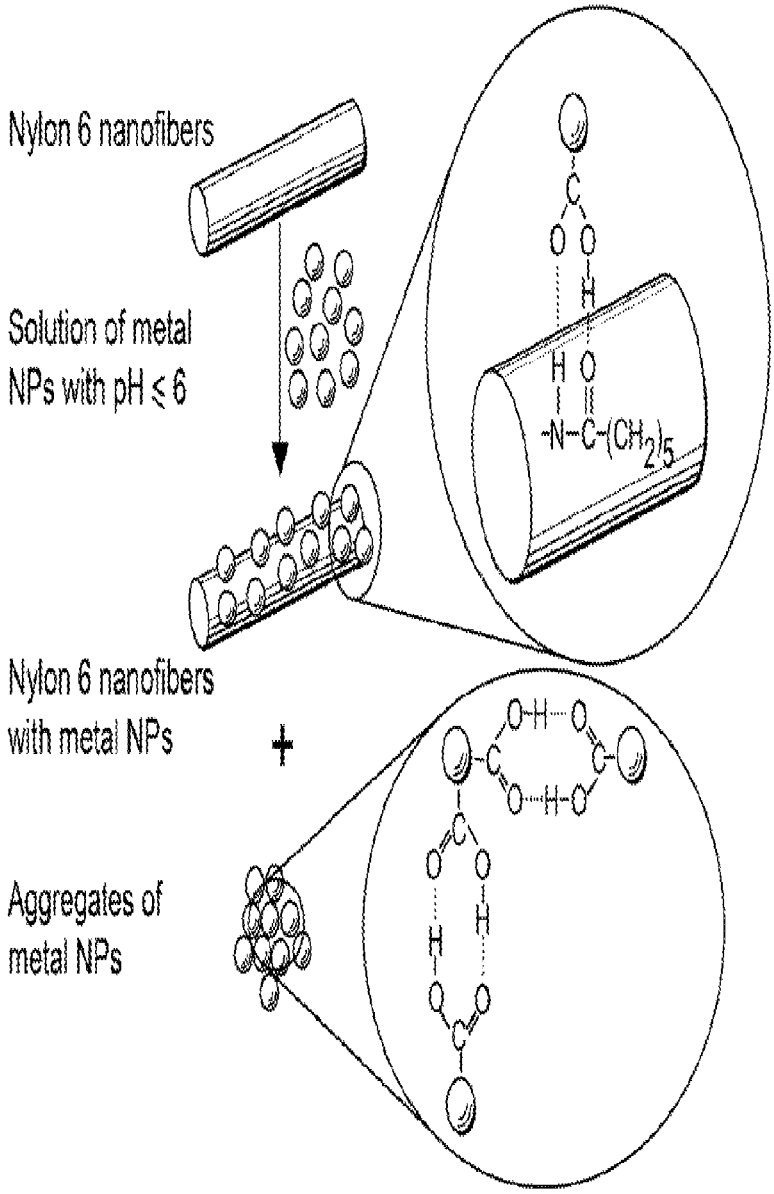

FIG. 21. Synthesis of particle coatings on fibers via self-assembly by pH-induced hydrogen bonding using metal nanoparticles (NPs) and nylon 6 nanofibers as an example.

5. DETAILED DESCRIPTION OF THE INVENTION

For clarity of disclosure, and not by way of limitation, the detailed description of the invention is divided into the subsections set forth below.

5.1 Conformal Coatings, Conformally Coated Non-Planar Surfaces and Methods for Producing them

5.1.1 Chemical Modification of the Non-Planar Surface to Impart a Surface Charge A conformal coating is provided for deposition on a non-planar surface of a substrate comprising a plurality of chemically functional particles, wherein:

the particles have a cross-sectional diameter of 2-2000 nm, the average distance between adjacent particles across the entire non-planar surface is no greater than 10 times the largest cross-sectional dimension of any particle in the plurality, and the attachment of the particles to the surface is through electrostatic self-assembly or covalent bonding.

The invention also provides a method for producing conformally coated non-planar surfaces. The method can comprise the steps of providing a substrate comprising a non-planar surface and chemically modifying the non-planar surface to impart a surface charge. The method can further comprise depositing complementary charged metal ions, complementary charged metal complexes or complementary charged particles on the non-planar surface.

The invention also provides a method for producing a surface-bonded particle comprising:

(a) providing a substrate comprising a non-planar surface;

(b) chemically modifying the non-planar surface to impart a surface charge; and (c) reacting a complementary charged metal ion, complementary charged metal complex or complementary charged particle with the chemically modified non-planar surface, producing the surface-bonded metallic particle, wherein the bond between the particle and the non-planar surface is a covalent or electrostatic bond.

In a specific embodiment, the invention provides a method for surface-bonding particles to a non-planar surface of a substrate to produce a conformal coating comprising the steps of:

(a) providing a substrate comprising a non-planar surface;

(b) chemically modifying the non-planar surface to impart a surface charge; and (c) depositing complementary charged particles on the non-planar surface, producing the conformal coating of surface-bonded particles, wherein:

the surface-bonded particles have cross-sectional diameters of 2.2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic self-assembly or covalent bonding.

In one embodiment, the non-planar surface is a carbohydrate-based polymer or a protein based polymer with a positive surface charge and the particle surface is negatively charged.

In another embodiment, the positive charge is imparted using an alkyl ammonium salt of the formula ($R_1$, $R_2$, $R_3$, $R_4$)—$N^+$, wherein $R_1$-$R_4$ groups are defined as follows: $R_1$ contains a reactive group suitable for functionalizing the primary alcohol of the carbohydrate backbone or the primary amines of the protein backbone including, epoxides, alkyl iodides/bromide/chlorides, sulfonic acid esters, and activated carboxylic acids such as N-hydroxy succinimidyl esters for amine attachment; and $R_2$-$R_4$ are H, $CH_3$, $CH_2CH_3$ or similar aliphatic carbon chains, and groups comprising a 5- or 6-membered cyclic ammonium salt.

In another embodiment, the positive charge is imparted using cationic N-alkylated aromatic heterocycles including, but not limited to, pyridinium and imidazolium derivatives having the following general structures;

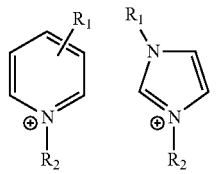

wherein $R_1$ and $R_9$ groups are defined as follows: $R_1$ contains a reactive group suitable for functionalizing the primary alcohol of the carbohydrate backbone or the primary amines of the protein backbone including, epoxides, alkyl iodides/bromide/chlorides, sulfonic acid esters, and activated carboxylic acids such as N-hydroxy succinimidyl esters for amine attachment; and $R_2$ is H, $CH_3$, $CH_2CH_3$ or similar aliphatic carbon chains.

In another embodiment, $R_1$ is H, and $R_2$ contains a reactive group suitable for functionalizing the primary alcohol of the carbohydrate backbone or the primary amines of the protein backbone including, epoxides, alkyl iodides/bromide/chlorides, sulfonic acid esters, and activated carboxylic acids such as N-hydroxy succinimidyl esters for amine attachment.

In another embodiment, the positive charge is imparted using a sulfonium salt of the formula $(R_1,R_2R_3)$—$S^+$, wherein $R_1$-$R_3$ groups are defined as follows: $R_1$ contains a reactive group suitable for functionalizing the primary alcohol of the carbohydrate backbone or the primary amines of the protein backbone including, epoxides, alkyl iodides/bromide/chlorides, sulfonic acid esters, and activated carboxylic acids such as N-hydroxy succinimidyl esters for amine attachment; and $R_2$ and $R_3$ are H, $CH_3$, $CH_2CH_3$ or similar aliphatic carbon chains.

In another embodiment, the non-planar surface is a carbohydrate-based polymer with a negative surface charge and the particle is positively charged.

In another embodiment, the particle is a metal or metal oxide and is functionalized with a chemical reagent having at least one group capable of binding to the metal or metal oxide and at least one group that is charged.

In another embodiment, the particle is an organic polymeric particle having a positively charged surface including, but not limited to, polyalkylammonium salts and cyclic polydiallylammonium salts.

In another embodiment, the particle is an organic polymeric particle having a negatively charged surface including, but not limited to, polystyrene sulfonate, polyacrylic acid, and polyglutamic acid.

In another embodiment, the negative charge is imparted using carboxylates of the formula R—$CH_2$—COO—, wherein R contains a reactive group for functionalizing the primary alcohol of the carbohydrate backbone including, but not limited to, epoxides, alkyl iodides/bromides/chlorides, and sulfonic acid esters.

In another embodiment, the negative charge is imparted using phosphonates of the formula $R_1$—$CH_2$—$PO_3R_2$—, wherein $R_1$ and $R_2$ are defined as follows: $R_1$ contains a reactive group suitable for functionalizing the primary alcohol of the carbohydrate backbone including, but not limited to epoxides, alkyl iodides/bromides/chlorides, and sulfonic acid esters; and $R_2$ is H, $CH_3$, $CH_2CH_3$ or similar aliphatic carbon chains.

In another embodiment, the negative charge is imparted by phosphorylating the primary alcohol of the carbohydrate backbone using a suitable phosphorylating agent including, but not limited to, enzymatic phosphorylating agents such as Baker's yeast hexokinase, phosphorus oxychloride, and 5- or 6-membered ring phosphate esters.

In another embodiment, the negative charge is imparted using sulfonates of the formula R—$CH_2$—$SO_3$—, wherein R contains a reactive group suitable for functionalizing the primary alcohol of the carbohydrate backbone including, but not limited to epoxides, alkyl iodides/bromides/chlorides, and sulfonic acid esters.

In another embodiment, the negative charge is imparted by alkylation of the primary alcohol of the carbohydrate backbone using 1,3-propane sultone or 1,4-butane sultone.

In another embodiment, the negative charge is imparted using sulfonates of the formula R—$CH_2$—$OSO_3$—, wherein R contains a reactive group suitable for functionalizing the primary alcohol of the carbohydrate backbone including, but not limited to epoxides, alkyl iodides/bromides/chlorides, and sulfonic acid esters.

In another embodiment, the negative charge is imparted by alkylation of the primary alcohol of the carbohydrate backbone using 5- or 6-membered ring sulfate esters.

In another embodiment, the particles are deposited as aqueous suspensions.

In another embodiment, the particle deposition is conducted at a temperature above of 273° K (Kelvin).

In another embodiment, the particle deposition is conducted at a pH above 1.

5.1.2 Depositing Complementary Charged Metal Ions or Complementary Charged Metal Complexes on Substrates Bearing a Surface Charge In another embodiment, the method can comprise depositing complementary charged metal ions or complementary charged metal complexes on substrates hearing a surface charge. The surfaces can then be treated with reducing agents, base, and/or heating to create metal or metal oxide particles.

Chemically treating the surface can comprise using a charged organic molecule, an organic molecule that becomes charged after reacting with the non-planar surface, or an ionizing chemical reagent.

The non-planar surface can be a carbohydrate-based polymer or a protein based polymer with a positive surface charge and the metal complex is negatively charged.

In another embodiment, a method is provided for producing a surface-bonded metallic particle comprising:

(a) providing a substrate comprising a non-planar surface;

(b) depositing a complementary charged metal ion or complementary charged metal complex on the non-planar surface; and (c) treating the complementary charged metal ion or complementary charged metal complex deposited on the non-planar surface with a treatment selected from the group consisting of treating with a reducing agent, treating with a base or heating to create metal or metal oxide particles, producing the surface-bonded metallic particle.

In a specific embodiment, the invention provides a method for surface-bonding metallic particles to a non-planar surface of a substrate to produce a conformal coating comprising the steps of:

(a) providing a substrate comprising a non-planar surface;

(b) depositing complementary charged metal ions or complementary charged metal complexes on the non-planar surface; and (c) treating the complementary charged metal ions or complementary charged metal complexes deposited on the non-planar surface with a treatment selected from the group consisting of treating with a reducing agent, treating with a base or heating, producing the conformal coating of surface-bonded metallic particles, wherein: the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic self-assembly.

In a specific embodiment, the positive surface charge can be imparted using an alkyl ammonium salt of the formula ($R_1$, $R_2$, $R_3$, $R_4$)—$N^+$, wherein $R_1$-$R_4$ groups are defined as follows: $R_1$ contains a reactive group suitable for functionalizing, the primary alcohol of the carbohydrate backbone or the primary amines of the protein backbone including, epoxides, alkyl iodides/bromide/chlorides, sulfonic acid esters, and activated carboxylic acids such as N-hydroxy succinimidyl esters for amine attachment; and $R_2$-$R_4$ are H, $CH_3$, $CH_2CH_3$ or similar aliphatic carbon chains, and groups comprising a 5- or 6-membered cyclic ammonium salt.

In another specific embodiment, the positive charge is imparted using cationic N-alkylated aromatic heterocycles including, but not limited to, pyridinium and imidazolium derivatives having the following general structures;

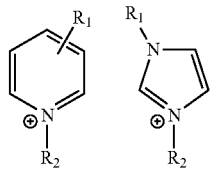

wherein $R_1$ and $R_2$ groups are defined as follows: $R_1$ contains a reactive group suitable for functionalizing the primary alcohol of the carbohydrate backbone or the primary amines of the protein backbone including, epoxides, alkyl iodides/bromide/chlorides, sulfonic acid esters, and activated carboxylic acids such as N-hydroxy succinimidyl esters for amine attachment; and $R_2$ is H, $CH_3$, $CH_2CH_3$ or similar aliphatic carbon chains.

In another embodiment, $R_1$ is H, and $R_2$ contains a reactive group suitable for functionalizing the primary alcohol of the carbohydrate backbone or the primary amines of the protein backbone including, epoxides, alkyl iodides/bromide/chlorides, sulfonic acid esters, and activated carboxylic acids such as N-hydroxy succinimidyl esters for amine attachment.

In another embodiment the positive charge can be imparted by using a sulfonium salt of the formula ($R_1$,$R_2R_3$)—$S^+$, wherein $R_1$-$R_3$ groups are defined as follows: $R_1$ contains a reactive group suitable for functionalizing the primary alcohol of the carbohydrate backbone or the primary amines of the protein backbone including, epoxides, alkyl iodides/bromide/chlorides, sulfonic acid esters, and activated carboxylic acids such as N-hydroxy succinimidyl esters for amine attachment; and $R_2$ and $R_3$ are H, $CH_3$, $CH_2CH_3$ or similar aliphatic carbon chains.

In one embodiment, the negative charge can be imparted using phosphonates of the formula $R_1$—$CH_2$—$PO_3R_2$—, wherein $R_1$ and $R_2$ groups are defined as follows: $R_1$ contains a reactive group suitable for functionalizing the primary alcohol of the carbohydrate backbone including, but not limited to epoxides, alkyl iodides/bromides/chlorides, and sulfonic acid esters; and $R_2$ is H, $CH_3$, $CH_2CH_3$ and similar aliphatic carbon chains.

In another embodiment, the negative charge can be imparted by phosphorylating the primary alcohol of the carbohydrate backbone using a suitable phosphorylating agent including, but not limited to, enzymatic phosphorylating agents such as Baker's yeast hexokinase, phosphorus oxychloride, and 5- or 6-membered ring phosphate esters.

In another embodiment, the negative charge can be imparted using sulfonates of the formula R—$CH_2$—$SO_3$—, wherein R contains a reactive group suitable for functionalizing the primary alcohol of the carbohydrate backbone including, but not limited to epoxides, alkyl iodides/bromides/chlorides, and sulfonic acid esters.

In another embodiment, the negative charge can be imparted by alkylation of the primary alcohol of the carbohydrate backbone using 1,3-propane sultone or 1,4-butane sultone.

In another embodiment, the negative charge can be imparted using sulfonates of the formula R—$CH_2$—$OSO_3$—, wherein R contains a reactive group suitable for functionalizing the primary alcohol of the carbohydrate backbone including, but not limited to epoxides, alkyl iodides/bromides/chlorides, and sulfonic acid esters.

In another embodiment, the negative charge can be imparted by alkylation of the primary alcohol of the carbohydrate backbone using 5- or 6-membered ring sulfate esters.

In another embodiment, the method can comprise covalently attaching chemically modified particles to a chemically modified non-planar surface. The non-planar surface can be chemically modified with an organic molecule that has a functional group that will react at the repeating functional groups of the non-planar surface and has another functional group that allows covalent attachment of chemically modified particles.

According to this embodiment, the charged metal ion or charged metal complex can be deposited onto the non-planar surface in aqueous solutions. The in situ particle formation can be conducted in aqueous or organic solutions. Heating can be at a temperature range above 273° K. The pH of the solution can be above 1.

In another embodiment, the in situ particle formation is done by reducing positive metal ions or negative metal ion complexes deposited onto the non-planar surface using reducing agents that include, but are not limited to, $NaBH_4$, $NaBH_3CN$, hydrazine, sodium citrate, and sodium ascorbate.

In another embodiment, the in situ particle formation is done by conversion of positive metal ions deposited onto the non-planar surface into metal oxide particles.

5.1.3 Covalently Attaching Chemically Modified Particles that Contain Surface Groups In another embodiment, the method can comprise attaching chemically modified particles that contain surface groups that allows covalent attachment to the chemically modified non-planar surfaces.

In another embodiment, the chemically modified particles can be functionalized metal particles (e.g., Au, Ag, Cu, Pt, Pd), functionalized metal oxide particles (e.g. ZnO, Ti $O_2$, SnO), functionalized non-metal oxide particles (e.g. $SiO_2$), or functionalized organic polymeric particles (e.g., polyacrylic acid).

In a specific embodiment, a method is provided for surface-bonding particles to a chemically modified non-planar surface of a substrate to produce a conformal coating comprising the step of:

(a) providing a substrate comprising a chemically modified non-planar surface; and (b) covalently attaching chemically functional particles to the chemically modified non-planar surface, producing the conformal coating of surface-bonded particles, wherein the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through covalent bonding.

Also provided is a method for producing a surface-bonded particle comprising: (a) providing a substrate comprising a chemically modified non-planar surface; and (b) covalently attaching a chemically functional particle to the chemically modified non-planar surface, producing the surface-bonded particle.

5.1.4 Hydrogen Bonding Between Hydrogen Bond Donors/Acceptors on Non-Planar Surface and Complementary Hydrogen Bond Donors/Acceptors on Particles In another embodiment, the method can comprise employing hydrogen bonding between hydrogen bond donors/acceptors on the non-planar surface and complementary hydrogen bond donors/acceptors on the particles.

The particles can have surface groups that are capable of hydrogen bonding, or the particles can be functionalized to give surface groups capable of hydrogen bonding with the non-planar surface.

In one embodiment, metal or metal oxide particles are functionalized using a chemical reagent that has at least one reactive group that is capable of binding the metal or metal oxide particles and at least one group that is a hydrogen bond donor and/or acceptor.

The hydrogen bond donors/acceptors can include, but are not limited to, the following classes of compounds: carboxylic acids, amides, imides, amines, alcohols, and nucleobases (e.g., adenine and thymine).

In a specific embodiment, a method is provided for surface-bonding particles to a non-planar surface of a substrate to produce a conformal coating comprising the step of:

(a) providing a substrate comprising a non-planar surface wherein the non-planar surface comprises hydrogen bond donors/acceptors;

(b) depositing chemically functional particles on the non-planar surface, the conformal coating of surface-bonded particles, wherein:

the chemically functional particles comprise hydrogen bond donors/acceptors, hydrogen bonding occurs between the hydrogen bond donors/acceptors on the particles and complementary hydrogen bond donors/acceptors on the non-planar surface, the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic self-assembly mediated through hydrogen bonding.

A method is also provided for producing a surface-bonded particle comprising:

(a) providing a substrate comprising a non-planar surface wherein the non-planar surface comprises hydrogen bond donors/acceptors;

(b) reacting a chemically functional particle with the non-planar surface, wherein:

the chemically functional particle comprises a hydrogen bond donor/acceptor, and hydrogen bonding occurs between the hydrogen bond donor/acceptor on the chemically functional particle and a complementary hydrogen bond donor/acceptor on the non-planar surface, producing the surface-bonded particle.

In another embodiment, the particles are organic polymeric particles bearing hydrogen bonding donors/acceptors including, but not limited to, polymers and copolymers comprised of polyamides, polycarboxylic acids (e.g., acrylic acid), polysaccharides (e.g., cellulose, cellulose acetate), polyalcohols (e.g., polyvinylalcohol), polyamines, polyaminoacids (e.g., polylysine), polyvinylpyrrolidone, polyethylene oxide, and specialized fibers of block copolymers having nucleobase functionality (e.g., adenine and thymine).

In another embodiment, the non-planar surface is comprised of fibers of nylons or combinations of nylons including, but not limited to, nylon-6, nylon-6,6, and nylon-12, and wherein the particles are metal particles with carboxylic acid surface groups.

In another embodiment, the particles are deposited as aqueous suspensions.

In another embodiment, the particle deposition is conducted at a temperature above 273° K.

In another embodiment, the particle deposition is conducted above a pH range of 1.

In another embodiment, the conformal coating of particles is controlled by pH in order to maximize the hydrogen bonding interactions between the non-planar surface and the particles.

5.1.5 Plasma Treating Non-Planar Surface

In another embodiment, the method can comprise the step of plasma treating the non-planar surface to impart a surface charge. The method can further comprise subsequently depositing complementary charged particles. In one embodiment, the non-planar surface can be a polymer with a negative surface charge and the particle can be positively charged.

In a specific embodiment, a method is provided for surface-bonding particles to a non-planar surface of a substrate to produce a conformal coating comprising the steps of:

(a) providing a substrate comprising a non-planar surface;

(b) plasma-treating the non-planar surface to impart a surface charge; and (c) depositing complementary charged particles on the non-planar surface, producing the conformal coating of surface-bonded particles, wherein the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic self-assembly.

A method is also provided for producing a surface-bonded particle comprising:

(a) providing a substrate comprising a non-planar surface;

(b) plasma treating the non-planar surface to impart a surface charge; and (c) depositing a complementary charged particle on the plasma-treated non-planar surface, producing the surface-bonded particle.

In another embodiment, the method can comprise the step of plasma treating the non-planar surface to impart a surface charge, followed by depositing complementary charged metal ions or complementary charged metal complexes.

The method can further comprise treating such surfaces with reducing agents, base, and/or heating to create metal or metal oxide particles.

In a specific embodiment, a method is provided for surface-bonding metallic particles to a non-planar surface of a substrate to produce a conformal coating comprising the steps of:

(a) providing a substrate comprising a non-planar surface;

(b) plasma treating the non-planar surface to impart a surface charge;

(c) depositing complementary charged metal ions or complementary charged metal complexes on the non-planar surface; and (d) treating the complementary charged metal ions or complementary charged metal complexes deposited on the non-planar surface with a treatment selected from the group consisting of treating with a reducing agent, treating with a base or heating, producing the conformal coating of surface-bonded metallic particles, wherein:

the surface-bonded particles have cross-sectional diameters of 2-2000 nm, the average distance between adjacent surface-bonded particles across the entire non-planar surface is no greater than 10 times the largest cross-sectional dimension of any of the surface-bonded particles, and the attachment of the surface-bonded particles to the surface is through electrostatic self-assembly.

A method is also provided for producing a surface-bonded metallic particle comprising:

(a) providing a substrate comprising a non-planar surface;

(b) plasma treating the non-planar surface to impart a surface charge;

(c) depositing a complementary charged metal ion or complementary charged metal complex with the plasma-treated non-planar surface; and (d) treating the complementary charged metal ion or complementary charged metal complex deposited on the non-planar surface with a treatment selected from the group consisting of treating with a reducing agent, treating with a base or heating, producing the surface-bonded metallic particle.

The charged metal ion or charged metal complex can be deposited onto the non-planar surface in aqueous solutions. The in situ particle formation can be conducted in aqueous or organic solutions. Heating can be at a temperature range above 273° K. The pH of the solution can be above 1.

In another embodiment, the in situ particle formation is done by reducing positive metal ions or negative metal ion complexes deposited onto the non-planar surface using reducing agents that include, but are not limited to, $NaBH_4$, $NaBH_3CN$; hydrazine, sodium citrate, and sodium ascorbate.

In another embodiment, the in situ particle formation is done by conversion of positive metal ions deposited onto the non-planar surface into metal oxide particles.

In another embodiment, the non-planar surface is treated with oxygen plasma to give a negative surface charge and the metal ion is positively charged.

In another embodiment, the non-planar surface is treated with ammonia/helium plasma to give a positive surface charge and the metal ion complex is negatively charged.

In another embodiment, the non-planar surface is a carbohydrate-based polymer with a negative surface charge and the metal ion is positively charged.

In another embodiment, the attachment of the particle to the surface can be accomplished through either through electrostatic self-assembly or covalent bonding.

The non-planar surface can be a polymer with a negative surface charge and the metal ion is positively charged. For example, the negative charge is imparted using carboxylates of the formula R—$CH_2$—COO—, wherein R contains a reactive group for functionalizing the primary alcohol of the carbohydrate backbone including, but not limited to epoxides, alkyl iodides/bromides/chlorides, and sulfonic acid esters.

In one embodiment, the particle is a metal or metal oxide and is functionalized with a chemical reagent having at least one group capable of binding to the metal or metal oxide and at least one group that is charged.

In another embodiment, the particle is an organic polymeric particle having a positively charged surface including, but not limited to, polyalkylammonium salts and cyclic polydiallylammonium salts.

In another embodiment, the particle is an organic polymeric particle having a negatively charged surface including, but not limited to, polystyrene sulfonate, polyacrylic acid, and polyglutamic acid.

In another embodiment, the negative charge is imparted using carboxylates of the formula R—$CH_2$—COO—, wherein R contains a reactive group for functionalizing the primary alcohol of the carbohydrate backbone including, but not limited to, epoxides, alkyl iodides/bromides/chlorides, and sulfonic acid esters.

In another embodiment, the negative charge is imparted using phosphonates of the formula $R_1$—$CH_2$—$PO_3R_2$—, wherein $R_1$ and $R_2$ are defined as follows: $R_1$ contains a reactive group suitable for functionalizing the primary alcohol of the carbohydrate backbone including, but not limited to epoxides, alkyl iodides/bromides/chlorides, and sulfonic acid esters; and $R_2$ is H, $CH_3$, $CH_2CH_3$ or similar aliphatic carbon chains.

In another embodiment, the negative charge is imparted by phosphorylating the primary alcohol of the carbohydrate backbone using a suitable phosphorylating agent including, but not limited to, enzymatic phosphorylating agents such as Baker's yeast hexokinase, phosphorus oxychloride, and 5- or 6-membered ring phosphate esters.

In another embodiment, the negative charge is imparted using sulfonates of the formula R—$CH_2$—$SO_3$—, wherein R contains a reactive group suitable for functionalizing the primary alcohol of the carbohydrate backbone including, but not limited to epoxides, alkyl iodides/bromides/chlorides, and sulfonic acid esters.

In another embodiment, the negative charge is imparted by alkylation of the primary alcohol of the carbohydrate backbone using 1,3-propane sultone or 1,4-butane sultone.

In another embodiment, the negative charge is imparted using sulfonates of the formula R—$CH_2$—$OSO_3$—, wherein R contains a reactive group suitable for functionalizing the primary alcohol of the carbohydrate backbone including, but not limited to epoxides, alkyl iodides/bromides/chlorides, and sulfonic acid esters.

In another embodiment, the negative charge is imparted by alkylation of the primary alcohol of the carbohydrate backbone using 5- or 6-membered ring sulfate esters.

In another embodiment, the particles are deposited as aqueous suspensions.

In another embodiment, the particle deposition is conducted at a temperature above of 273° K.

In another embodiment, the particle deposition is conducted at a pH above 1.

In another embodiment, the method can comprise the step of treating the non-planar surface iteratively, i.e., by a layer-by-layer treatment process. The iterative process uses sequential chemical modification steps to form a plurality of layers (multilayers) of particles. The chemical modification steps can be performed using electrostatic self-assembly, covalent attachment, or combinations of both.

5.2 Polymeric, Non-Planar, Topographically Uneven Surfaces

A conformal (i.e., uniform) coating of chemically functional particles on a polymeric, non-planar, topographically uneven surface is provided. The conformal coating can be produced by the methods of the invention described in Section 5.1.

In one embodiment, the polymeric, non-planar, topographically uneven surface can comprise one or more fibers having a diameter in the range of 10 nanometers-100 micrometers.

Many types of fibers known in the art are suitable for use according to the methods of the invention. The fibers can be organic or inorganic. In one embodiment, the fibers comprise one or more components including, but not limited to, bi- and tri-component fibers in which one of the components is either organic or inorganic.

In another embodiment, the fibers are part of a textile including, but not limited to, woven textile, non-woven textile, woven composite, knit, braid and yarn.

In another embodiment, the fibers are inorganic fibers including, but not limited to, glass fibers based on silica and ceramic fibers comprising alumina, beryllia, magnesia, thoria, zirconia, silicon carbide, and/or quartz.

The polymeric, non-planar, topographically uneven surface can comprise natural or synthetic carbohydrate-based fibers including, but not limited to, cellulose, cellulose acetate, and cotton. In another embodiment, the surface can comprise natural protein-based fibers including, but not limited to, wool, collagen, and silk.

The polymeric, non-planar, topographically uneven surface can comprise organic synthetic fibers capable of participating in hydrogen bonding, which include, but are not limited to, fibers of polyamides (e.g. nylons, aramids, and acrylamides), polycarboxylic acids (e.g., acrylic acid), polysaccharides (e.g., cellulose, cellulose acetate), polyalcohols (e.g., polyvinylalcohol), polyamines, polyaminoacids (e.g., polylysine), polyvinylpyrrolidone, polyethylene oxide, and specialized fibers of block copolymers having nucleobase functionality (e.g., adenine and thymine).

In another embodiment, the polymeric, non-planar, topographically uneven surface can comprise an organic synthetic fiber that is substitutionally inert including, but not limited to, polyamides (e.g. nylons, aramids, etc.), polyesters, fluoropolymers, polyimides, and polyolefins (e.g., polyethylenes such as Tyvek®, polypropylene).

In certain embodiment wherein the fibers are part of a textile material, the textile material can be a composite of synthetic fiber and natural fiber, a composite of synthetic fibers, or a composite of natural fibers including, but not limited to, cotton and nylon blends, cotton and wool blends, cotton and polyester blends.

In other embodiments, the textile material can be a composite of organic and/or inorganic fibers including, but not limited to synthetic fibers (organic and/or inorganic) and/or natural fibers.

5.3 Conformal Coating on a Polymeric, Non-Planar, Topographically Uneven Surface A conformal (i.e., uniform) coating of chemically functional particles on a polymeric, non-planar, topographically uneven surface is provided. The conformal coating can be produced by the methods of the invention described in Section 5.1

The conformal coating produced by the methods of the invention can comprise particles having a cross-sectional diameter ranging from 2 to 2,000 nanometers.

In one embodiment, the average distance between adjacent particles across the entire non-planar surface can be no greater than 10 times the largest cross sectional dimension of particle.

In one embodiment, the particles can be metallic wherein "metallic" indicates metal particles (e.g., Au, Ag, Cu, Pt, Pd) and metal oxide particles (e.g. ZnO, $TiO_2$, $SnO_2$).

In another embodiment, the particles can be organic and can include, but are not limited to, polystyrene sulfonate based particles, polyacrylate based particles, and polyglutamate based particles, polyalkylammonium salt based particles, and cyclic polydiallylammonium salt based particles.

In another embodiment, the particles can be inorganic and non-metallic and include, but are not limited to, $SiO_2$.

As described above, in certain embodiments, particles can be conformally coated on a non-planar surface by chemically modifying the non-planar surface to impart a surface charge, covalently attached to a chemically modified non-planar surface, or deposited on a plasma-treated non-planar surface imparted with a surface charge. According to these embodiments, the coating particles can be hybrid particles including, but not limited to, semiconductor quantum dots and core/shell particles comprising materials selected from the group consisting of metals, metal oxides, polymers, and non-metal oxides (e.g., $SiO_2$).

In another embodiment, the particles can be spherical and/or non-spherically shaped, e.g., rods, cubes, polygons, etc.

In another embodiment, the particles can actively function as devices (e.g., sensor, particles that mediate controlled release of agents, etc.).

The particles can also be functionalized with organic and/or inorganic components. Chemically modified particles can be, for example, functionalized metal particles (e.g., Au, Ag, Cu, Pt, Pd), functionalized metal oxide particles (e.g., ZnO, $TiO_2$, SnO), functionalized non-metal oxide particles (e.g. $SiO_2$), or functionalized organic polymeric particles (e.g., polyacrylic acid).

In another embodiment, the particles derive from an intermediate substrate comprised of charged non-planar surfaces complexed with oppositely charged metal ions or oppositely charged metal complexes.

5.4 Uses of Coated Materials

Materials coated according to the methods of the invention and/or with the coatings of the invention ("coated" or "treated" materials) can have antimicrobial properties for applications including, but not limited to, surgical garments, wound dressings, bedding, masks, diapers, sanitary products carpeting, upholstery, filtration media, ropes, and sutures. For example, nanofiber mats decorated with metal particles produced in accordance with the methods of the invention can exhibit strong antibacterial activity, and thus can be used, e.g., for producing wound dressing, antibacterial clothing, and non-woven antibacterial filtration materials.

Coated materials can provide antimicrobial properties for implantable medical applications including, but not limited to, treated collagen, pacemakers and other medical devices.

The coating on the treated material can provide antimicrobial properties to prevent biofilm development on the material. It can provide antimicrobial properties for filter media used in filtration of air, water, or other fluids.

The coating on treated materials can provide catalytic properties for use in reactors, catalytic converters, etc.

Fiber mats decorated with metallic or nonmetallic particles produced in accordance with the methods of the invention can be used as flexible and portable catalytic mantles or as seeds for electroless deposition of metal on cellulose substrates.

The coating on treated materials can provide enhanced spectroscopic properties such as Raman spectroscopy, infrared spectroscopy and fluorescence spectroscopy for applications including, but not limited to, positive identification, analyte detection and tagging/tracking identification.

The coating on treated materials can provide enhanced magnetic properties for applications including, but not limited to, positive identification, tagging/tracking identification, microwave directed hyperthermia and high efficiency motor windings.

Coated materials that exhibit self-cleaning (hydrophobic and/or oleophobic) properties can be used in textiles goods including, but not limited to, outerwear such as coats, jackets, shirts and trousers, undergarments, hats and footwear.

Coated materials that exhibit superhydrophobic and/or superoleophobic properties can be used in textiles goods including, but not limited to, outerwear such as coats, jackets, shirts and trousers, undergarments, hats and footwear.

Coated materials that exhibit electrical conductivity can be used in applications including, but not limited to, detection of garment integrity breach, monitoring of medical condition (heart rate, etc.), anti-tampering devices, anti-static devices, positive identification and batteries.

Coated materials that exhibit thermal conductivity can be used in applications including, but not limited to, athletic shirts, socks, jackets, microprocessors, electronics and sensors.

Coated materials that exhibit insulating properties can be used in applications including, but not limited to, athletic and outdoor clothing, socks, jackets, microprocessors, electronics and sensors.

The particles and particle density of coated materials can be adjusted to affect the absorption, reflection and scattering of light of UV, visible, near infrared and infrared wavelengths.

Coated materials can be used to provide enhanced wound healing properties via electrical conductivity, heat conduction, or the attraction of curative blood constituents.

In another aspect, the methods of the invention can also be used for fabric inkjet printing with particles.

The following examples are offered by way of illustration and not by way of limitation.

6. EXAMPLES

6.1 Example 1

Efficient Assembly of Metal Nanoparticles on Electrospun Nylon 6 Nanofibers by Control of Interfacial Hydrogen Bonding Interactions

6.1.1 Summary

This example demonstrates an efficient, one-step route for uniformly assembling preformed Ag metal nanoparticles (NPs) on the surface of electrospun nylon 6 nanofibers that is driven by interfacial hydrogen bonding interactions. Metal nanoparticles (Ag, Au, Pt) were assembled on electrospun nylon 6 nanofibers by controlling the interfacial hydrogen bonding interactions between the amide groups in the nylon 6 backbone and the carboxylic acid groups capped on the surface of the metal nanoparticles.

Metal nanoparticles were synthesized in aqueous media using sodium citrate as a stabilizer. Nylon 6 nanofiber mats, produced by electrospinning, were immersed into pH-adjusted solutions of metal nanoparticles. Since silver and silver ions have long been known to exhibit strong inhibitory and bactericidal effects as well as a broad spectrum of antimicrobial activities (Choa, K.-H.; Park, J.-E.; Osaka, T.; Park, S.-G. Electrochim. Acta 2005, 51, 956), the antibacterial activity of these Ag-nylon 6 fibers was evaluated against *Escherichia coli* (*E. coli*). The nylon 6 nanofiber mats decorated with Ag nanoparticles exhibited strong antibacterial activity against *Escherichia coli.*

One factor determining the assembly phenomena was identified as the hydrogen bonding interactions between the amide groups in the nylon 6 backbone and the carboxylic acid groups capped on the surface of the metal nanoparticles. The assembly was strongly dependent on the pH of the media, which affected the protonation of the carboxylate ions on the metal nanoparticles and hence, influenced the hydrogen bonding interaction between nanofibers and nanoparticles. High surface coverage of the nanofibers by the Ag nanoparticles was found at pH intervals from 3 to 6, whereas only few Ag nanoparticles were found on the surface of the fibers when the pH was greater than 7.

6.1.2 Materials and Methods

6.1.2.1 Chemicals

Silver nitrate ($AgNO_3$), hydrogen tetrachloroaurate trihydrate ($HAuCl_4_3H_2O$), chloroplatinic acid hexahydrate ($H_2PtCl_6_6H_2O$), sodium borohydride ($NaBH_4$), sodium citrate tribasic dihydrate ($Na_3C_6H_5O_7_2H_2O$), nylon 6 and formic acid were all purchased from Sigma-Aldrich and used as received. All solutions were prepared using distilled/deionized water with resistance ~18.2 MΩcm.

6.1.2.2 Synthesis of Citrate-Stabilized Ag NPs

The aqueous solution of Ag NPs was synthesized by sodium borohydride reduction of $AgNO_3$ in the presence of sodium citrate as a stabilizing reagent (Lok, C.-N.; Ho, C.-M.; Chen, R.; He, Q.-Y.; Yu, W.-Y.; Sun, H.; Tam, P. K.-H.; Chiu, J.-F.; Che, C.-M. J. Proteome Res. 2006, 5, 916). The stoichiometry of $AgNO_3$/sodium citrate/$NaBH_4$ in the solution has a molar ratio of 1:1:5. A 45 mL solution of $AgNO_3$ and sodium citrate was prepared from 8.5 mg $AgNO_3$ dissolving in water followed by addition of 14.7 mg $Na_3C_6H_5O_7.2H_2O$ in water under continuous stirring. To this solution, a 5 mL solution of $NaBH_4$ (9.5 mg) was rapidly added under vigorously stirring. After one hour of continuous stirring at room temperature, a deep brown solution was formed.

6.1.2.3 Synthesis of Citrate-Stabilized Au NPs

Synthesis of citrate-stabilized Au NPs was carried out using methods of Turkevich et al., (Turkevich, J.; Stevenson, P. C.; Hiller, J. Discuss. Faraday Soc. 1951, 11, 55). A 45 mL aqueous solution of $HAuCl_4_3H_2O$ (19.7 mg) was heated to boiling under vigorous stirring. A 5 mL aqueous solution of sodium citrate (73.5 mg) was introduced to the gold salt solution. This stoichiometry leads to a molar ratio of $HAuCl_4_3H_2O$ to sodium citrate 1:5 in the reaction solution. Continuous boiling for one hour completed the formation of the colloids producing a stable solution with a wine red color.

6.1.2.4 Synthesis of Citrate-Stabilized Pt NPs

Synthesis of citrate-stabilized Pt NPs was carried out using methods of Pron'kin et al. (Pron'kin, S. N.; Tsirlina, G. A.; Petrii, O. A.; Vassiliev, S. Y. Electrochim. Acta 2001, 46, 2343A). 45 mL of H2PtCl6 aqueous solution was prepared by dissolving 26.5 mg $H_2PtCl_6.6H_2O$ in water, and then a 5 mL solution of sodium citrate (73.5 mg) was added. The mixture with a 1:5 molar ratio of $H_2PtCl_6$ to sodium citrate was heated to reflux, and it was kept refluxing for one hour. A solution of Pt NPs with a black color was yielded after reflux.

6.1.2.5 Electrospinning of Nylon 6

Nylon 6 was dissolved in formic acid to form a solution with a concentration of 220 mg/mL. Electrospinning was carried out using a syringe and an 18 gauge needle with a flat tip at an applied voltage of 20 kV. The syringe pump was set to deliver polymer solution at a feeding rate of 0.5 mL/h. The nanofibers were collected on a grounded aluminum sheet that was located 20 cm apart from the needle.

6.1.2.6 Assembly of Metal NPs on Nylon 6 Nanofibers

For pH-controlled assembly of Ag NPs on nylon 6 nanofibers, the pH values of the solutions of Ag NPs were adjusted to 3.0, 4.0, 5.0, 6.0, 7.0, respectively, from the original pH 9.7 using a 1 M HCl solution. Immediately after pH adjustment, nylon 6 nanofiber mats, peeled off from the collector, were immersed into the pH adjusted solutions. After a 3 h immersion, the mats were taken out, thoroughly rinsed in deionized water and air-dried. For the assembly of Au NPs and Pt NPs, the pH of NP solutions was adjusted to 5.0 by adding drops of 1 M HCl solution. Similar procedures as those previously described for Ag NP were used for binding Au NPs and Pt NPs on the surface of nylon 6 nanofibers.

6.1.2.7 Antibacterial Test

The antibacterial properties of the Ag-nylon 6 nanofiber mats were examined against *Escherichia coli* coli) (K-12, a Gram-negative bacterium), according to a modified AATCC 100 test method. Nylon 6 nanofiber mats without Ag NPs were used as control. Ten milligrams of the control sample and the Ag-nylon 6 nanofiber mats were placed in a sterilized container. A 1.0 mL volume of an aqueous suspension containing *E. coli* was dropped onto the surfaces of the mats. Four hatches of the Ag-nylon 6 nanofiber mats and the control samples were prepared to assess the effect of contact times varying from 2 h, 5 h, 12 h to 24 h on the antibacterial properties of the Ag-nylon 6 nanofiber mats. After exposure, the inoculated controls and the Ag-nylon 6 nanofiber mats were placed into 100 mL distilled water. The mixture was vigorously shaken for 1 min. Then 100 μL of microbial suspension was taken out from the container and diluted to $10^1$, $10^2$, and $10^3$ times in sequence. Finally, 100 μL each of the microbial suspension and the three diluted solution were placed onto four zones of a nutrient agar plate, and incubated at 37° C. for 18 h.

The numbers of viable bacteria on zone 4 of the nutrient agar plates for the control samples and for the Ag-nylon 6 nanofiber mats were counted, and the difference between these two numbers was obtained. The total numbers of bacteria killed by Ag NPs on nylon 6 nanofiber mats was calculated using the difference multiplied by the dilution times, $10^5$. The power index to 10 of the calculated total number represents the logarithm reduction-of bacteria. The numbers of bacteria on zone 3, 2 and 1 were also counted, and the logarithm reductions of bacteria in these three zones were calculated for procedure validation purposes.

6.1.2.8 Characterization

Field emission scanning electron microscopy (FESEM) was carried out with a LEO 1550 at a voltage of 2 kV, using an in-lens detector. The specimens were sputtered with an ultra thin layer of Au/Pd before imaging. Transmission electron microscopy (TEM) were performed on a TECNAI T-12 with 120 kV accelerating voltage. Samples for TEM imaging were prepared as follows. Nylon 6 nanofibers were electrospun directly onto TEM grids coated with lacey support films. The TEM grids were immersed into pH-adjusted solutions of metal nanoparticles for 3 h. The grids were rinsed with copious deionized water and air-dried. UV-vis spectra were collected using a PerkinElmer Lambda 35 spectrometer. The liquid samples were placed in quartz cuvettes and the fiber samples were supported on glass slides.

6.1.3 Results and Discussion 6.1.3.1 pH-Controlled Assembly of Ag NPs on Nylon 6 Nanofibers The assembly process initiated with the synthesis of Ag NPs in the presence of sodium citrate and the fabrication of nylon 6 nanofibers via electrospinning. The citrate ions, weakly bound on the NP surfaces, imparted negative charges to the metal NPs and prevented aggregation of the NPs in the solution (Henglein, A. J. Phys. Chem. B 1999, 103, 9533-9539). The as synthesized Ag colloidal solution exhibited a deep brown color and a pH value of 9.7. The production of nylon 6 nanofibers via electrospinning is a well documented process (Ryu, Y. J.; Kim, H. Y.; Lee, K. H.; Park, H. C.; Lee, D. R. Europ. Polym. J. 2003, 39, 1883). A nonwoven mat consisting of uniform and continuous nanofibers with an average diameter of 108 nm and interconnected pores was produced by electrospining a 220 mg/mL formic acid polymer solution.

Nylon 6 nanofiber mats were immersed into pH adjusted solutions of Ag NPs (pH values of 3.0, 4.0, 5.0, 6.0, 7.0 and 9.7 were used) immediately after acidification. Thirty minutes after the pH of the solutions was adjusted aggregates of Ag NPs formed in the solution at pH 3.0 whereas the solutions at higher pH remained clear. Aggregates of NPs formed at the bottom of the solutions with pH ranging from 4.0 to 6.0 after the solutions stood overnight. The color of the fiber mats evolved from white into brown after they were immersed during 3 h into the solutions with acidic pH values. The dried nanofiber mats immersed in solutions with pH values ranging from 3.0 to 6.0 exhibited a dark brown color, the mat at pH 7.0 had a light brown color, while the mat prepared at pH 9.7 remained white color.

Figure 1B:
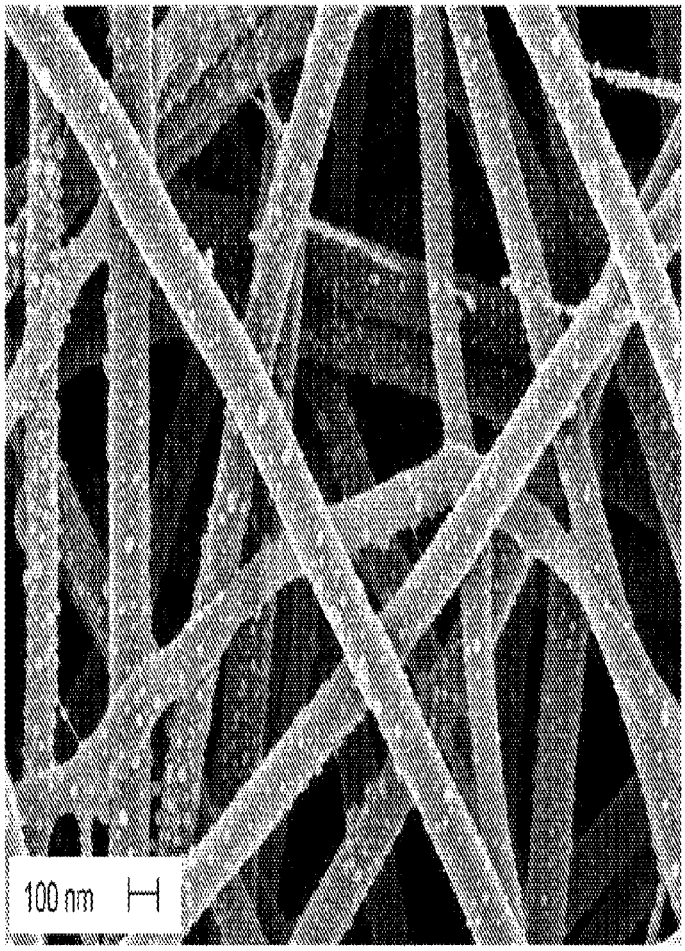
Figure 1C:
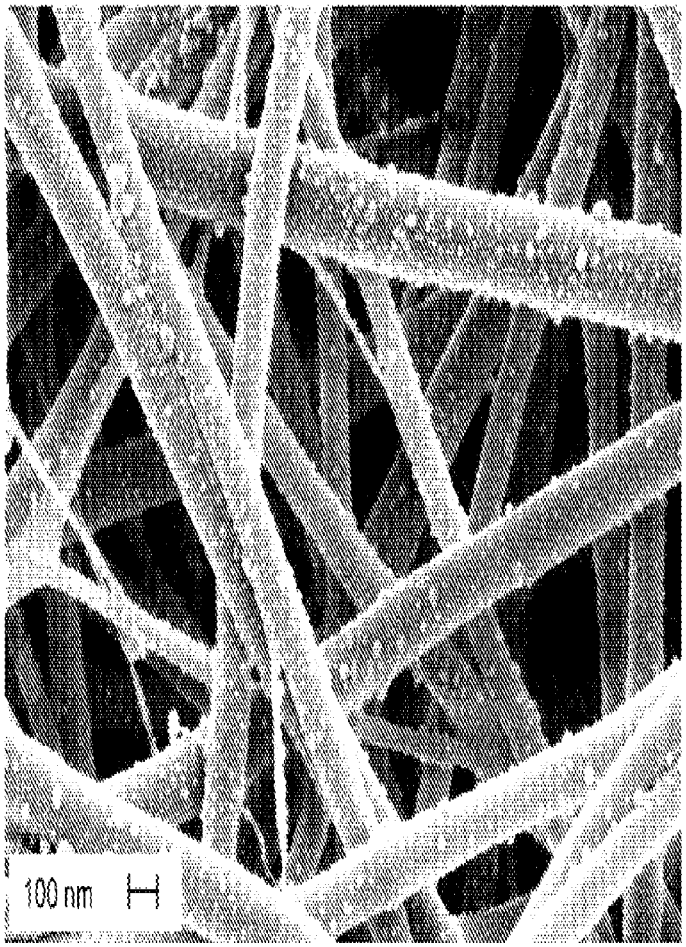
Figure 1D:
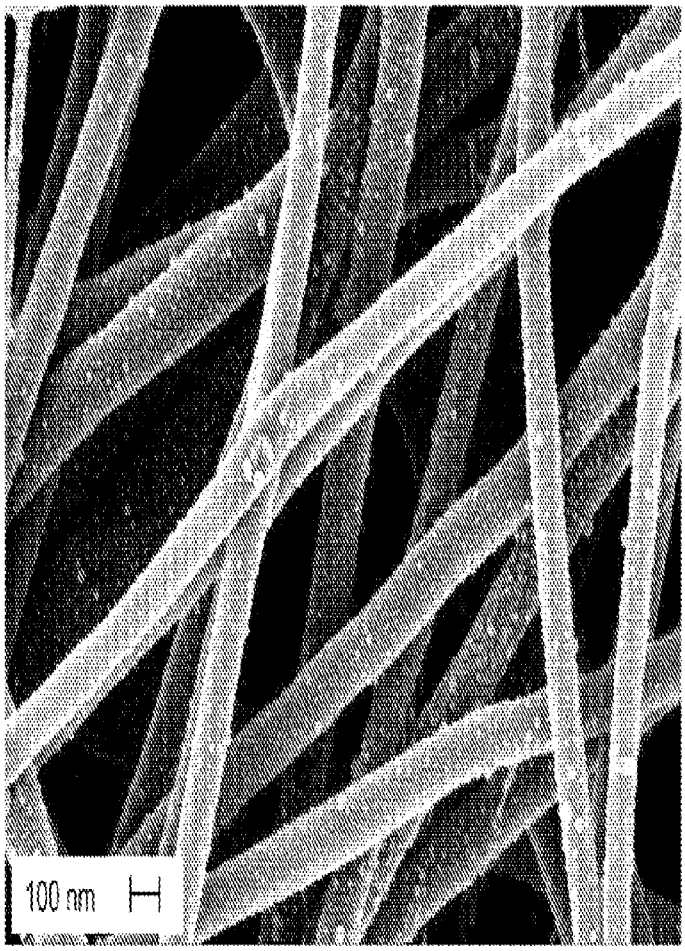
Figure 1E:
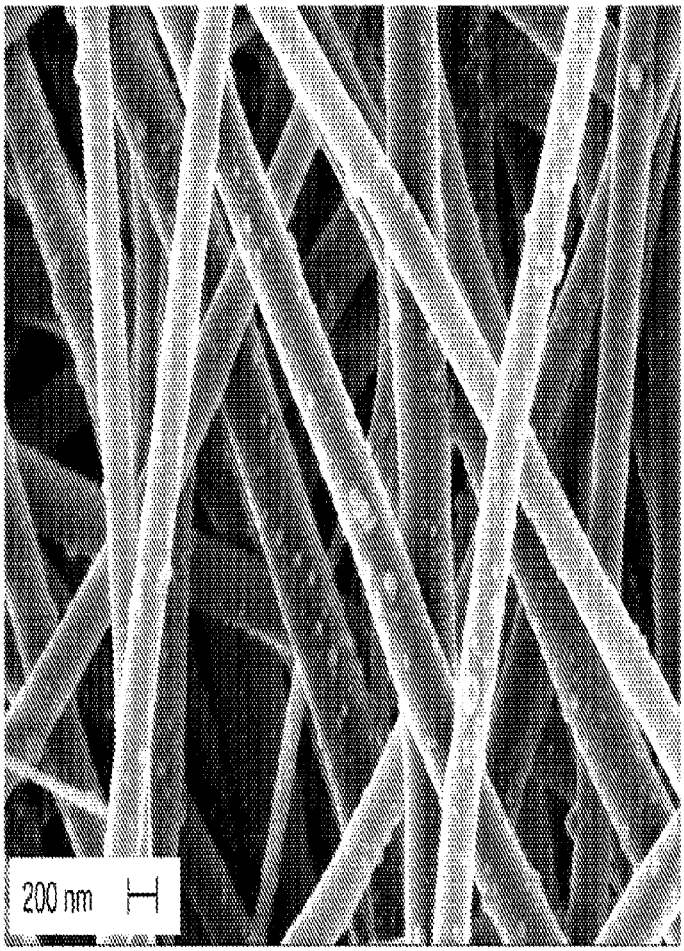
Figure 1F:
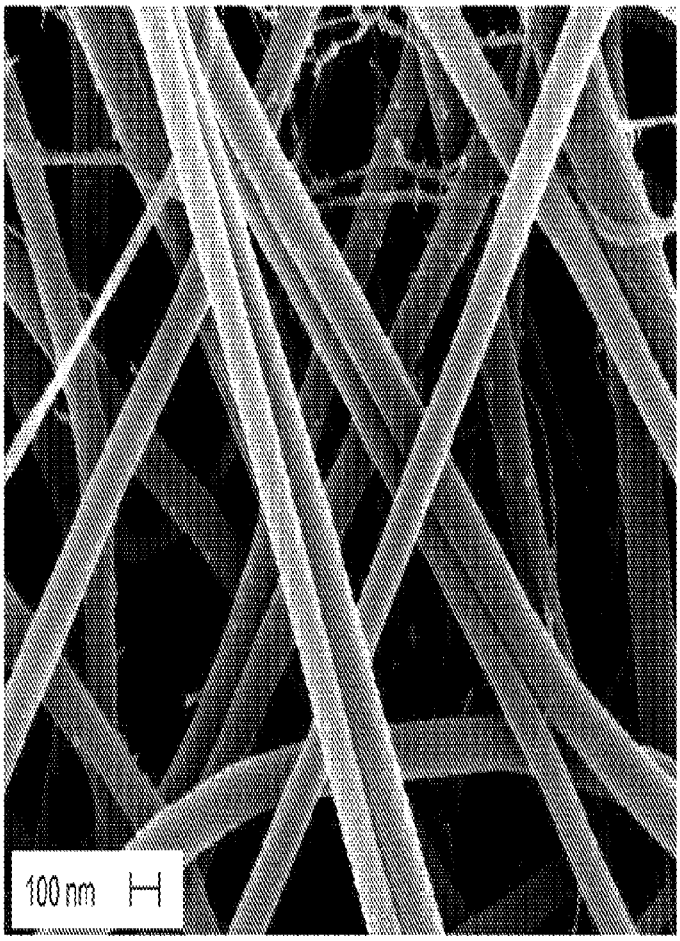

FIG. 1 shows FESEM images of Ag-nylon 6 nanofiber mats as a function of the pH values of the Ag NP solutions (FIG. 1A, pH 3.0, FIG. 1B, pH 4.0, FIG. 1C, pH 5.0, FIG. 1D, pH 6.0, FIG. 1E, pH 7.0, and FIG. 1F, pH 9.7). At pH values ranging from 3.0 to 6.0, individual nanoparticles were observed to distribute uniformly and in high coverage density on the surface of the nylon 6 nanofibers (FIGS. 1A-1D), whereas only a few nanoparticles were found on the nanofibers immersed in the solution with pH 7.0 (FIG. 1E). Very few particles were observed on the surface of the nanofibers immersed in the as-synthesized solution (pH 9.7) (FIG. 1F).

To assess the assembling structure of the Ag NPs on the nanofibers, nylon 6 nanofibers were directly electrospun onto TEM grids coated with lacey support films. The nanofibers were decorated with Ag NPs by immersing the TEM grids into pH-adjusted Ag nanoparticle solutions. FIG. 2A-2B shows TEM images of a nylon 6 sample immersed in a solution of Ag nanoparticles at pH 5.0. FIG. 2A shows TEM images at low magnification and FIG. 2B shows TEM images at high magnification. A large number of individual nanoparticles with spherical shape were observed to distribute homogeneously on the surface of the nylon 6 nanofibers. The size of Ag NPs on the fiber surface had an average of 8 nm.

UV-vis spectroscopy was employed for further characterization of Ag NPs assembled on nylon 6 nanofibers. FIG. 3 shows UV-vis spectra for (A) diluted solution of as-synthesized Ag NPs at a ratio of 1:1 with water, (B) nylon 6 nanofiber mat, (C) wet Ag-nylon 6 nanofiber mat, and (D) dried Ag-nylon 6 nanofiber mat. The spectrum of the diluted solution of Ag nanoparticles in FIG. 3(A-D) shows an absorption band at 394 nm which is attributed to the surface plasmon resonance band (SPR) of Ag NPs (Lok, C.-N.; Ho, C.-M.; Chen, R.; He, Q.-Y.; Yu, W.-Y.; Sun, H.; Tam, P. K.-H.; Chiu, J.-F.; Che, C.-M. J. Proteome Res. 2006, 5, 916).

The SPR band of the wet Ag-nylon 6 fiber mat was red shifted to 409 nm. This red shift of the SPR band can be explained by the close proximity of NPs on the nanofibers compared with a larger interparticle distance while the NPs are in solution. The SPR of dried Ag-nylon 6 nanofiber mat was also broadened and further red shifted to 416 nm due to further closed interparticle distance after drying.

6.1.3.2 Assembly Mechanism

The assembly mechanism for citrate-covered NPs on the nylon 6 nanofibers could be explained on the basis of hydrogen bonding interactions between the amide groups along the nylon 6 backbone and the carboxylic acid groups capped on the surface of the Ag NPs, as presented in FIG. 21. Nylon 6 has been known to have inter- and intra-hydrogen bonding through its amide groups leading to the high crystallinity of nylon 6 (Reddy, P. S.; Kobayashi, T.; Abe, M.; Fujii, N. Europ. Polym. J. 2002, 38, 521). Nylon 6 has also been reported to interact with other polymers containing carboxylic acid groups forming miscible blends via hydrogen bonding interactions (Sainath, A. V. S.; Inoue, T.; Yonetake, K.; Koyama, K. Polymer 2001, 42, 9859). Either amide and carboxylic acid functional groups can act as proton donor and acceptor hence dimeric associations involving two hydrogen bonds can form between amid and carboxylic acid groups (Wash, P. L.; Maverick, E.; Chiefari, J.; Lightner, D. A. J. Am. Chem. Soc. 1997, 119, 3802). The pKa values of citric acid are known to be 3.13, 4.76, 6.40 (Lide, D. R., Handbook of Chemistry and Physics, 87th edition; CRC: 2007).

The as-synthesized Ag NP aqueous solution, using citrate as a stabilizer, has a pH value of 9.7. At a pH above the pKa values, carboxylate groups are attached on the surface of the Ag NPs. These carboxylate ions may form one hydrogen bond with the amide groups in the nylon 6 backbone between the carbonyl in the carboxylate and the H—N in the amide.

This interaction, however, might not be strong enough to drive Ag NPs from the solution to the surface of the nylon 6 fibers when compared with the hydrogen bonding interactions between water and nylon 6 (Iwamoto, R.; Murase, H. J. Polym. Sci. Part B-Polym. Phys. 2003, 41, 1722). As the pH of Ag NP solutions is lowered to 6.0, which is below one of the pKa values of citric acid (6.40), one of the three COONa groups from the surface-bound citrate on the surface of the NPs is acidified becoming COOH. This COOH group can be bridged to the amide group on the surface of the nylon 6 fibers through two intermolecular hydrogen bonds as shown in FIG. 21. Further increasing the number of COOH groups on the Ag NPs by lowering down the pH of the solutions below 6 did not appear to increase the quantity of Ag NPs bound with nylon 6 nanofibers. At pH 3.0, the COONa groups on Ag NPs are completely acidified. The strong hydrogen bonding between two COOH groups attached to Ag NPs brings the NPs into close proximity in all three-dimensions resulting in the formation of aggregates.

FIG. 21 shows the postulated mechanism of pH-induced assembly of metal nanoparticles on the surface of nylon 6 nanofibers.

6.1.3.3 Antibacterial Test

Ag NPs with high specific surface area and large fraction of surface atoms, are expected to exhibit high antimicrobial activity compared to that of bulk. Ag meta 1 (Choa, K.-H.; Park, J.-E.; Osaka, T.; Park, S.-G. Electrochim. Acta 2005, 51, 956-960; Lok, C.-N.; Ho, C.-M.; Chen, R.; He, Q.-Y.; Yu, W.-Y.; Sun, H.; Tam, P. K.-H.; Chiu, J.-F.; Che, C.-M. J. Biol. Inorg. Chem. 2007, 12, 527-534). The antibacterial activities of Ag NPs have been found to be size dependent, with smaller particles having higher activities on the basis of equivalent silver mass content (Lok, C.-N.; Ho, C.-M.; Chen, R.; He, Q.-Y.; Yu, W.-Y.; Sun, H.; Tam, P. K.-H.; Chiu, J.-F.; Che, C.-M. J. Biol. Inorg. Chem. 2007, 12, 527-534). The effects of Ag nanoparticles on microorganisms and the precise antimicrobial mechanism have not been completely revealed yet. One proposed mechanism is that the antibacterial activity of Ag NPs originates from chemisorbed Ag+, which is readily formed on Ag NPs owing to their extreme sensitivity to oxygen (Lok, C.-N.; Ho, C.-M.; Chen, R.; He, Q.-Y.; Yu, W.-Y.; Sun, H.; Tam, P. K.-H.; Chiu, J.-F.; Che, C.-M. J. Biol. Inorg. Chem. 2007, 12, 527-534).

The antibacterial properties of nylon 6 nanofibers with or without Ag NPs were examined against *E. coli* according to a modified AATCC 100 test method. The contact time of the nanofiber mats with bacteria varied from 2 h, 5 h, 12 h, to 24 h. The antibacterial effect of the Ag-nylon 6 fiber mat is obvious, as shown in FIG. 4A-B. No colony of viable bacteria was found in the agar plate with the solution extracted from the Ag-nylon 6 nanofiber mat even at a contact time of 2 h, whereas proliferated colonies were observed in all the agar plates at all contact times from the uncoated nylon 6 nanofiber mat. The reduction of *E. coli* at a contact time of 2 h (FIG. 4A) was 5-logarithm. When the contact time increased to 5 h, 12 h and 24 h (FIG. 4B), the reductions could further reach 6-7 logarithm. The very strong and rapid antibacterial activity of the Ag-nylon 6 nanofiber mats, comparing with that of Ag NPs incorporated in the electrospun polymer fibers (Son, W. K.; Youk, J. H.; Lee, T. S.; Park, W. H. Macromol. Rapid Commun. 2004, 25, 1632-1637; Xu, X. Y.; Yang, Q. B.; Wang Y. Z.; Yu, H. J.; Chen, X. S.; Jing, X. B. Europ. Polym. J. 2006, 42, 2081-2087), could be attributed to the high surface packing density of the Ag NPs assembled exclusively on the surface of nylon 6 nanofibers.

Applications of these porous mats thus include wound dressing and antibacterial filtration.

FIG. 4 shows the results of antibacterial tests of nylon 6 nanofiber mats without (left) and with (right) Ag NPs against *E. coli* after incubation. (A) 2 h contact time. (B) 24 h contact time. The extraction of bacterial solution after the contact time was diluted to $10^1$, $10^2$, and $10^3$ times. Then the extraction and three diluents were incubated on four zones of a nutrient agar plate at 37° C. for 18 h.

6.1.3.4 Assembly of Au NPs or Pt NPs on Nylon 6 Nanofibers

The assembly method presented in this example, utilizing interfacial hydrogen bonding interactions, can also be extended to anchoring many other metal NPs capped with carboxylic acid groups. Au NPs and Pt NPs, synthesized using citrate as both a reducing agent and protective group, were applied as examples to demonstrate the versatility of the reported approach. After synthesis, a solution of Au NPs with a wine red color and a solution of Pt NPs with a black color, respectively, were yielded. The pH values of the NP solutions were adjusted to 5.0 before immersion of the nylon 6 nanofiber mats. After dried, the nanofiber mats exhibited a purple color and a grey color for those immersed in Au and Pt NPs solutions, respectively.

Figure 5A:
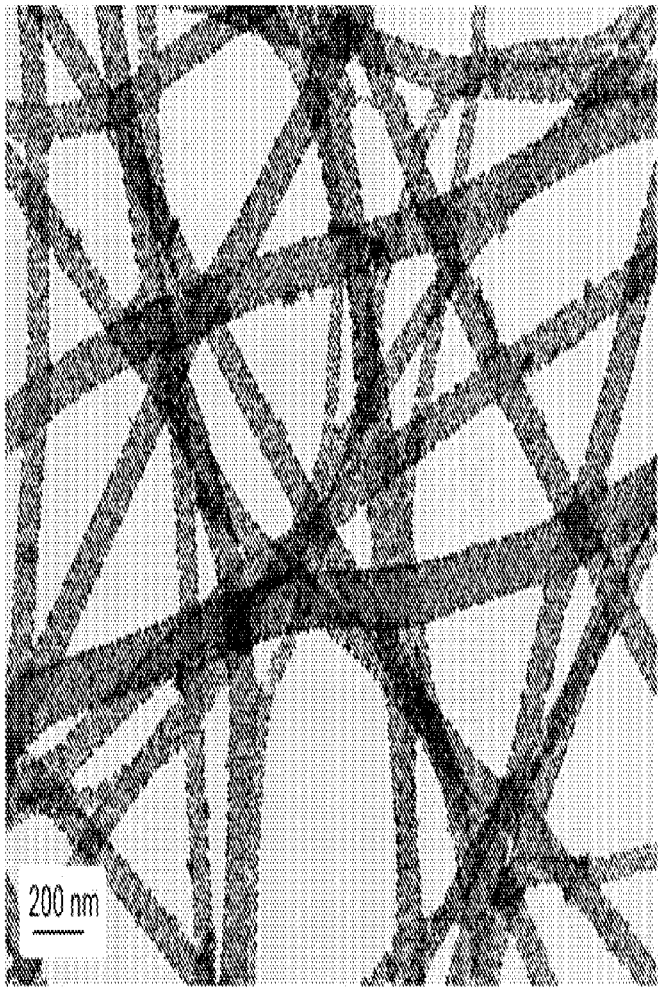
Figure 5B:
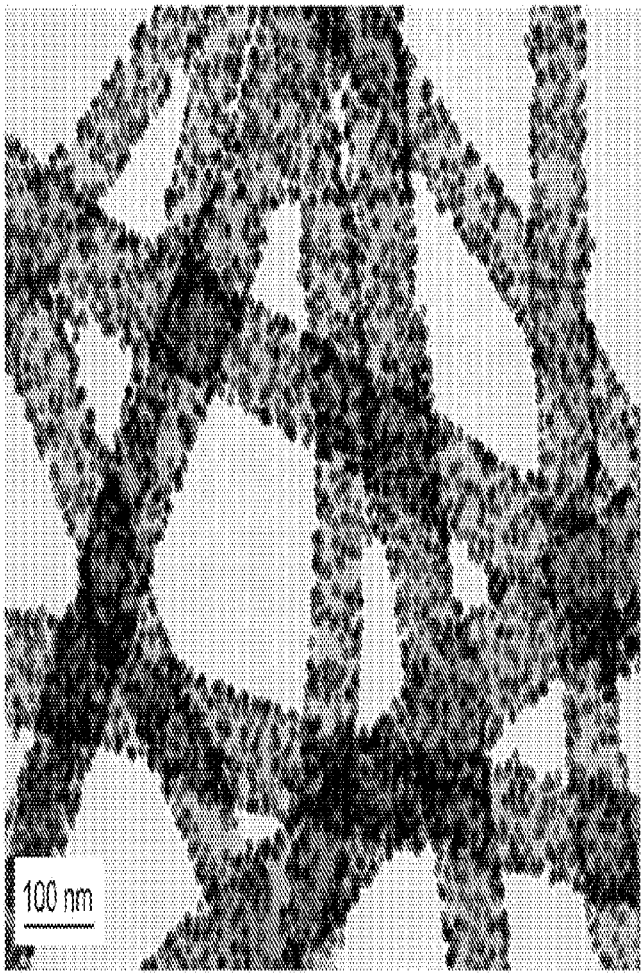

FIGS. 5A-D shows TEM images. FIGS. 5A and 5B show assembly of Au NPs on nylon 6 nanofibers at pH 5. Spherical NPs with an average diameter of 12 nm were observed to uniformly distribute on the surface of nanofibers.

Figure 5C:
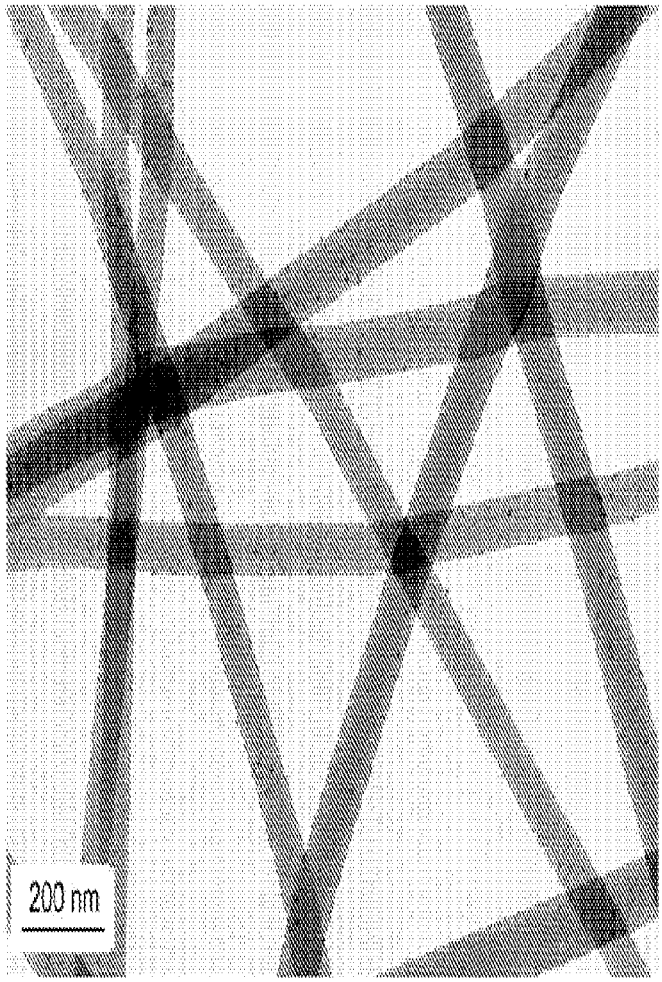
Figure 5D:
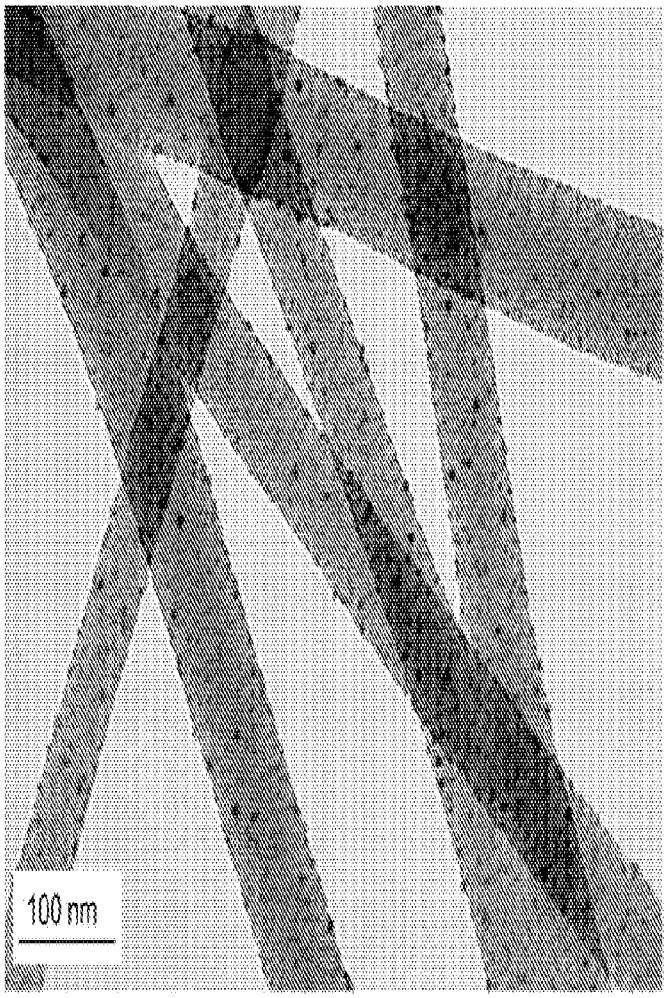

FIGS. 5C and 5D show assembly of Pt NPs on nylon 6 nanofibers at pH 5. A large quantity of irregular-shaped NPs with an average size of 2-3 nm was found to be dispersed on the surface of nanofibers.

FIG. 6A shows the UV-vis spectra for (a) half-diluted solution of Au NPs and for (b) the Au-nylon 6 nanofiber mat. FIG. 6B shows the UV-vis spectra for (a) the half-diluted solution of Pt NPs and for (b) the Pt-nylon 6 nanofiber mat. The UV-vis absorption spectrum in FIG. 6A indicates that the solution of Au NPs exhibits a sharp SPR band at 519 nm, which is characteristic for Au NPs (Rotello, V. M. Nanoparticles: Building Blocks for Nanotechnology; Kluwer Academic Publishers: New York 2004). The SPR band of Au NPs on the dried nylon 6 nanofiber mat was broadened and red shifted to 531 nm. This red shift of SPR hand could be explained by the close proximity of the NPs on the nanofibers after dried compared to the larger interparticle distance while in solution. The UV-vis absorption spectra (FIG. 6B) indicate that both the solution of Pt NPs and Pt NPs on the nylon 6 nanofiber mat have no absorption band in the visible range, which is consistent with previous report on Pt NPs (Pron'kin, S. N.; Tsirlina, G. A.; Petrii, O. A.; Vassiliev, S. Y. Electrochim. Acta 2001, 46, 2343).

6.1.4 Conclusion

The assembly of metal nanoparticles on electrospun nylon 6 nanofibers by control of interfacial hydrogen bonding interactions has been demonstrated. A high surface packing density of the nanoparticles was achieved on the surface of the nanofibers when the NPs precursor solutions were adjusted to pH values between 3 and 6. When the pH of the NP solutions was higher than 7.0, limited coverage of the surface of the nanoparticles was noted. The nylon 6 nanofiber mat decorated with Ag NPs exhibited very strong antibacterial activities against *E. coli*. The assembly of Au NPs and Pt NPs on nylon 6 nanofibers demonstrated the versatility of this method for the deposition of other metal nanoparticles onto nylon 6 nanofibers. The mechanism for the pH-induced assembly of metal nanoparticles on the surface of nylon 6 nanofibers appears to be controlled by the presence of dimeric associations involving two hydrogen bonds that form between the amid and carboxylic acid groups present on the nanofiber and the nanoparticles.

6.2 Example 2

Surface Bonding of Metal and Metal Oxide Nanoparticles on Cellulose Substrates 6.2.1 Summary This example demonstrates surface bonding of metal nanoparticles on cellulose substrates using two approaches: direct assembly of metal nanoparticles on cationic cellulose substrates and in-situ synthesis of metal nanoparticles on cationic and anionic cellulose substrates.

6.2.2 Background

In situ synthesis of metal nanoparticles on porous cellulose fibers has been previously demonstrated by He et al. (2003, Chem. Mater. 15, 4401-4406). Metal nanoparticles were formed on porous cellulose fibers by impregnation and reduction.

Hyde et al. (2007, Effect of surface cationization on the conformal deposition of polyelectrolytes over cotton fibers. Cellulose (2007) 14:615-623, DOI 10.1007/s10570-007-9126-z) showed assembly of a solution of charged polymers onto fibrous material. These polymers represented continuous domains and assembled onto the fibrous materials as films. Hyde et al. showed the effect of surface cationization on the conformal deposition of alternating nanolayers of poly (sodium styrene sulfonate) (PSS) and poly(allylamine hydrochloride) (PAH) over cotton fibers. Three different levels of cotton cationization were evaluated. Variations in the cationization degree were achieved by manipulating the ratio of 3-chloro-2-hydroxy propyl trimethyl ammonium to NaOH. Experimental results obtained via Carbon-Hydrogen-Nitrogen-Sulfur (CHNS) elemental analysis and X-ray Photoelectron Spectroscopy (XPS) indicated that the deposition process was not significantly influenced by the degree of cotton cationization. The build up of further polyelectrolyte layers was found to be less sensitive to variations in the cationic character of the substrates once a critical number of alternating layers was deposited.

In the present example, metal nanoparticles were surface-bonded on cellulose substrates by four methods; (1) direct assembly using negatively charged nanoparticles in a colloidal solution and cationic cellulose (FIG. 7A; left), (2) in situ synthesis using negatively charged metal complexes and cationic cellulose (FIG. 7B; left), and (3) in situ synthesis using positively charged metal ions and anionic cellulose (FIG. 7B; right). The synthetic methods for the production of cationic and anionic cellulose are pictured in FIG. 8 and FIG. 9, respectively. The direct assembly method using positively charged nanoparticles in a colloidal solution and anionic cellulose (shown in FIG. 7A, right) is provided here by way of example. The ordinarily skilled practitioner will understand that this method is encompassed in the present invention.

The cellulose was chemically pretreated with a small organic molecule to give a formal charge on the surface of the fibers. The metal ion or metal complex was then electrostatically bonded to the surface of the cellulose. This was followed by in situ reduction to give nanoparticles that bonded to the fiber surface through electrostatic bonds. The method of the present example contrasts with, and is a significant advance over, prior art methods of, e.g., He et al. (2003, Chem. Mater. 15, 4401-4406), in which a native porous material such as cellulose is simply soaked in an Ag metal ion solution and the metal is reduced to nanoparticles in the pores.

6.2.3 Material and Methods 6.2.3.1 Cotton-Based Cellulose Substrate Preparation

Cationic cellulose was prepared using the methods of Hauser et al. (Color. Technol. 2001, 117, 282-288) and Bilgen (Master Thesis, North Carolina State University, 2005). The synthesis scheme is shown in FIG. 8.

Anionic cellulose was prepared using the methods of Bilgen (Master Thesis, North Carolina State University, 2005). The synthesis scheme is shown in FIG. 9.

6.2.3.2 Preparation of Metal Nanoparticles in Colloidal Solution

Colloidal solutions of metal nanoparticles were prepared at a concentration of approximately 1 mM using well-known methods. Au nanoparticles were synthesized by employing the methods described by Turkevich et. al. (Turkevich, J.; Stevenson, P. C.; Hiller, J. Discuss. Faraday Soc. 1951, 11, 55-75.). Pt nanoparticles were synthesized using the reported protocol of Huang et. al. (Huang, M.; Shao, Y.; Sun, X.; Chen, H.; Liu, B.; Dong, S. Langmuir, 2005, 21, 323-329). Finally, Ag nanoparticles were synthesized using methods described by Lok et. al. (Lok, C.-N.; Ho, C.-M.; Chen, R.; He, Q.-Y.; Yu, W.-Y.; Sun, H.; Tam, P. K.-H.; Chiu, J.-F.; Che, C.-M. J. Proteome Res., 2006, 5, 916). All of the above methods use citrate as the nanoparticle stabilizing agent and give the particles negatively charged surface groups.

6.2.3.3 Characterization

Transmission electron microscopy (TEM) imaging of cross sections of cotton fibers was achieved using a Hitachi H-7000 (100 kV) or a JEOL 1200EX (120 kV). Samples for TEM imaging were prepared by embedding the cotton yarns coated with nanoparticles in a Spurr resin and hardening the resin at 60° C. for 16 h. The embedded specimens were cross-sectioned using an ultramicrotome equipped with a diamond knife. Cross sections of the embedding block with thicknesses of ~100-150 nm were collected on TEM copper grids and dried before imaging. Field-emission scanning electron microscopy (FESEM) was performed on a LEO 1550 microscope, using an in-lens detector. The specimens were coated with a thin layer of carbon ~20-30 nm) prior to FESEM imaging. Elemental characterization was performed using an energy-dispersive X-ray spectroscope attached to the LEO microscope.

6.2.3.4 Direct Assembly of Metal Nanoparticles on Cationic Cellulose Substrates

Pieces of cationic cotton fabric and several cationic cotton yarns were immersed into a beaker containing 50 mL of either a solution of Au nanoparticles or a solution of Pt nanoparticles. After 24 h of soaking, the cotton specimens were removed from the container and rinsed thoroughly with water to remove loosely bound metal nanoparticles. The fabrics and yarns were dried in air before further analysis.

Direct assembly using negatively charged Au nanoparticles in a colloidal solution and cationic cotton (cellulose) is shown in FIGS. 10A-D.

Direct assembly using Pt negatively charged nanoparticles in a colloidal solution and cationic cotton (cellulose) is shown in FIGS. 11A-D.

6.2.3.5 In-Situ Synthesis of Metal and Metal Oxide Nanoparticles on Cationic and Anionic Cellulose Substrates Negative metal complex ions were adsorbed onto cationic cellulose substrates by immersing the cotton specimens in a 5 mM aqueous solution of $NaAuCl_4$ or $Na_2PdCl_4$. After removal of the samples from the metal salt solution, they were rinsed with water three times in order to remove the excess ions. The fabrics or yarns were then immersed in a 50 mM $NaBH_4$ solution in order to reduce the metal ions to zero-valence metal. After reduction, the samples were rinsed copiously with water. The obtained specimens were dried in air prior to characterization.

Cationic cotton specimens treated with $Na_2PdCl_4$ to furnish Pd nanoparticle coated cotton were further processed by electroless plating of Cu nanoparticles. This example indicates the catalytic properties of the Pd deposited onto cotton. Electroless copper plating was carried out using $CuSO_4$, ethylene diamine tetraacetic acid (EDTA), and sodium hypophosphite using the modified procedure of Ochanda et. al. (Ochanda, F; Jones Jr., W. E., Langmuir, 2005, 21, 10791-10796).

Cationic metal ions were adsorbed onto anionic cellulose substrates by immersing the cotton specimens in a 5 mM aqueous solution of $AgNO_3$, $Pd(NO_3)$ or $RuCl_3$ and processed as described above for Au and Pd.

Cationic metal ions of Zn were also adsorbed onto anionic cellulose substrates by immersing the cotton specimens in a 10 mM methanolic solution of $Zn(OAc)_2$ at elevated temperatures (e.g., 60 degrees Celsius). This was followed by the dropwise addition of 30 mM NaOH and further heated at 60 degrees Celsius to produce zinc oxide particles. After a specified time, the cotton specimens were removed from the metal solution and washed with copious amounts of methanol to remove excess particles and dried for analysis.

In situ synthesis of Ag nanoparticles on anionic cotton (cellulose) is shown in FIGS. 12A-C.

In situ synthesis of Au nanoparticles on cationic cotton (cellulose) is shown in FIGS. 13A-D.

In situ synthesis of Pd nanoparticles on cationic cotton (cellulose) is shown in FIGS. 14A-D. The synthetic scheme was the same as in FIG. 13A-D above except that the metallic precursor solution was 5 mM $Na_2PdCl_4$.

In situ synthesis on anionic cellulose substrates was also achieved. Photomicrographs of cellulose substrates resulting from in situ synthesis on anionic cellulose substrates are shown in FIGS. 15A-C and 16A-B.

In-situ synthesis of Cu nanoparticles on cationic cotton (cellulose) is shown in FIGS. 15A-C.

In situ synthesis of ZnO (zinc oxide) nanoparticles on anionic cotton (cellulose) is shown in FIGS. 16A-B.

6.2.3.6 Antibacterial Tests

Modified AATCC 100 Test. The American Association of Textile Chemists and Colorists test method 100 (AATCC 100) provides a quantitative assessment of antibacterial finishes on textile materials. This method was modified according to ASTM method E2149-01 for determining antibacterial activity of immobilized agents under dynamic contact conditions (FIGS. 18A-B). Ag and Cu-treated cotton described in Sections 6.2.3.4 and 6.2.3.5 were weighed out and immersed in *E. coli* or *S. aureus* inoculum that was grown to log phase and diluted to a standardized concentration (e.g., colony forming units per milliliter; CFU/mL, as determined by absorbance and plate count assay). Samples were then agitated with the bacterial cultures on a benchtop shaker and aliquots were taken at 0 hrs (i.e., "0" contact time) and then again at a specified contact time points (1-24 h). Each aliquot was serially diluted, plated and incubated for ~18 hrs to perform standard plate counts. Each assay was done in triplicate with an "inoculum only" control, and negative controls were performed (e.g., cotton or silk materials having no NP coating). From the plate counts, the percent reduction of the organisms resulting from contact with the NP-coated cotton was calculated to be 99.9% after 24 hours, which corresponds to at least a 6 log reduction in growth.

Zone of Inhibition Test. The ability of antibacterial compounds/materials to inhibit bacterial growth can be estimated with a so-called "zone of inhibition" test. Antibacterial materials are placed on an agar plate, pre-seeded with bacteria, which is then incubated to promote bacterial growth. Antibacterial agents diffuse out of the material, inhibiting growth in the "diffusion zone". The relative antibacterial activity and diffusivity of the agent can be determined by comparing the size of these zones of inhibition. The presence of a zone of inhibition for Cu-coated cotton samples described in Section 6.2.3.5 were measured using the standard AATCC 147 test method. The assay was performed by placing an 8 mm disk of each fiber composite onto an agar-media plate seeded with approximately $10^7$ CFUs of *E. coli* or *S. aureus*. After ~18 h of incubation, the diameters of the inhibitions zones were measured.

FIGS. 19A-B display photographs of inhibition zones for Cu-cotton against *S. aureus* (FIG. 19A) and for Cu-cotton against *E. coli* (19B). Control plates were used for non-treated cotton substrates and showed no zone of inhibition.

Biofilm Inhibition Tests. Ag and Cu-coated cotton samples described in Section 6.2.3.4 and Section 6.2.3.5 were also tested for *P. aeruginosa* biofilm inhibition. A standardized microplate-based assay was used as reported by Junker and co-workers (Junker, L. M.; Clardy, J., Antimicrob. Agents Chemother., 2007, 51, 3582-3590). A culture of *P. aeruginosa* was grown overnight to log phase in LB media. In a 96-well microtiter plate, a series of weighed fibers with and without NP-treatment was added to biofilm growth medium (10% tryptic soy broth; TSB), which was then spiked with the bacterial culture to a standard concentration. The microtiter plate was covered and incubated at 37° C. for 24 hours. After this time, medium and substrate was discarded and the wells were washed with phosphate buffer (PBS) to remove planktonic cells. The remaining biofilm that was formed during incubation was stained with a 0.1% (w/v) solution of crystal violet by incubating at room temperature for 30 minutes. The CV solution was then removed, the well was washed and the portion of CV embedded into biofilm was extracted with ethanol. Biofilm quantification was done spectrophotometrically by measuring the absorbance of the extracts at 600 nm. As illustrated in FIG. 20, no biofilm was produced in the wells containing either Ag or Cu-coated cotton, however, non-treated cotton and 'cell only' controls showed the growth biofilms after the 24 hour inhibition.

6.2.4 Discussion

The deposition of metal nanoparticles on cellulose substrates has been achieved via electrostatic interactions between modified cellulose surfaces and oppositely charged metal nanoparticles or metal ions. The methods demonstrated in this example achieved very high surface coverage of metal nanoparticles on cotton fabrics. The color appearance of metal-cotton fabrics was uniform in samples resulting from direct assembly and from in situ synthesis methods (data not shown).

The deposition methods described in this example are also versatile. Various nonmetallic, bimetallic nanoparticles or other charged particles can be deposited onto modified cellulose substrates. In addition to cellulose, glass, carbon, metal or metal oxides and polymers are suitable substrates for the deposition of metal particles as demonstrated in this example.

Such coated substrates have applications for optical materials, magnetic materials, biological sensors and catalysts. They also have use as antibacterial materials, such as in wound dressings, antibacterial clothing and non-woven antibacterial filtration material. The methods for metal nanoparticle deposition demonstrated in this example have numerous applications, e.g., in fabric inkjet printing with nanoparticles, as flexible and portable catalytic mantles, and as seeds for electroless deposition of metal on cellulose substrates.

6.3 Example 3

Surface Bonding of Organic Particles on Cellulose Substrates 6.3.1 Summary

This example demonstrates surface bonding of polystyrenesulfonic acid (PSS) particles on cellulose substrates using direct assembly of PSS particles on cationic cellulose substrates.

6.3.2 Material and Methods

Cationic cellulose was prepared using the methods described in Section 6.2.3.

Spherical PSS colloidal particle suspensions at a concentration of 2.5% wt. were purchased from Polysciences, Inc. in diameters of 0.2, 0.5, and 1.0 micrometers and diluted with deionized water to 0.016 mg PSS spheres per mL of suspension. Mushroom cap shaped particles, approximately 1.2 micrometers in diameter, at a concentration 4.2% wt. were diluted with deionized water to 0.009 mg PSS particles per mL of suspension.

The process used to deposit PSS particles onto cationic cellulose was achieved by immersing the specimens into aqueous colloidal solutions of negatively charged PSS particles.

Direct assembly using negatively charged PSS particles in a colloidal solution and cationic cotton (cellulose) is shown in FIGS. 17A-B. Shown are SEM images of the surface of a cationic cotton fiber coated with (A) polystyrene sulfonate spheres size 1 micron in diameter, (B) polystyrene sulfonate mushroom cap particles size 1.2 microns in diameter.

The present invention is not to be limited in scope by the specific embodiments described herein. Indeed, various modifications of the invention in addition to those described herein will become apparent to those skilled in the art from the foregoing description. Such modifications are intended to fall within the scope of the appended claims.

All references cited herein are incorporated herein by reference in their entirety and for all purposes to the same extent as if each individual publication, patent or patent application was specifically and individually indicated to be incorporated by reference in its entirety for all purposes.

The citation of any publication is for its disclosure prior to the filing date and should not be construed as an admission that the present invention is not entitled to antedate such publication by virtue of prior invention.

What is claimed is:

1. A conformal coating for deposition on a non-planar surface of a substrate comprising a plurality of chemically functional particles, wherein:

the particles have a cross-sectional diameter of 2-2000 nm, the average distance between adjacent particles across the entire non-planar surface is no greater than 10 times the largest cross-sectional dimension of any particle in the plurality, and the attachment of the particles to the surface is through electrostatic self-assembly or covalent bonding.

2. The coating of claim 1 wherein the substrate is a polymer.

3. The coating of claim 1 wherein the substrate comprises a plurality of fibers.

4. The coating of claim 3 wherein the fibers have cross-sectional diameters of 10-100 μm.

5. The coating of claim 3 wherein the fibers are organic or inorganic.

6. The coating of claim 5 wherein the inorganic fibers comprise glass or ceramic.

7. The coating of claim 3 wherein the fibers are a bi-component or tri-component fibers.

8. The coating of claim 1 wherein the substrate is a textile.

9. The coating of claim 1 wherein the substrate comprises natural or synthetic carbohydrate-based fibers.

10. The coating of claim 1 wherein the substrate comprises natural protein-based fibers.

11. The coating of claim 1 wherein the substrate comprises organic synthetic fibers capable of participating in hydrogen bonding.

12. The coating of claim 1 wherein the particles are metallic.

13. The coating of claim 12 wherein the particles comprise metal or metal oxide.

14. The coating of claim 1 wherein the particles are organic.

15. The coating of claim 1 wherein the particles are inorganic and non-metallic.

16. The coating of claim 1 wherein the particles comprise $SiO_2$.

17. The coating of claim 1 wherein the particles are hybrid particles.

18. The coating of claim 1 wherein the particles are spherical and/or non-spherical.

19. The coating of claim 1 wherein the particles are functionalized.

20. A polymeric non-planar surface comprising the conformal coating of claim 1.

* * * * *